US011103069B2

(12) United States Patent
Shibamoto et al.

(10) Patent No.: US 11,103,069 B2
(45) Date of Patent: Aug. 31, 2021

(54) CHAIR

(71) Applicants: KOKUYO CO., LTD., Osaka (JP); TAKANO CO., LTD., Nagano (JP)

(72) Inventors: Yasuhiro Shibamoto, Osaka (JP); Takao Sugano, Osaka (JP); Kensuke Nakamura, Kamiina-gun (JP); Tomoaki Ichikawa, Kamiina-gun (JP); Kenta Shiozawa, Kamiina-gun (JP)

(73) Assignees: KOKUYO CO., LTD., Osaka (JP); TAKANO CO., LTD., Nagano (JP)

( * ) Notice: Subject to any disclaimer, the term of this patent is extended or adjusted under 35 U.S.C. 154(b) by 32 days.

(21) Appl. No.: 16/614,571

(22) PCT Filed: Jun. 20, 2017

(86) PCT No.: PCT/JP2017/022760
§ 371 (c)(1),
(2) Date: Nov. 18, 2019

(87) PCT Pub. No.: WO2018/235175
PCT Pub. Date: Dec. 27, 2018

(65) Prior Publication Data

US 2020/0085195 A1 Mar. 19, 2020

(51) Int. Cl.
*A47C 3/026* (2006.01)
*A47C 3/025* (2006.01)
*A47C 7/00* (2006.01)

(52) U.S. Cl.
CPC ..... *A47C 3/026* (2013.01); *A47C 3/0255* (2013.01); *A47C 7/006* (2013.01)

(58) Field of Classification Search
CPC ..... A47C 3/026; A47C 3/0255
See application file for complete search history.

(56) References Cited

U.S. PATENT DOCUMENTS

2008/0093905 A1 4/2008 Maier et al.
2015/0265052 A1 9/2015 Gehner et al.
(Continued)

FOREIGN PATENT DOCUMENTS

EP 1192882 A2 4/2002
EP 1 401 306 B1 2/2007
(Continued)

OTHER PUBLICATIONS

International Search Report dated Jul. 18, 2017, issued in counterpart International Application No. PCT/JP2017/022760, with English Translation. (4 pages).
(Continued)

*Primary Examiner* — Anthony D Barfield
(74) *Attorney, Agent, or Firm* — Westerman, Hattori, Daniels & Adrian, LLP

(57) ABSTRACT

In view of various movement of a seated person, when giving the left-right swinging operation to the seat in the non-conventional aspect, a chair configured such that the back can perform a new movement suitable for the left-right movement of the seat and return to the predetermined position when the seated person leaves a seat, is realized. For the purpose, a back 6 is arranged behind a seat 5, and the back 6 has an operation mechanism 6M turning-movably supporting the load received from a seated person in a left-right direction in a front view, and when the load is applied, at least a part of guide part 65*a*, 66*a* of the operation mechanism 6M is separated and the back moves freely, and when the applied load is removed, the back automatically returns to the neutral position along the guide part 65*a*, 66*a*.

18 Claims, 46 Drawing Sheets

(56) References Cited

U.S. PATENT DOCUMENTS

| | | | |
|---|---|---|---|
| 2016/0081483 | A1 | 3/2016 | Harrison et al. |
| 2016/0159254 | A1 | 6/2016 | Katoh et al. |

FOREIGN PATENT DOCUMENTS

| | | | |
|---|---|---|---|
| EP | 2387913 | A1 | 11/2011 |
| JP | 46-533 | Y1 | 1/1971 |
| JP | 3555175 | B2 | 8/2004 |
| JP | 3135597 | | 9/2007 |
| JP | 2008-100066 | A | 5/2008 |
| JP | 2009-131357 | A | 6/2009 |
| WO | 2015/011803 | A1 | 1/2015 |

OTHER PUBLICATIONS

Extended (Supplementary) European Search Report dated Sep. 22, 2020, issued in counterpart EP Application No. 17914176.7. (7 pages).

[Conceptual diagram of left-right stopper]

[Conceptual diagram of front-rear stopper]

[Conceptual diagram of front-rear stopper when seated person leaves seat]

CHAIR

TECHNICAL FIELD

The present invention relates to a chair suitably used at office and the like.

BACKGROUND ART

A chair which changes the direction and the angle of the backrest in accordance with the change of a seated person's posture, has conventionally existed. (for example, Patent Document 1 to 5)

A chair described in Patent Document No. 1 is configured such that a pair of back plates is each attached to a frame through rubber parts, moves rotationally upward and downward and turns leftward and rightward while compressing the rubber parts and storing repulsion.

A chair described in Patent Document 2 is configured such that an upper half of the back of automobile sheet turns around the vertical axis while storing repulsion.

A chair described in Patent Document 3 is configured such that a back and a seat are integrally provided, a lower part of the seat is rollably supported around a fulcrum, and when rolling, the back and the seat compress rubber parts disposed around the lower part of the seat, and the repulsion that the back and the seat return to the reference position, is produced.

In a chair described in Patent Document 4, a back and a seat are integrally provided. A configuration is enclosed that a part of the back is fixed at fulcrum, and centering around this fulcrum, the back and the seat deform in such a way as to twist leftward and rightward in a front view with the elasticity of the back and the seat in accordance with the movement of a seated person.

A chair described in Patent Document 5 is configured such that a back and a seat are separated into a plurality of compartments, a part of the back and the seat among the components is partially separated so as to be partially easily deformed, accordingly the area between the compartments is easily twisted and the degree of deformation is increased.

CITATION LIST

Patent Literature

Patent Document 1: Japanese Utility Model Registration No. 3135597

Patent Document 2: Japanese Patent No. 3555175

Patent Document 3: US Patent Publication No. 2016-0081483

Patent Document 4: US Patent Publication No. 2015-0265052

Patent Document 5: EP Patent No. 1401306

SUMMARY OF THE INVENTION

Problem to be Solved by the Invention

By the way, keeping the same posture on a seat for a long time is painful and a user continues to sit on a chair while changing the posture unconsciously. For this change of the posture, in order to change the rate of left-right load to prevent the pressure to gluteal region or femoral region, it is natural that twisting operation of the body is performed so that one of right and left of lower body, especially, gluteal region moves up, and the other moves down, while upper body moves in the opposite direction with keeping balance. Seen from the front side, left-right turning operation of a back is performed.

However, the chairs described in Patent Documents 1 and 2 just perform a rotating operation around vertical shaft. Therefore, the movement of a back does not match the above-described movement of the seated person and it is difficult to appropriately support the seated person.

Meanwhile, in the chair described in Patent Document 3, a back and a seat perform a turning operation, however, the back and the seat greatly incline in the same direction and this gives an imbalance to a seated person and it is also difficult for the seated person to rebalance.

Furthermore, in the chair described in Patent Document 4, the back performs a rotating operation so as to twist around a fulcrum and at the same time, the seat deforms. Therefore, when considering the movement of lower body and the movement of upper body, it cannot be said that the movement of the back and the seat matches the movement of the back of the seated person.

Further, in the chair described in Patent Document 5, the degree of deformation freedom is high, and on the other hand, a repulsion force to return to the original position easily becomes insufficient and supporting force becomes poor.

Especially, in view of various movement of the seated person, when pursuing provision of a non-conventional front, rear, left and right swinging operation to the seat, it is required that the back performs a new movement suitable for the left-right movement of the seat.

The present invention focuses on these problems, and in view of various movement of the seated person, in order to provide the left-right swinging operation to the seat in non-conventional aspect, an object thereof is to realize a chair wherein a back is capable of performing a new movement suitable for the left-right movement of the seat and returning to the predetermined position when the seated person leaves a seat.

Means for Solving the Problem

The present invention adopts the following means to achieve such object.

That is, a chair according to the present invention, wherein the chair is configured such that a back is arranged behind a seat, and the back has an operation mechanism turning-movably supporting the load received from a seated person in a left-right direction in a front view, and when the load is applied, at least a part of guide part of the operation mechanism is separated and the back moves freely, and when the applied load is removed, the back automatically returns to the neutral position along the guide part.

With the configuration described above, the back is turning-movable in a front view in a left-right direction, and when the load is applied, at least a part of guide parts of the operation mechanism is separated, and the back moves freely. Therefore, it can be easily adapted to various movement of the seated person. Further, when the seated person leaves a seat, the back reliably returns to the neutral position along guide parts. Therefore, even if the degree of freedom of back movement is increased, a plurality of chairs is easily uniform in appearance when the seated person leaves a seat. Further, it is possible to avoid the situation in that the initial condition of the chair is changed every time the seated person sits on the seat.

When considering the load balance to a turning direction, it is desirable that the chair is configured such that a reaction force with which the back returns to the neutral position becomes larger in accordance with an amount of turning movement to both of the left and right directions.

To easily incorporate the operation mechanism, it is desirable that the back is configured such that a backrest is supported by a back frame via the operation mechanism, the back frame is erected at the rear of the seat, and the backrest is turning-movably attached to the back frame substantially clockwise or counterclockwise direction in a front view via the operation mechanism.

To realize an appropriate supporting force and returning force, it is desirable that the back is configured such that a backrest is supported by the back frame via the operation mechanism, and the backrest moves via the operation mechanism having an elastic body toward the rear direction and the turning direction against an elastic reaction force.

To realize a support which matches the body movement of the seated person, it is desirable that the backrest is configured such that a turning range to the left-right direction becomes larger in accordance with the movement in the rear direction with respect to the back frame.

To realize an appropriate supporting condition corresponding to the seated person's posture, it is desirable that the chair is configured such that the seat is swingable in the left-right direction in a front view, and the back performs a left-right turning operation separated from the seat.

To incorporate as operation unit for various purposes, it is desirable that the operation mechanism is provided with a base part and a tilting part, and includes a reference position, a guide part set at the side of the base part and a guide part set at the side of the tilting part are in pressure contact with each other to be guided by the shapes of the guide parts and stopped at the reference position, and when the pressure contact is loosened by the received pressure from the seated person, the base part and the tilting part can be relatively changed from the reference position in accordance with the degree of the received pressure.

To support the load of backrest and return to the reference position in an appropriate manner, it is desirable that the chair is configured such that the pressure contact of the both guide parts is formed by the elastic body and the elastic body is pressed by the received pressure, whereby the guide part of the tilting part and the guide part of the base part are separated.

To facilitate assembly, it is desirable that the operation mechanism includes: the base part fixed to the backrest and provided with the elastic body on the back surface side of the base part; the tilting part disposed at a position adjacent to the base part and including a guide part recessed in a tapered shape at the back surface side of the tilting part, the bottom part of the guide part having an opening; and a pressing tool including a guide part having a convex shape corresponding to the guide part of the tilting part on the front surface side of the pressing tool, the pressing tool being fixed to the base part via the opening of the tilting part in a state where the guide part of the pressing tool is fitted into the guide part of the tilting part, and the tilting part is fixed to the received pressure part provided at the upper end part of the back frame.

To increase a positioning function at the reference position, it is desirable that one guide part has a substantially partially elliptical mortar-like shape including at least one valley line and the other guide part has a curved shape having at least one ridge line fitted smoothly into the valley line, and the valley line and the ridge line can be fitted into each other.

As the other configuration to easily realize the operation mechanism one guide part of the both guides are a shaft-shaped part extended upward and downward, or leftward and rightward and the other guide part is a V-groove leading the upper-lower or left-right shaft-shaped part to the center position.

To prevent concentration of the local load in the guide part, it is desirable that the base part and the tilting part are provided with engaging parts configured to regulate a relative movement of the base part and the tilting part in collaboration with the guide parts.

To effectively correspond to behavior of the back that the upper edge of the backrest moves backward or forward and the lower edge of the backrest moves forward or backward, it is desirable that one guide part has three protrusion parts and the other part is in a shape which receives the three protrusion parts, and an elastic body is placed between the one guide part and the other guide part.

Effect of the Invention

According to the present invention, in view of various movement of a seated person, when giving the left-right swinging operation to the seat in the non-conventional aspect, it is possible to provide a new chair wherein the back can perform a new movement suitable for the left-right movement of the seat and return to the predetermined position when the seated person leaves a seat.

MODE FOR CARRYING OUT THE INVENTION

Figure 1:
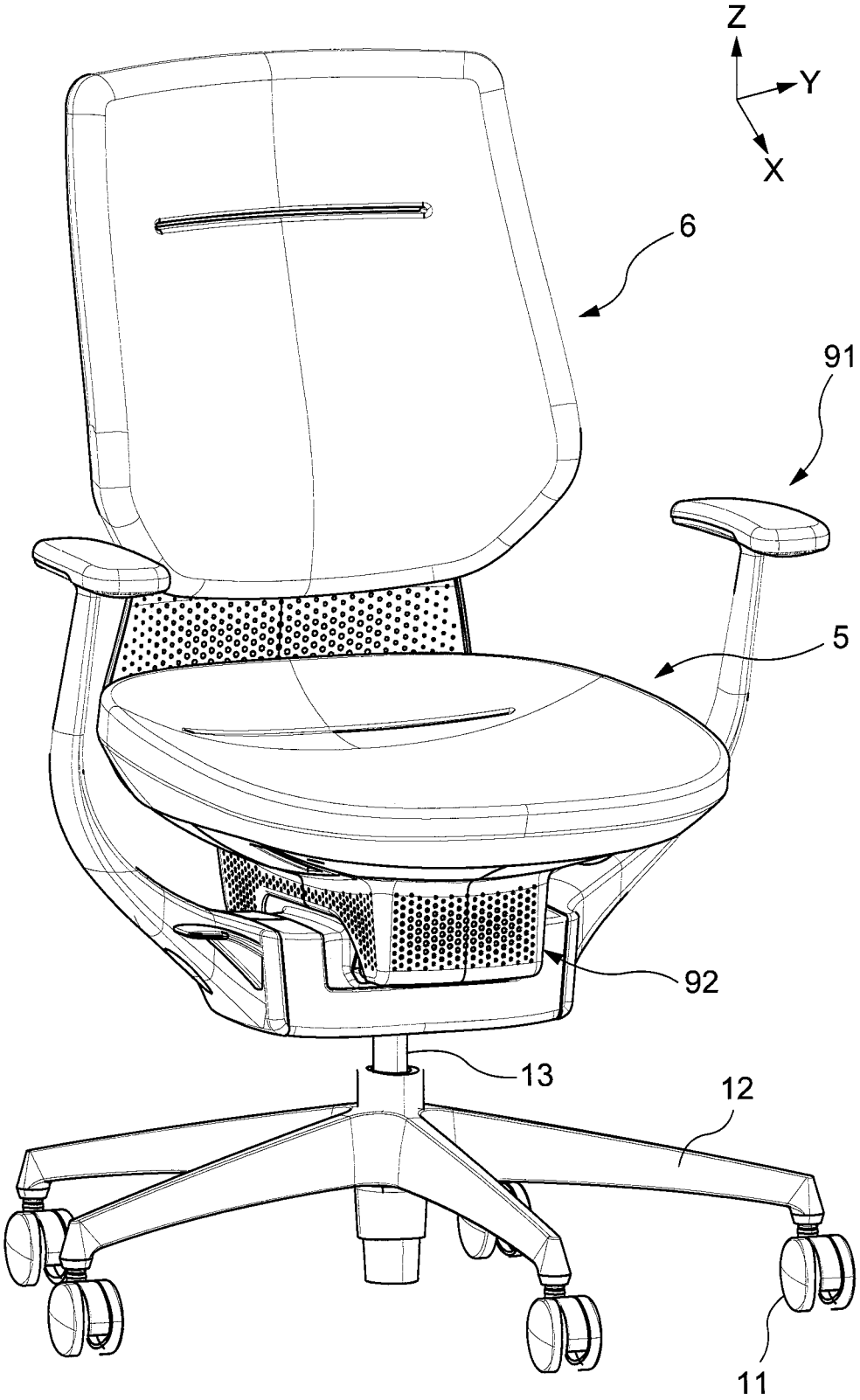
FIG. 1 is a perspective view, as viewed obliquely from the front, of a chair according to an embodiment of the present invention.

An embodiment of the present invention will be described below with reference to the drawings.

As illustrated in FIGS. 1 to 5, this chair is an office chair configured by erecting a leg supporting post 13 incorporating a lifting/lowering mechanism therein, in a central part of a leg vane 12 supported by a caster 11, and attaching a support base part 2 rotatably at an upper end side of the leg supporting post 13. In the support base part 2, a seat 5 being a movable part is supported via a front-rear swing part 3 as a one-direction operating part (movable part) operable any one of a front-rear direction (X-direction in the drawings) and a left-right direction (Y-direction in the drawings) being two directions crossing each other, and a left-right swing part 4 being an other-direction operating part (support part) operable in the other of the front-rear direction and the left-right direction and the seat 5 can swing in the front-rear direction and the left-right direction with respect to the support base part 2. Specifically, the front-rear swing part 3 is provided between the seat 5 and the support base part 2 configured to support the seat 5, and the left-right swing part 4 is provided between the front-rear swing part 3 and the support base part 2. Behind the seat 5, a back 6 is arranged.

The support base part 2 functions as a structured body for receiving the load applied by seated person, and in the support base part 2, a left-right pair of arm attachment parts 23 is integrally formed with the support base part 2 via a bearing base part 22 on both left and right sides of a support base main body 21 including a through hole 21*a* along an up-down direction into which an upper end of the leg supporting post 13 is inserted. A shaft swing damper 21*b* is attached to the hole 21*a* opening on the surface of the support base main body 21 in the front-rear direction and upper ends of left-right swing links L1, L2 are attached to holes 22*a* opening on the front and rear surfaces of the bearing base part 22, via swing support shafts S1, S2.

Figure 4:
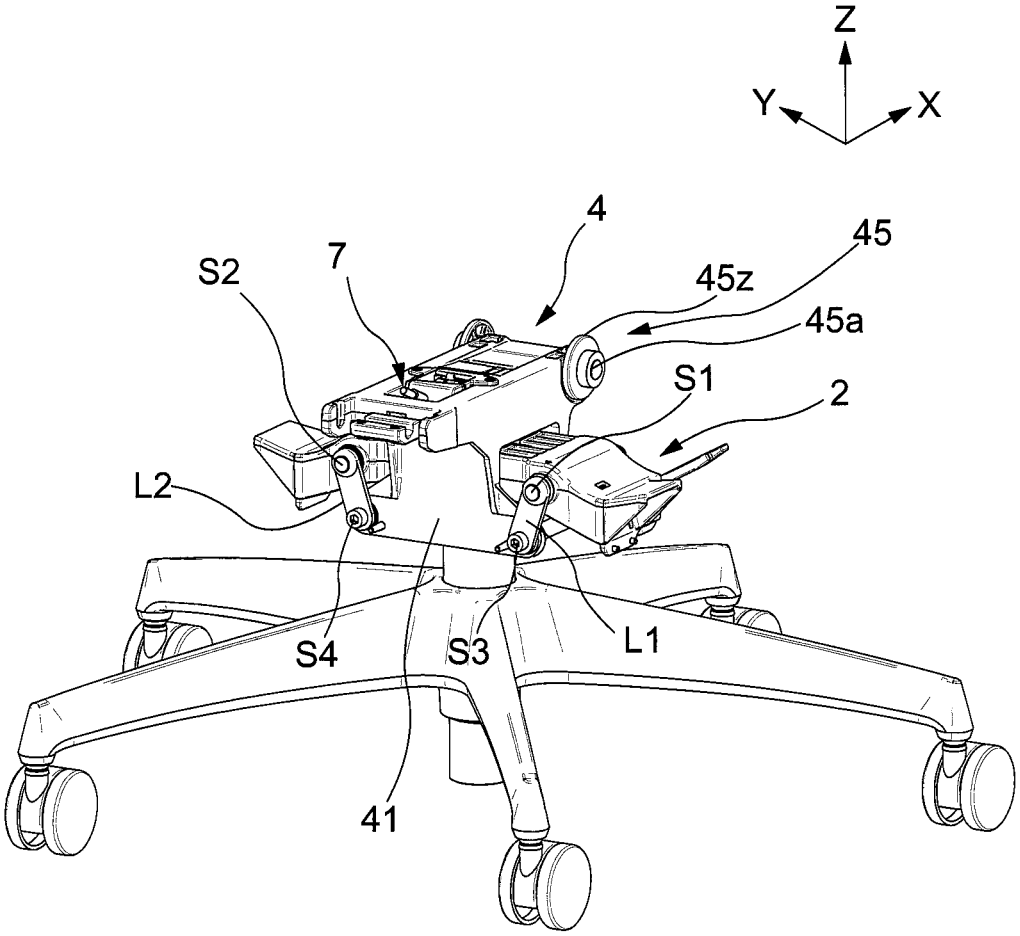
FIG. 4 is a perspective view illustrating a state where a left-right swing part is incorporated in a support base part of the chair.
Figure 5:
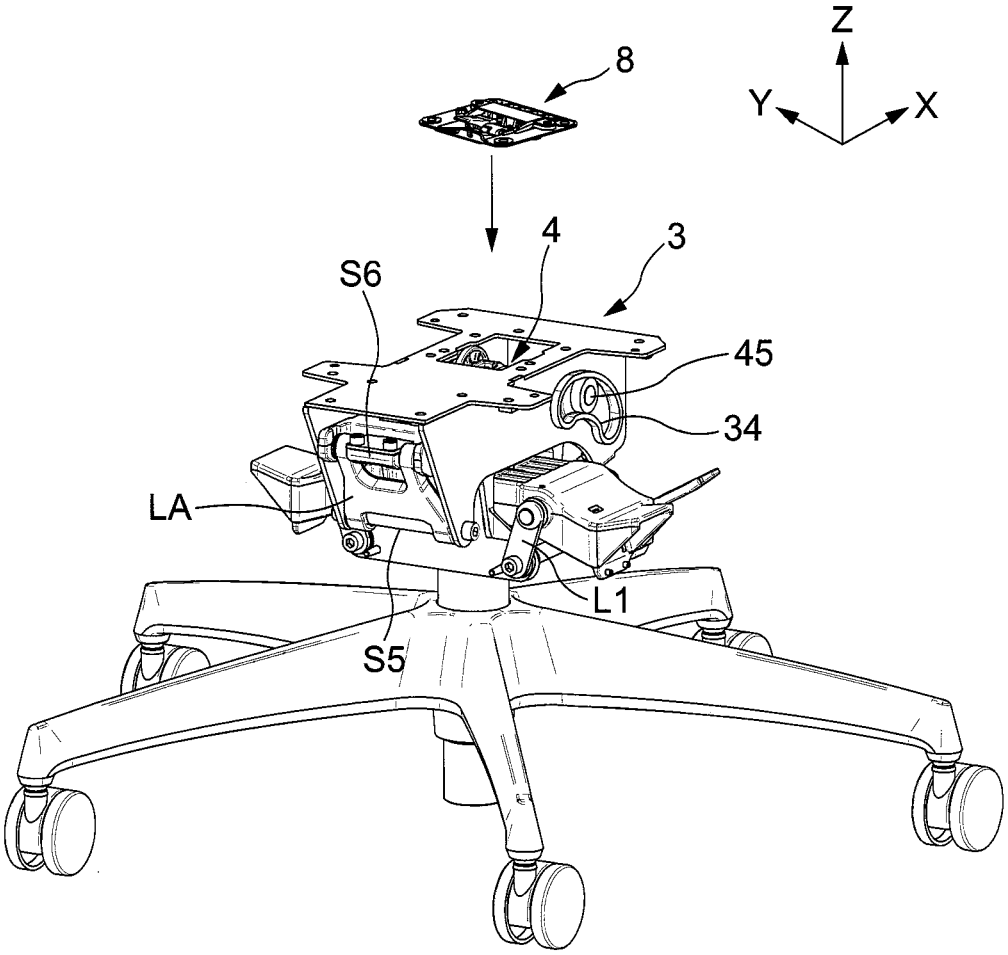
FIG. 5 is a perspective view illustrating a state where a front-rear swing part is incorporated in the left-right swing part.
Figure 6:
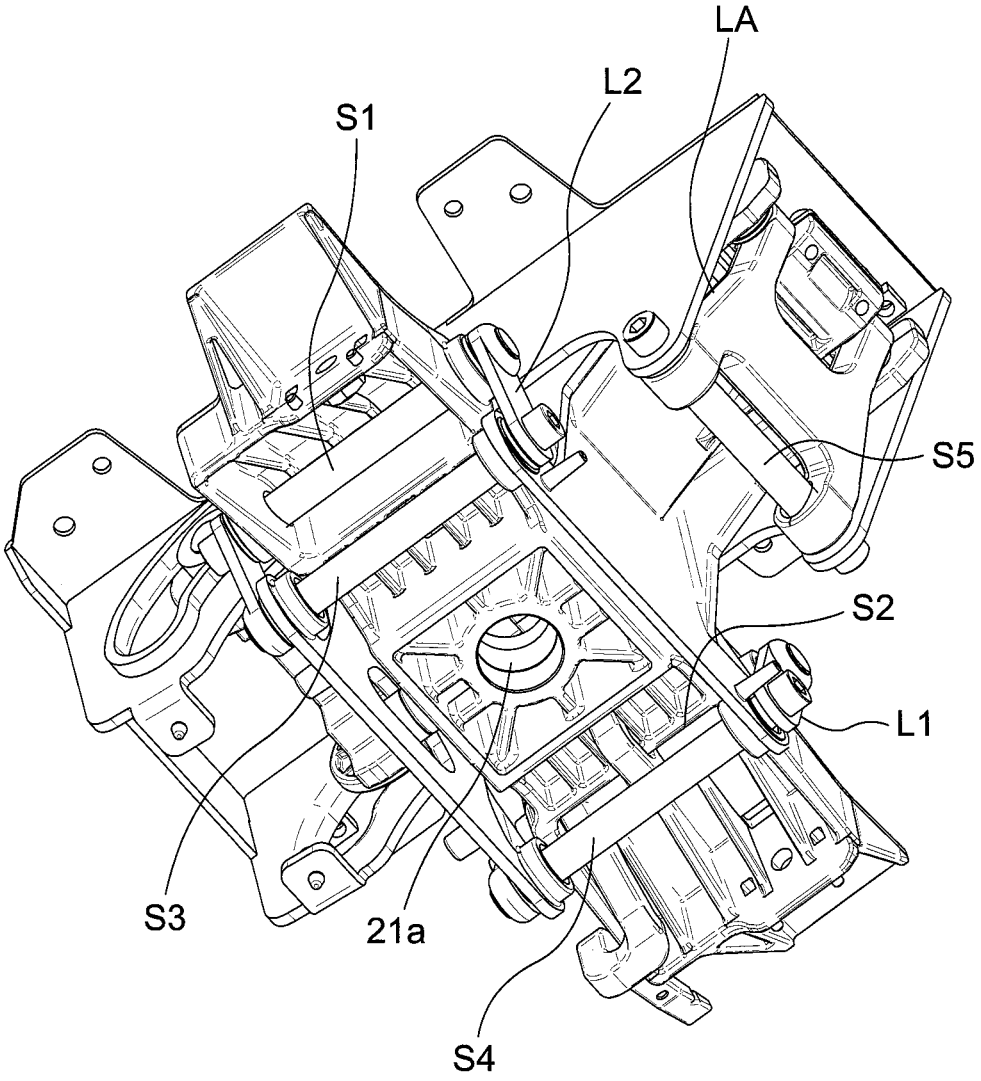
FIG. 6 is a perspective view of a part of FIG. 5, as viewed obliquely from below.
Figure 7:
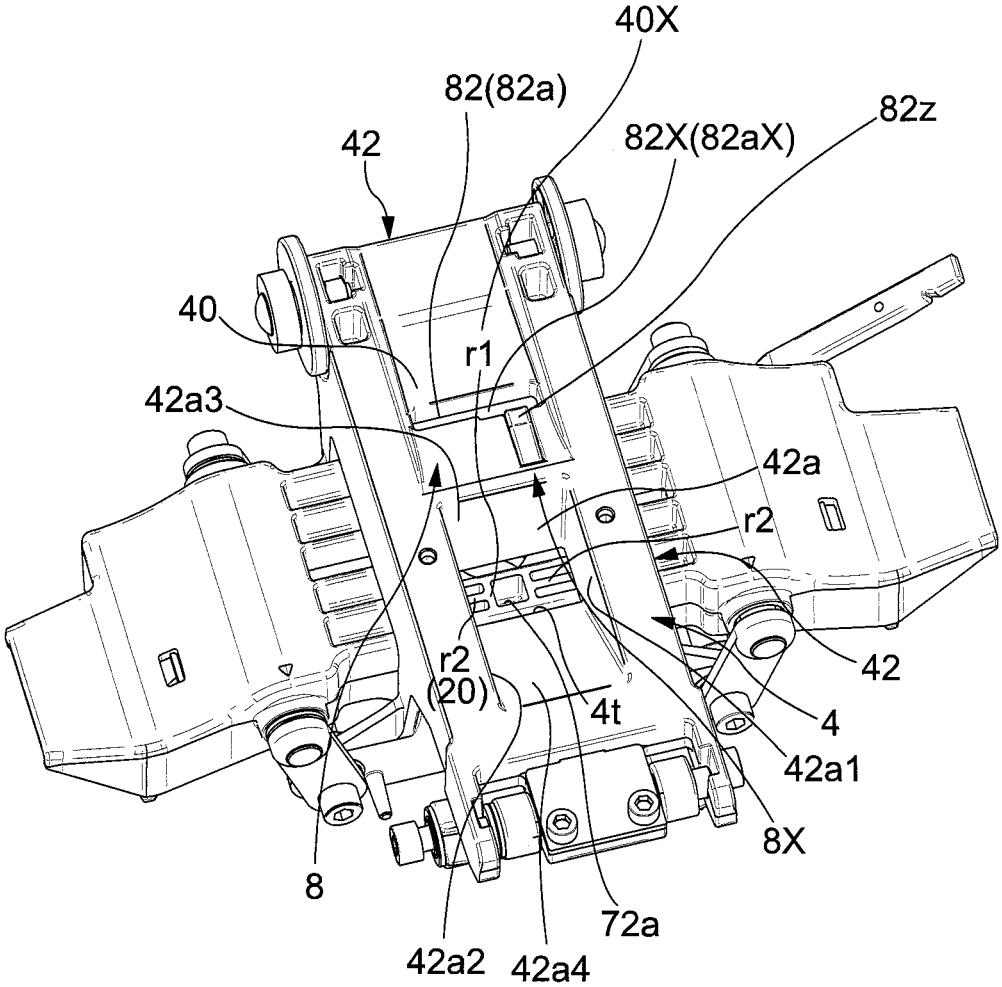
FIG. 7 is an enlarged perspective view illustrating a part of FIG. 4.
Figure 8:
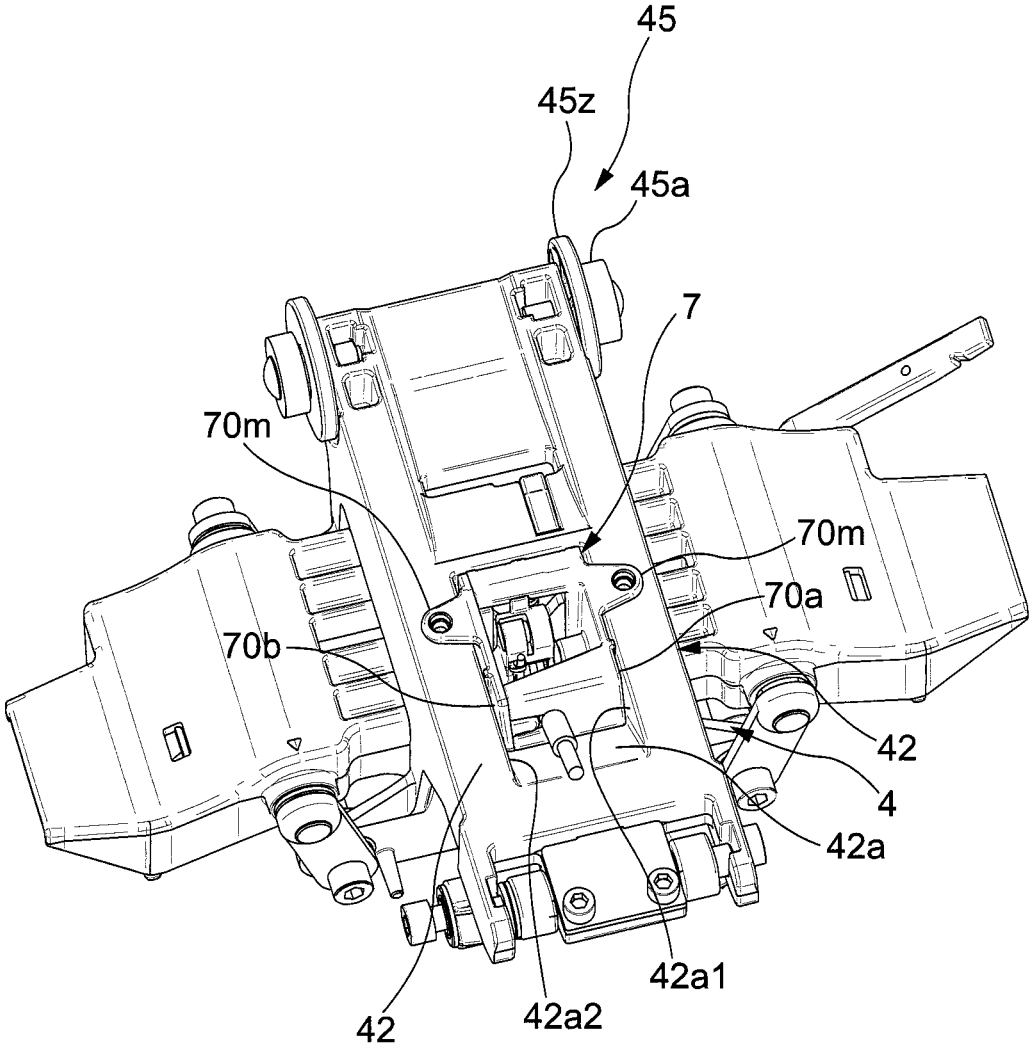
FIG. 8 is a perspective view of a state where a left-right stopper mechanism is incorporated in FIG. 4.

The left-right swing part 4 includes a pair of plate-shaped link bases 41 disposed separated from each other in the front-rear direction to perform a swinging operation in the left-right direction with respect to the support base part 2, and a left-right swing main body 42 configured to connect the pair of link bases 41, 41. At both left and right ends of the link bases 41, holes 41*a*, 41*a* are opened and the lower ends of the left-right swing links L1, L2 are attached via swing shafts S3, S4. FIG. 4 illustrates a state where the links L1, L2 are attached via the swing shafts S1 to S4. As illustrated in FIGS. 7 and 8, the left-right swing main body 42 is provided with a unit attached hole 42*a* penetrating in the up-down direction, and a later-described left-right lock part 7 is attached to the unit attached hole 42*a*. That is, the left-right swing main body 42 is disposed in a suspended state to be swingable to the left and right with respect to the support base part 2 via the left-right swing links L1, L2, and the left-right swing links L1, L2 are attached so that the distance between the lower ends is smaller than the distance between the upper ends, as illustrated in FIG. 4 and the like.

Figure 9:
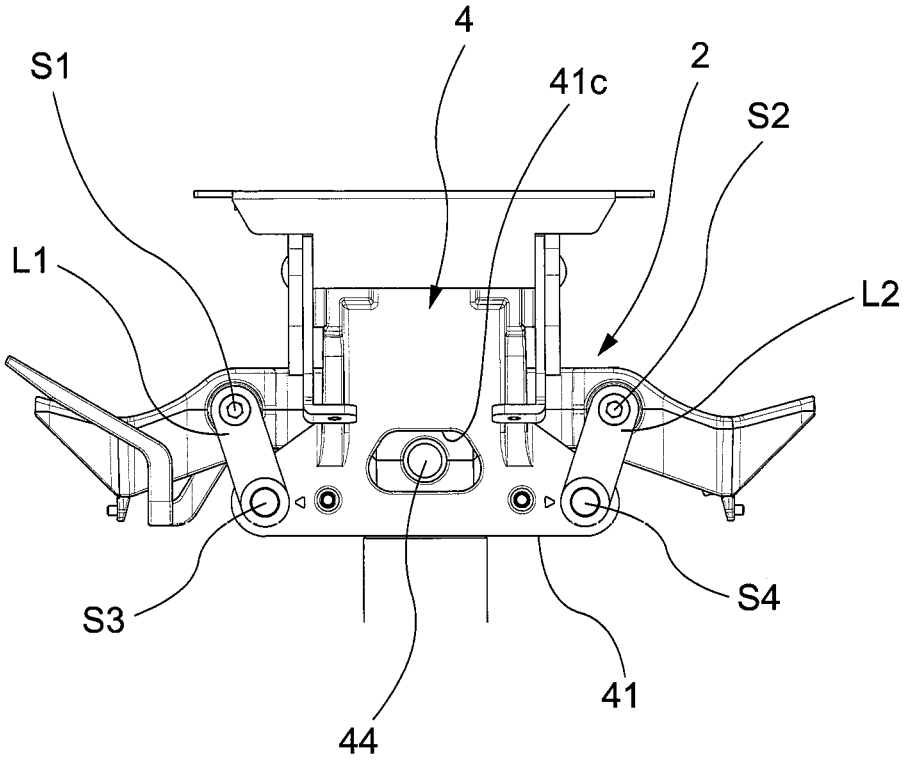
FIG. 9 is an operation explanatory diagram of the left-right swing part.
Figure 10:
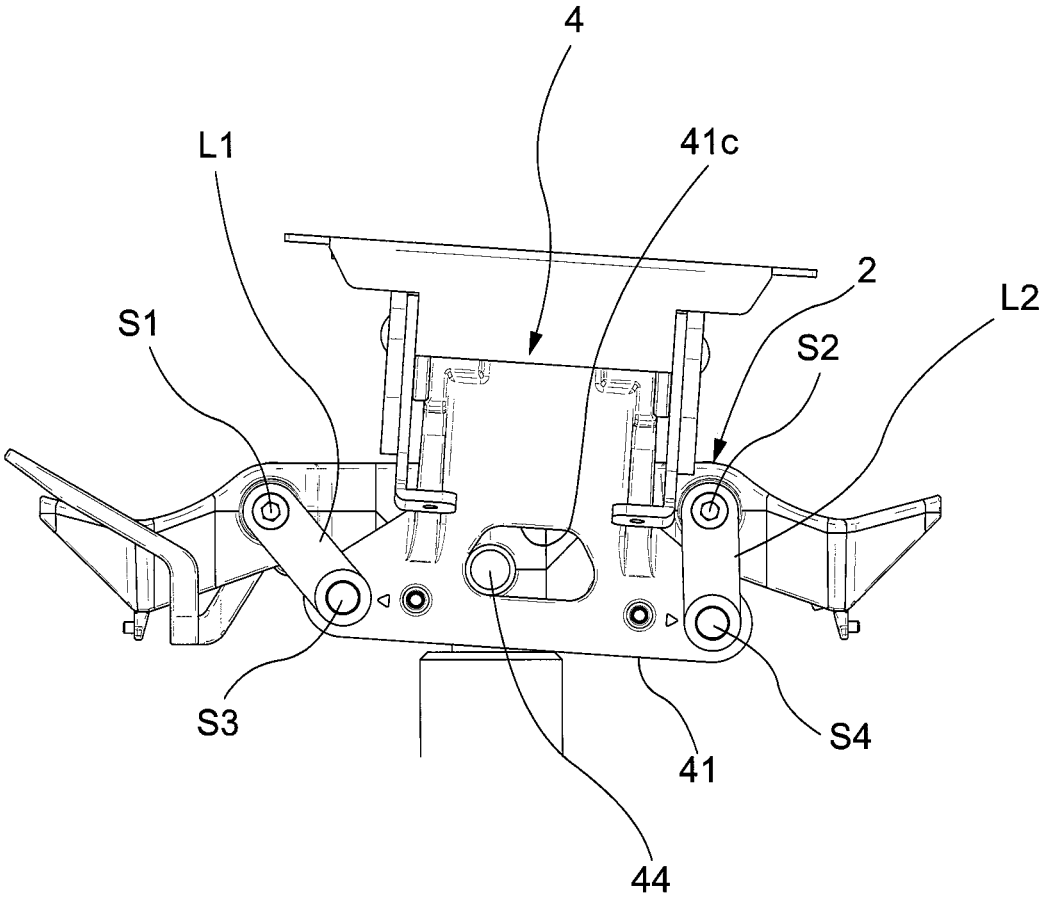
FIG. 10 is an operation explanatory diagram of the left-right swing part.

That is, as illustrated in FIGS. 9 and 10, when the left-right swing part 4 swings, the link L2 (L1) located at the swing destination approaches a vertical posture and the other link L1 (L2) approaches a horizontal posture, as a result of which an operation is performed in which a center of gravity of the left-right swing part 4 is lifted while tilting so that a moving tip side is lower.

A window 41*c* is opened at the center of the link base 41, a rolling damper 44 is positioned in the window 41*c*, and a swing range of the left-right swing part 4 is restricted to a range where the rolling damper 44 can perform a relative movement within the window 41*c*.

Figure 16:
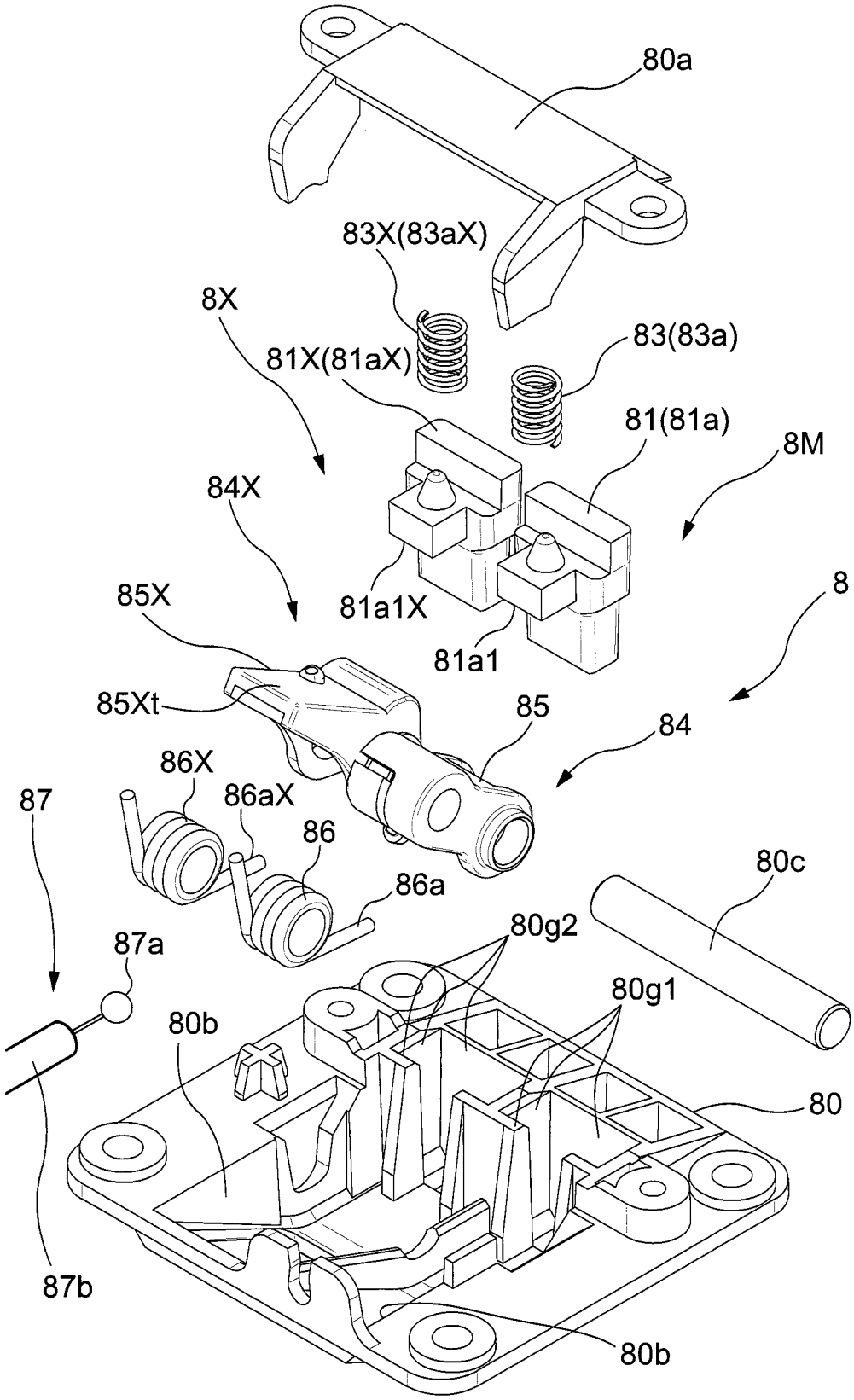
FIG. 16 is an exploded perspective view of a control mechanism and a front-rear stopper mechanism configured to suppress a front-rear operation.

The front-rear swing part 3 includes a pair of plate-shaped rail plates 31, 31 disposed separated from each other in the left-right direction to perform a swinging operation in the front-rear direction with respect to the left-right swing part 4, and an upper connection plate 32 and a front connection plate 33 configured to connect the pair of rail plates 31, 31. At a front side of the rail plates 31, a guide hole 34 is provided to penetrate the rail plates 31, a bearing 45*a* is engaged in the guide hole 34, and the bearing 45*a* is a rolling body 45 provided to be rollable independently to the left and right on a side surface at a front end side of the left-right swing main body 42. The reference sign 45*z* in the drawings indicates a spacer disposed on an inner surface side of the rail plate 31 and having a diameter larger than that of the bearing 45*a*. The rear end side of the rail plate 31 extends rearward and downward, a lower end of a link arm LA, being a swingable front-rear swing link, is attached via a swing shaft S5 to an extension end of the rail plate 31, and the upper end of the link arm LA is supported by the rear end of die left-right swing part 4 via a swing shaft S6. That is, the rear end of the front-rear swing part 3 is disposed in a suspended state to be swingable forward and rearward with respect to the left-right swing part 4 via the link arm LA. The guide hole 34 has a shape that is gently curved forward and downward from the rear end side toward the front end side, and at the rear end, there is provided a shockless part SL configured to mitigate a shock when the front-rear swing part 3 moves forward together with the seat 5. The upper connection plate 32 is provided with a unit attached hole 32*a* penetrating in the up-down direction, and a front-rear lock unit 8 described later based on FIG. 16 is attached to the unit attached hole 32*a*. Axles of the bearing 45*a* being the rolling body 45 in the example of the drawings are separated to the left and right. However, as long as the bearing 45*a* being the rolling body 45 is rollable independently to the left and right, the axle may be common.

Figure 11:
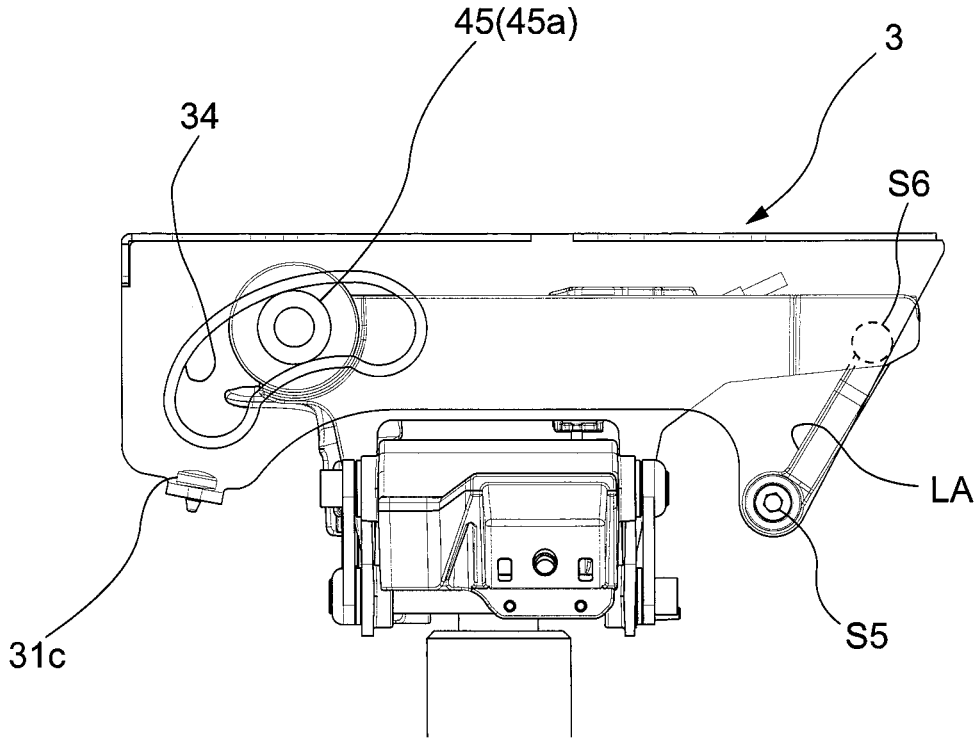
FIG. 11 is an operation explanatory diagram of the front-rear swing part, a part of which is illustrated transparently.
Figure 12:
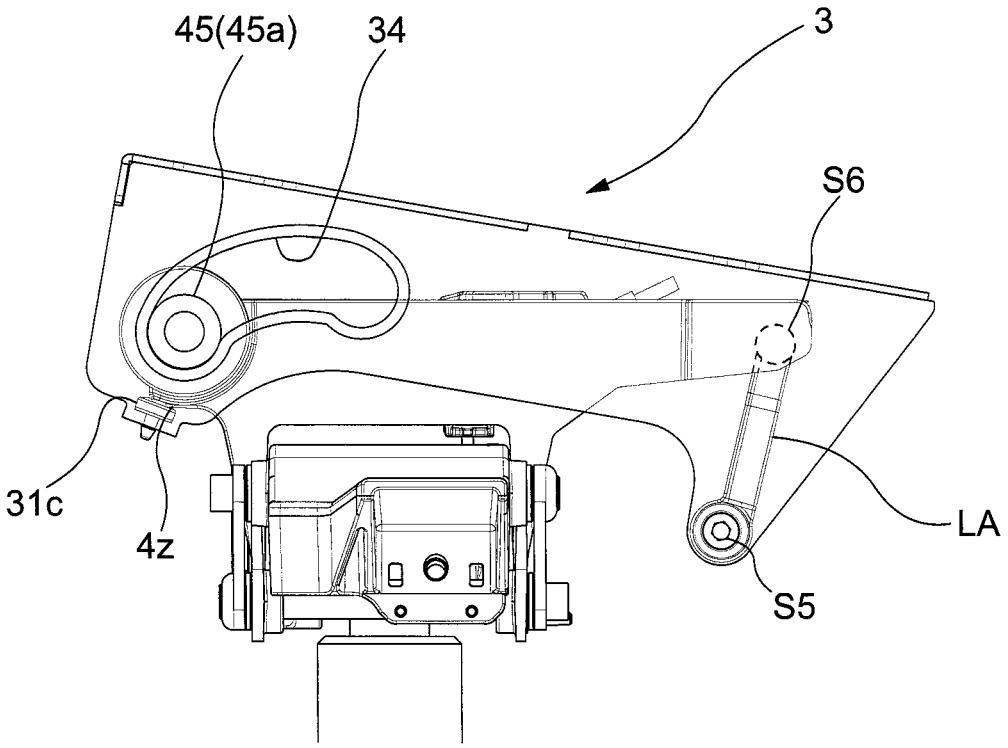
FIG. 12 is an operation explanatory diagram of the front-rear swing part, a part of which is illustrated transparently.
Figure 13:
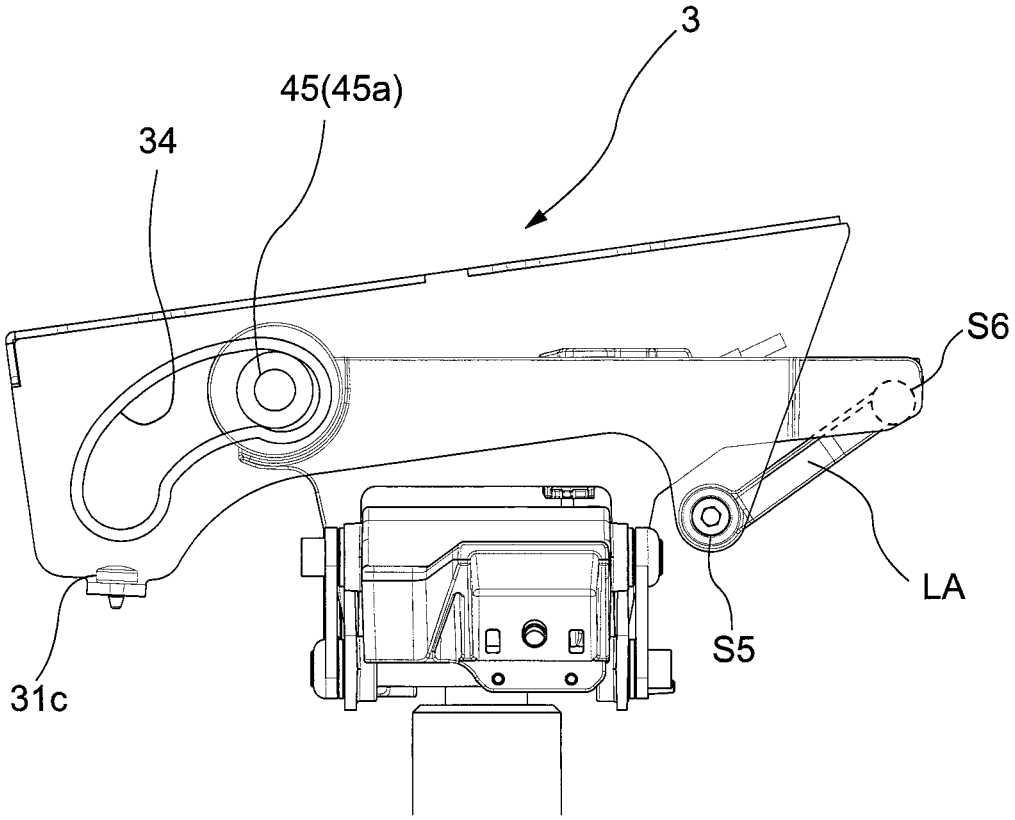
FIG. 13 is an operation explanatory diagram of the front-rear swing part, a part of which is illustrated transparently.

That is, if the front-rear swing part 3 moves rearward, as illustrated in FIG. 12, from the state of FIG. 11 where the upper surface of the front-rear swing part 3 takes a substantially horizontal posture, the bearing 45*a* performs a relative movement with respect to the front end side of the guide hole 34 at the front end of the front-rear swing part 3, so that the front end side of the front-rear swing part 3 is lifted to a high position, and the link arm LA approaches a vertical posture. As a result, an operation is performed where the rear end side of the front-rear swing part 3 is guided to a lower position. Conversely, when the front-rear swing part 3 moves forward, as illustrated in FIG. 13, from the state of FIG. 11, the bearing 45*a* performs a relative movement with respect to the rear end side of the guide hole 34 at the front end of the front-rear swing part 3, so that the front end side of the front-rear swing part 3 is guided to a lower position, and the link arm LA approaches a horizontal posture. As a result, an operation is performed where the rear end of the front-rear swing part 3 is lifted to a higher position. That is, the front-rear swing part 3 performs an inclining operation so that the moving tip side is also lower in the front-rear direction.

On the front end side of the rail plate 31 included in the front-rear swing part 3, a pitching damper 31*c* formed by bending a part of the rail plate 31 is provided, and when swinging rearward, the front-rear swing part 3 abuts against a front end lower part 4*z* (see FIG. 3) of the left-right swing part 4 in the vicinity of the swing end to mitigate the shock at the rearward movement end.

Figure 14:
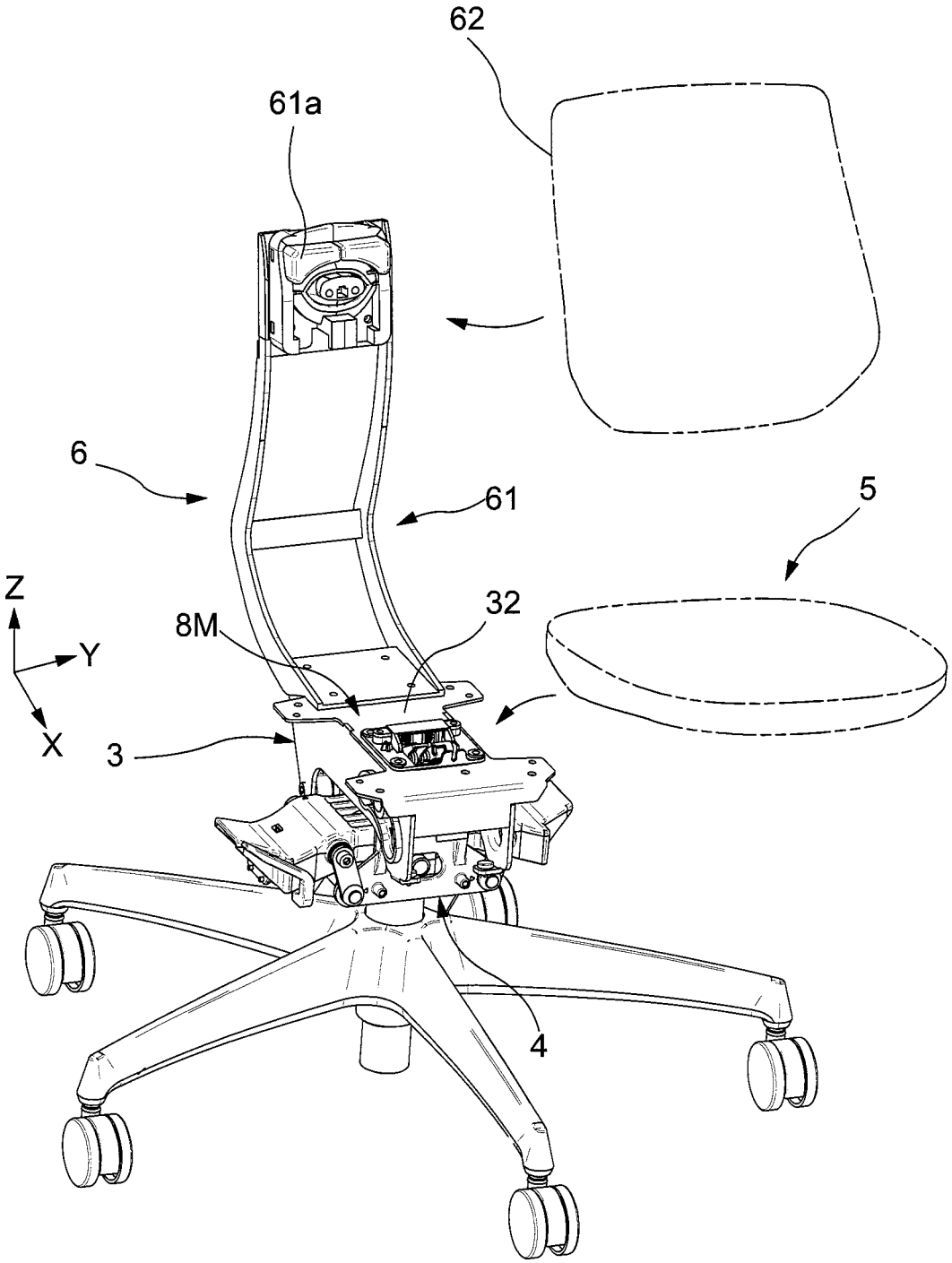
FIG. 14 is an exploded perspective view illustrating a relationship between the front-rear swing part and a back.

As illustrated in FIG. 14, a back frame 61 included in the back 6 is attached to a rear part of the upper connection plate 32 included in a front-rear swing part 3, and a seat outer shell 51 (see FIG. 15) included in the seat 5 is attached to the connection plate 32 from above. That is, when the back frame 61 configured to support a backrest 62 is erected integrally behind the seat 5 and the seat 5 swings in the front-rear and left-right directions with respect to the support base part 2, as indicated by X and Y in the thawing, the back frame 61 also moves together with the seat 5, but the backrest 62 according to the present embodiment operates separately from the back frame 61 and the seat 5, as described later.

Figure 15:
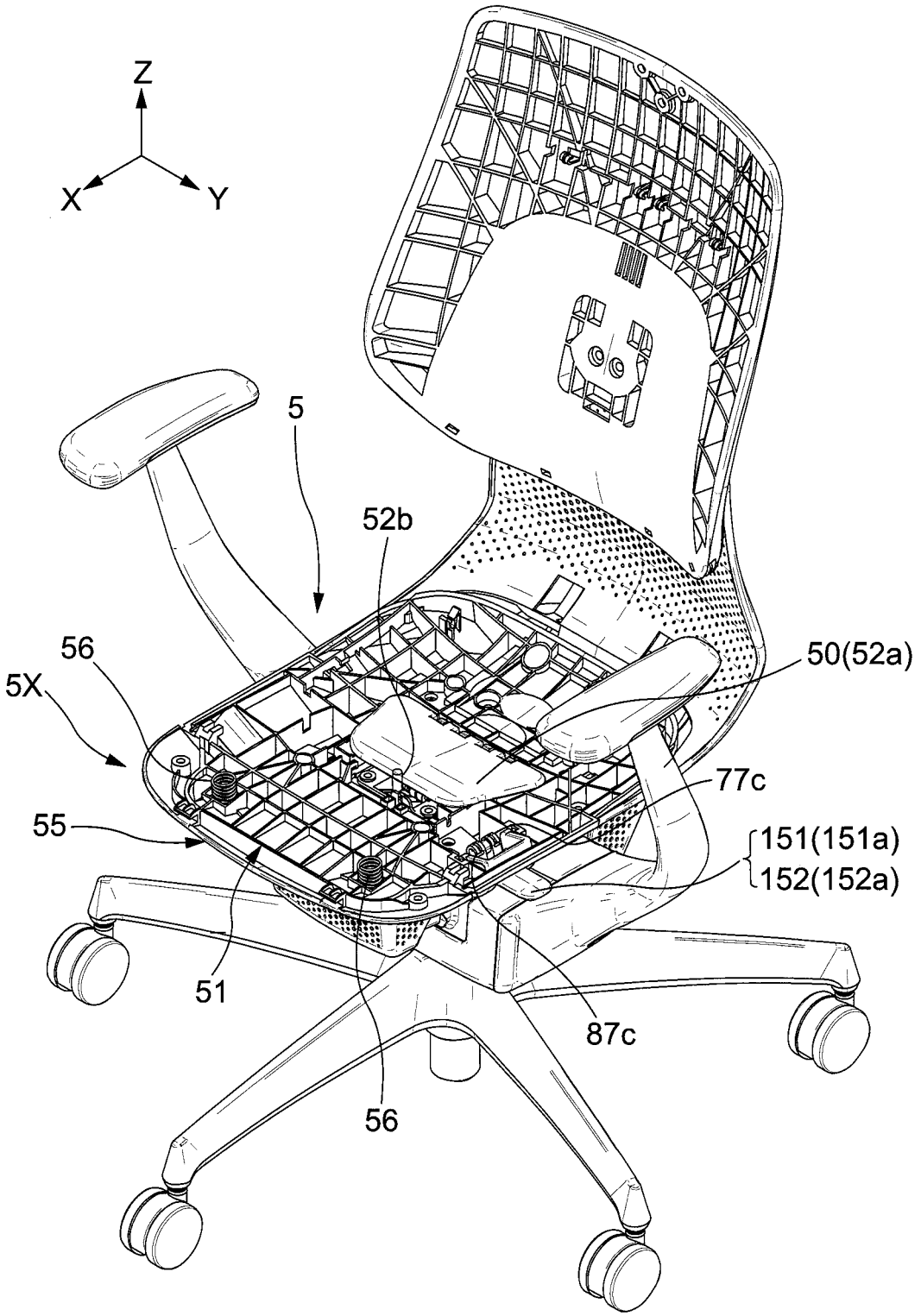
FIG. 15 is a perspective view illustrating a weight-receiving part provided on a seat.
Figure 17:
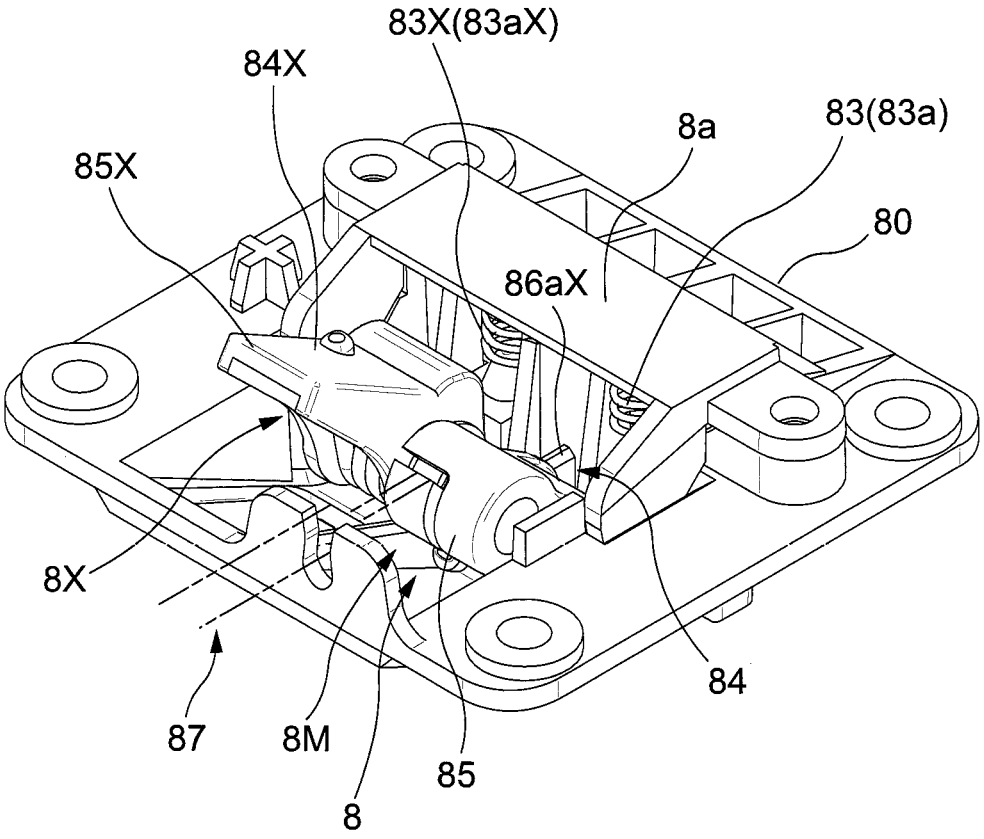
FIG. 17 is a perspective view of the assembled control mechanism and front-rear stopper mechanism configured to suppress a front-rear operation.
Figure 18:
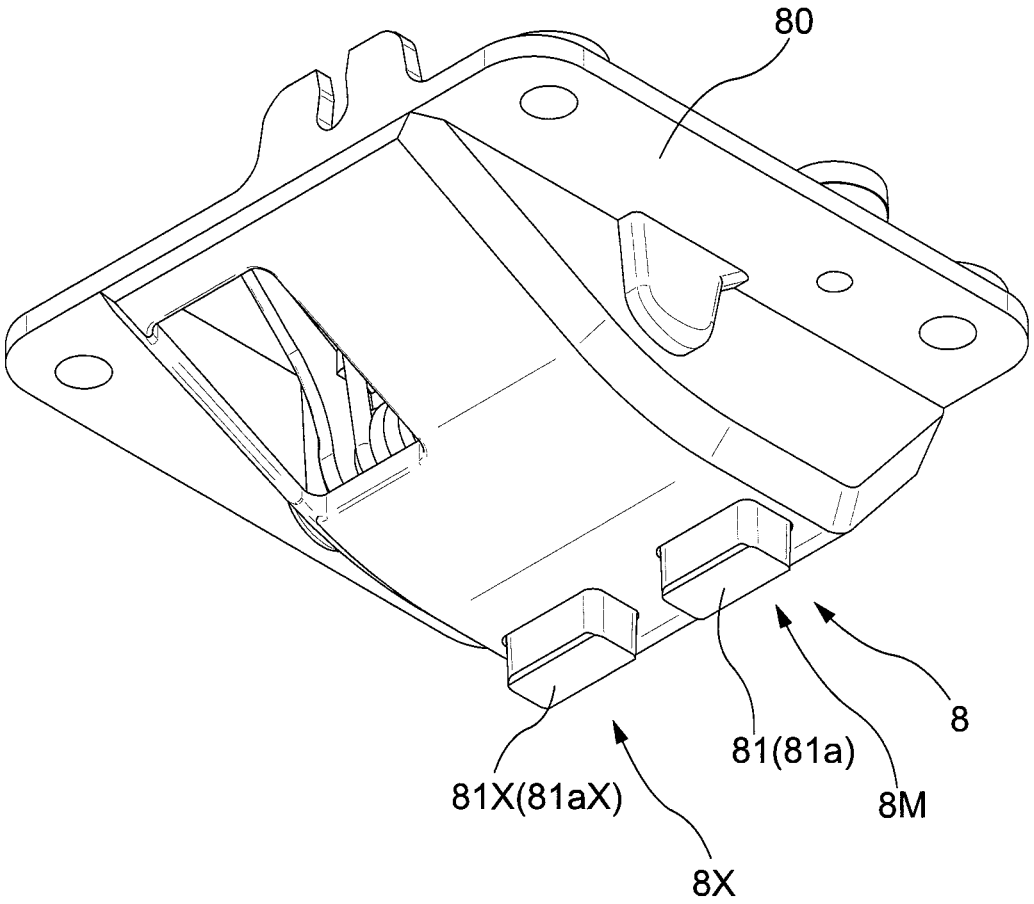
FIG. 18 is a perspective view of FIG. 17, as viewed obliquely from below.

A front-rear stopper mechanism 8M utilizing the front-rear lock unit 8 illustrated in FIGS. 16 to 18 is provided to suppress a swinging of the seat 5 in the front-rear direction relative to the support base part 2 at a predetermined position through an operation of an operating member 152 illustrated in FIG. 15. A left-right stopper mechanism 7M utilizing the left-right lock unit 7 illustrated in FIGS. 19 and 20 is provided to suppress a swinging of the seat 5 in the left-right direction relative to the support base part 2 at a position determined in advance through an operation of an operating member 151 (being an operating member common with the operating member 152 in practice) illustrated in FIG. 15.

In this embodiment, the left-right swing part 4 is supported by the support base part 2 and the front-rear swing part 3 is supported by the left-right swing part 4 so that a layered structure is formed in which the left-right stopper mechanism 7M is provided between the support base part 2 and the left-right swing part 4, and the front-rear stopper mechanism 8M is provided between the left-right swing part 4 and the front-rear swing part 3.

Figure 3:
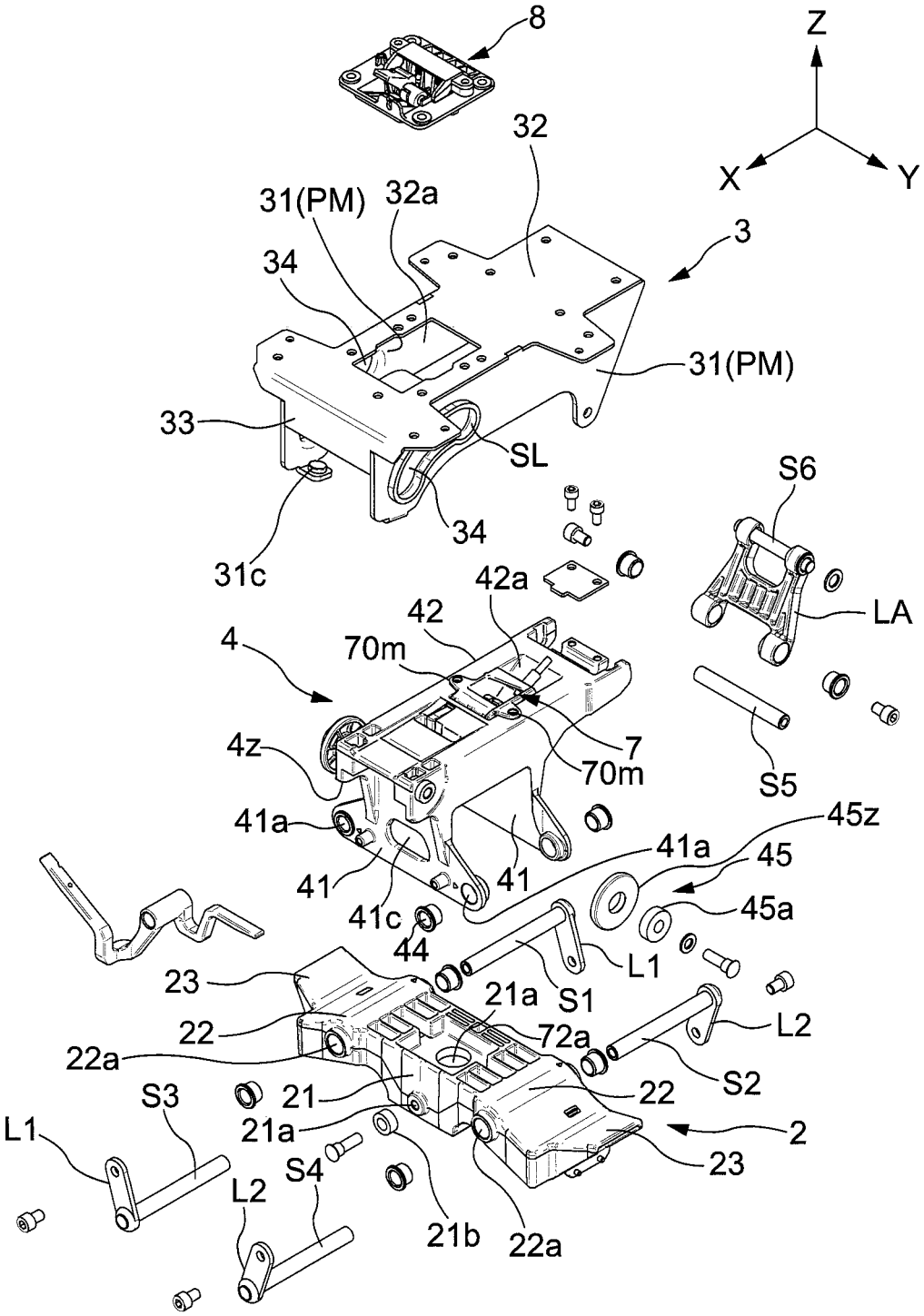
FIG. 3 is an exploded perspective view of front, rear, right, or left support portions in the chair.
Figure 20:
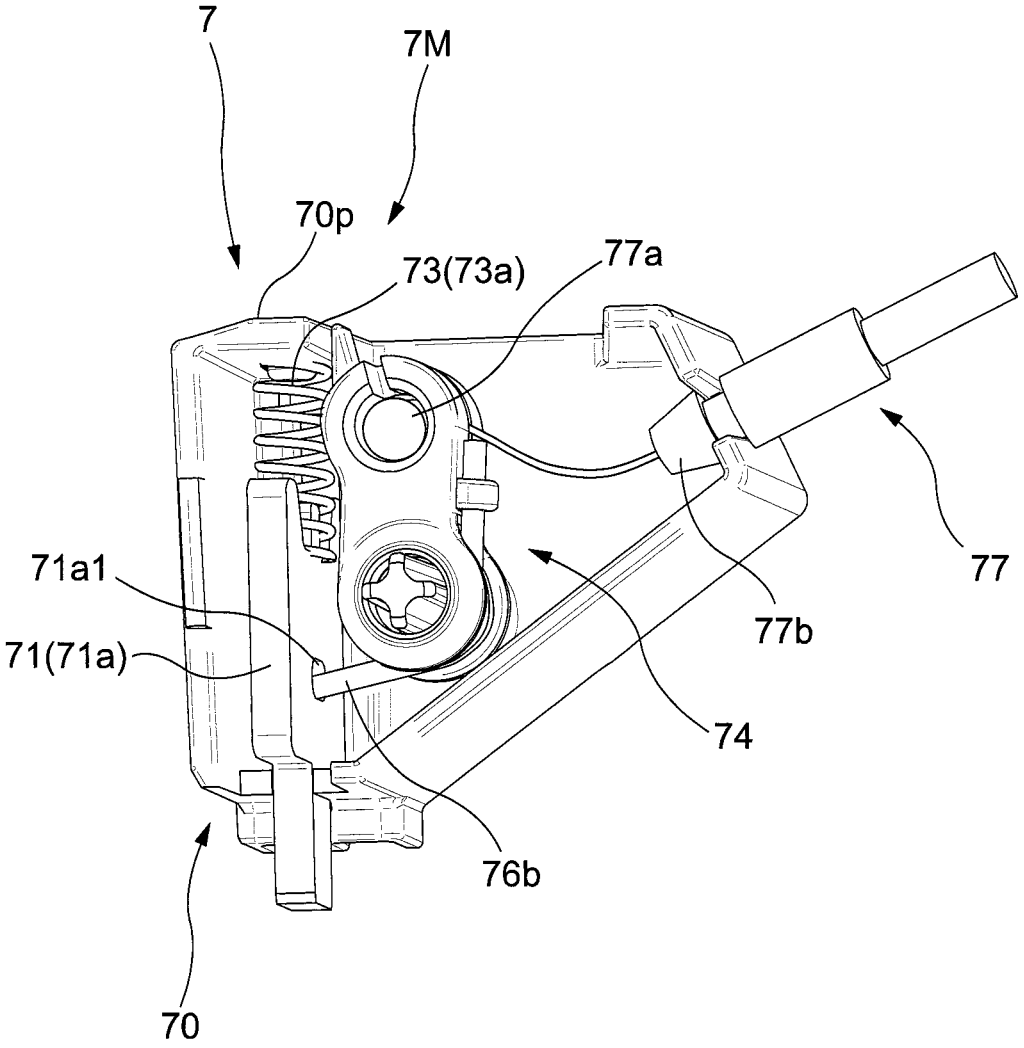
FIG. 20 is a perspective view of a partially assembled left-right stopper mechanism configured to suppress a left-right operation.
Figure 21A:
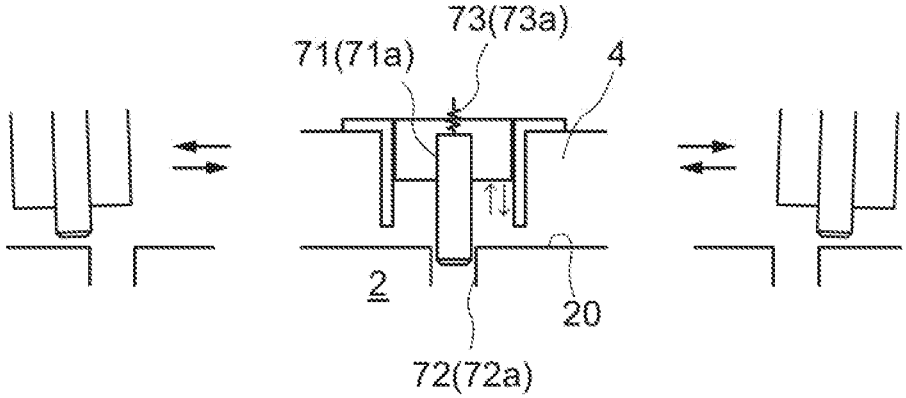
FIGS. 21A to 21C are schematic views illustrating suppressing operations for the front, rear, right, or left.

The left-right stopper mechanism 7M is configured to switch between allowing and suppressing the swinging of the seat 5 in the left-right direction, by engaging or disengaging an engaging part 71 and an engaged part 72 illustrated in FIG. 21A when the operating member 151 illustrated in FIG. 15 is operated. Specifically, the left-right stopper mechanism 7M includes an engagement pin 71*a* being the engaging part 71 provided at the side of the left-right swing part 4 and a groove 72*a* being the engaged part 72 provided on a sliding surface 20, the engaged part 72 relatively operating at the side of the support base part 2 being a position facing the engagement pin 71*a*. The engagement pin 71*a* is configured to be elastically biased toward the sliding surface 20, and to be fitted in the groove 72*a* at a predetermined position. As illustrated in FIGS. 3 and 7, the groove 72*a* has a rectangular shape in plan view and is provided at a center reference position in the left-right direction of the support base part 2 exposed upward via an opening 4*t* of the left-right swing part 4, and the engagement pin 71*a* illustrated in FIG. 20 is engaged to and disengaged from the groove 72*a*. A coil spring 73*a* being an elastic member 73 functions to bias the engagement pin 71*a* in a direction where the engagement pin 71*a* protrudes toward the sliding surface 20. Further, the left-right stopper mechanism 7M includes a conversion mechanism 74 illustrated in FIGS. 19 and 20 configured to convert an operation of the operating member 151 into an operation in a direction in which the engagement pin 71*a* is separated from the sliding surface 20 and the conversion mechanism 74, the engagement pin 71*a* and the coil spring 73*a* are integrally incorporated into a casing 70 of the left-right lock unit 7 to form with unitized.

Figure 19:
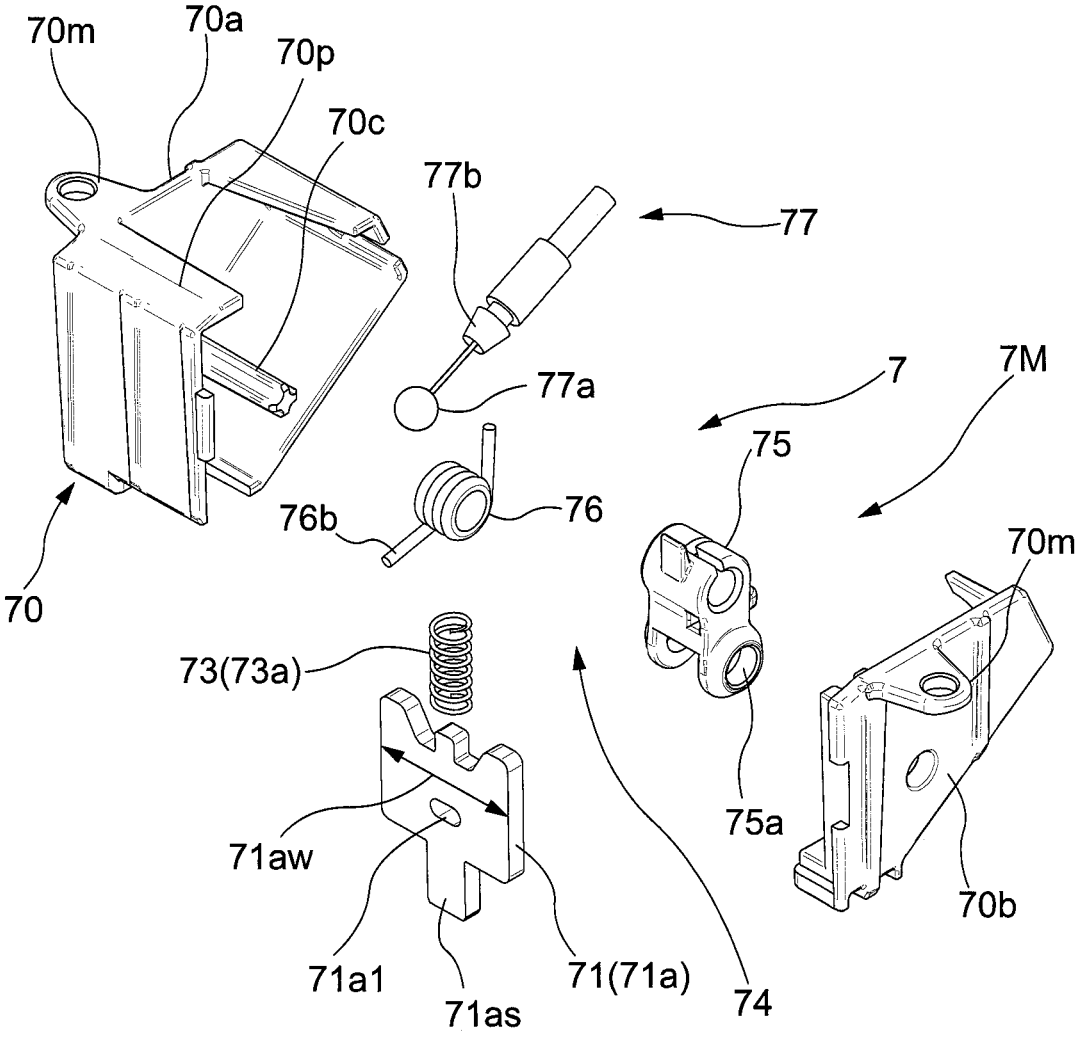
FIG. 19 is an exploded perspective view of a left-right stopper mechanism configured to suppress a left-right operation.

As illustrated in FIG. 19, the casing 70 has a halved structure, and the engagement pin 71*a* is disposed to be liftable and lowerable in a state where a wide part 71*aw* of the engagement pin 71*a* is guided by inner surfaces of side walls 70*a*, 70*b* of the casing 70 while a tip end part 71*as* being a part of the engagement pin 71*a* protrudes from a lower end of the casing 70. The conversion mechanism 74 includes the above-described coil spring 73*a* provided elastically in a compressed state between an upper end of the engagement pin 71*a* and an upper wall 70*p* of the casing 70, a stopper operation arm 75 rotatably supported via a horizontal shaft 70*c* between the side walls 70*a*, 70*b* of the casing 70 at a position adjacent to the engagement pin 71*a*, a torsion coil spring 76 rotatably attached together with the stopper operation arm 75, and a wire tube 77 including a spherical wire tip end 77*a* to be attached to the stopper operation arm 75 and a tube tip end 77*b* locked to the casing 70. As illustrated in FIG. 15, the other end of the wire tube 77 is locked in the vicinity of an operation lever 151*a* being the operating member 151 provided in the seat 5 and a wire base end 77*c* drawn therefrom is connected to the operation lever 151*a*. A tip end 76*b* of the torsion coil spring 76 is engaged with a hole 71*a*1 provided on the engagement pin 71*a*.

When the casing 70 is fitted into the unit attached hole 42*a* of a swing main body part 42 included in the left-right swing part 4 illustrated in FIG. 7 to achieve the state in FIG. 8, an attachment part 70*m* provided in the casing 70 is mounted on an upper surface of the swing main body part 42 and fixed by screwing. The left and right side walls 70*a*, 70*b* of the casing 70 are tightly accommodated between left and right side walls 42*a*1, 42*a*2 of the unit attached hole 42*a* and the engagement pin 71*a* is tightly guided in the casing 70 by the inner surfaces of the side walls 70*a*, 70*b* of the casing 70. In this way, a rattling of the engagement pin 71*a* to the left and right is suppressed, and thus, the unit attached hole 42*a* of a left-right swing part 4 illustrated in FIG. 7 includes merely the left and right side walls 42*a*1, 42*a*2, a rear wall 42*a*3, and an inclined front wall 42*a*4 to form the lower opening 4*t* without a bottom wall. The engagement pin 71*a* is configured to hang directly from the lower opening 4*t* of the unit attached hole 42*a* without being guided by the bottom wall to abut against the sliding surface 20, to engage with the groove 72*a*. Parts in the front-rear direction of the engagement pin 71*a* are supported by front and rear guide walls formed in the casing 70. The groove 72*a* is formed between longitudinal ribs r1, r1 provided in the support base part 2, lateral ribs r2 are provided around the longitudinal ribs r1, r1, and upper surfaces of the longitudinal ribs r1 and the lateral ribs r2 form the sliding surface 20 on which the engagement pin 71*a* slides until engaging with the groove 72*a*.

Figure 22:
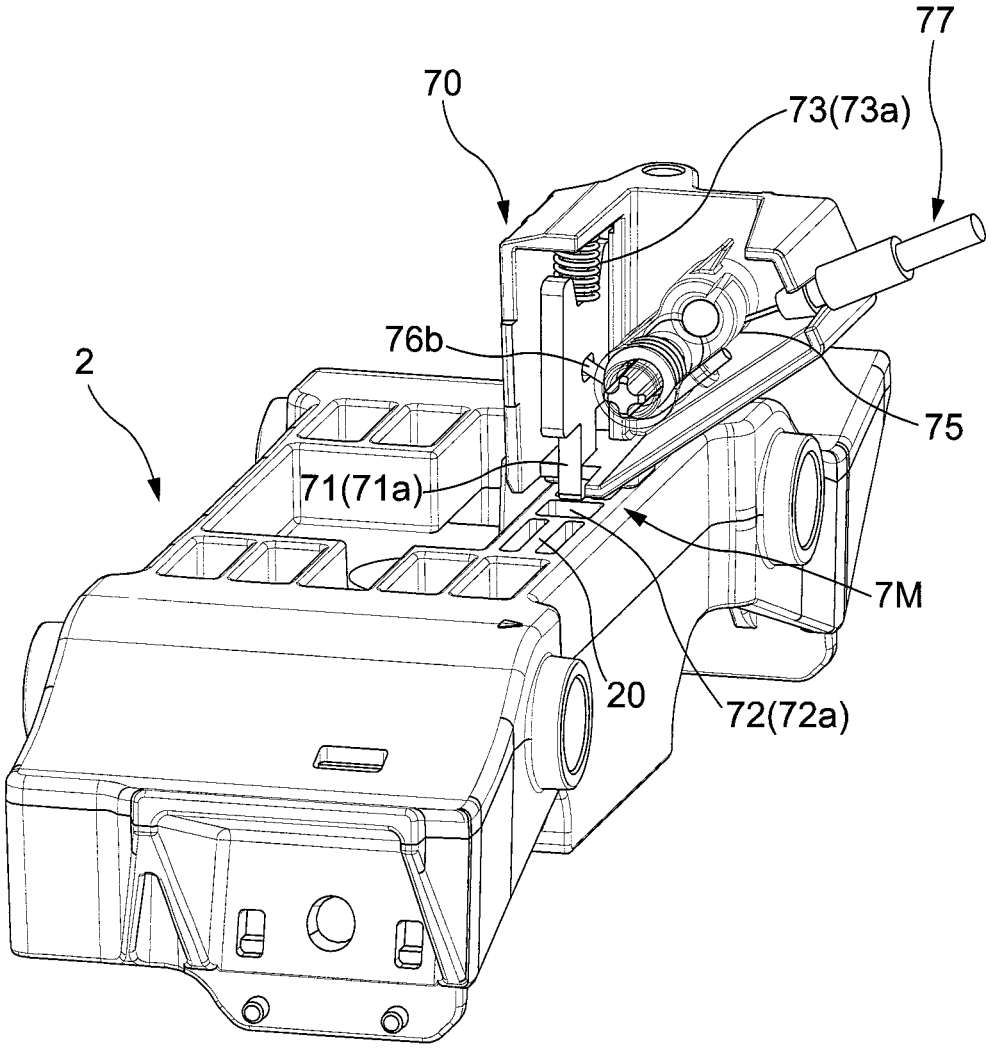
FIG. 22 is an operation explanatory diagram of the left-right stopper mechanism.
Figure 23:
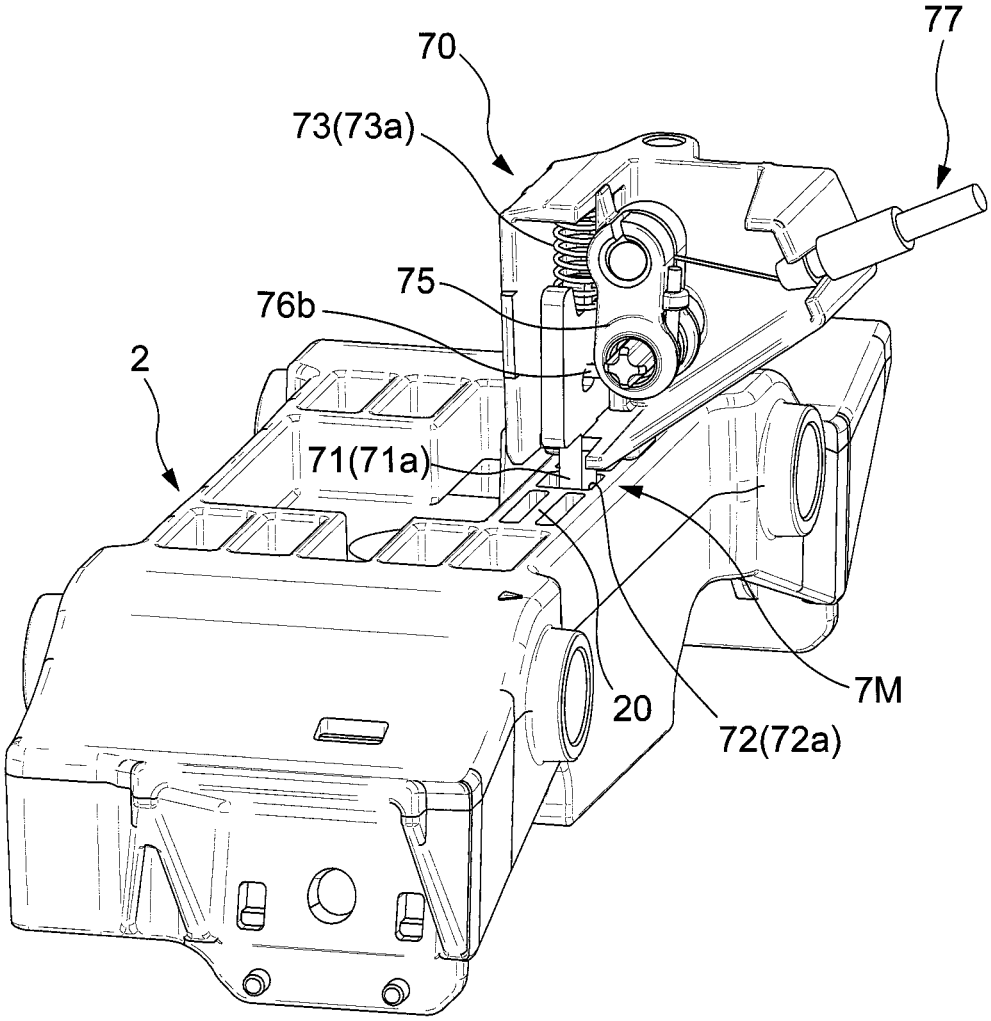
FIG. 23 is an operation explanatory diagram of the left-right stopper mechanism.

As illustrated in FIG. 22, when the operation lever 151*a* is in an unlocked position, the wire tube 77 rotates the stopper operation arm 75 to compress the coil spring 73*a* while the engagement pin 71*a* is lifted upwards at a tip end 76*b* of the torsion coil spring 76. When the operation lever 151*a* is operated to a locked position, as illustrated in FIG. 23, the tip end 76*b* of the torsion coil spring 76 rotates together with the stopper operation arm 75 by the repulsive force of the coil spring 73*a*, the engagement pin 71*a* is pressed downward, and when the engagement pin 71*a* engages with the groove 72*a* of the support base part 2, the locked state in the left-right direction is realized.

Figure 21B:
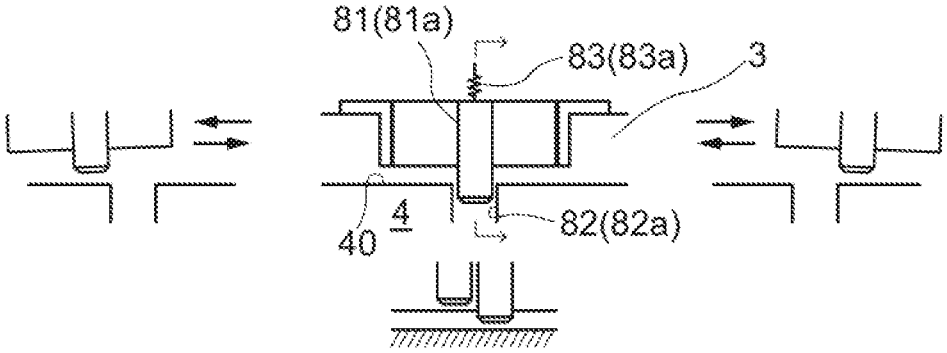

The front-rear stopper mechanism SM is configured to switch between allowing and suppressing the swinging of the seat 5 in the front-rear direction, by engaging or disengaging an engaging element 81 and an engaged part 82 illustrated in FIG. 21B when the operating member 152 illustrated in FIG. 15 is operated. Specifically, a configuration is so that the front-rear stopper mechanism SM includes an engagement pin 81*a* being the engaging part 81 provided at the side of the front-rear swing part 3 and a groove 82*a* being the engaged part 82 provided on a sliding surface 40, the engaged part 82 relatively operating at the side of the left-right swing part 4 being a position facing the engagement pin 81*a*. The engagement pin 81*a* is configured to be elastically biased toward the sliding surface 40, and to fit in the groove 82*a* at a predetermined position. As illustrated in FIG. 7, the groove 82*a* is provided on an upper surface of the swing main body part 42 of the left-right swing part 4 at one or more predetermined locations (one location in the present embodiment) within a movable range of the engagement pin 81*a* when the engagement pin 81*a* of the front-rear swing part 3 mounted on the upper surface of the swing main body part 42 moves in the front-rear direction, and thus, the groove 82*a* has a shape extending in the left-right direction and an upper surface of a swing main body part 42 forms the sliding surface 40. A coil spring 83*a* being an elastic member 83 functions to bias the engagement pin 81*a* in a direction where the engagement pin 81*a* protrudes toward the sliding surface 40, a conversion mechanism 84 illustrated in FIGS. 16 and 17 is provided, the conversion mechanism 84 converting an operation of the operating member 152 into an operation in a direction in which the engagement pin 81*a* is separated from the sliding surface 40, and the conversion mechanism 84, the engagement pin 81*a*, and the coil spring 83*a* are integrally incorporated into a half-piece of the casing 80 to form with unitized.

The casing 80 has a flat saucer-shape opened upward, and thus, the engagement pin 81*a* is guided by a guide 80*g*1 in the casing 80, and is disposed to be liftable and lowerable with a part of the engagement pin 81*a* protruding from a lower end of the casing 80. The conversion mechanism 84 includes the above-described coil spring 83*a* provided elastically in a compressed state between an upper end of the engagement pin 81*a* and a cover 80*a* closing the upper opening of the casing 80, a stopper operation arm 85 rotatably supported by a horizontal shaft 80*c* disposed between side walls 80*b*, 80*b* of the casing 80 at a position adjacent to the engagement pin 81*a*, a torsion coil spring 86 rotatably attached together with the stopper operation arm 85, and a wire tube 87 having a spherical wire tip end 87*a* that is attached to the stopper operation arm 85 and a tube tip end 87*b* locked to the casing 80. As illustrated in FIG. 15, the other end of the wire tube 87 is locked in the vicinity of an operation lever 152*a* being the operating member 152 provided in the seat 5 and a wire base end 87*c* drawn therefrom is connected to the operation lever 152*a*. A tip end 86*a* of the torsion coil spring 86 is at all times smoothly slidably engaged with a downward-facing surface 81*a*1 of the engagement pin 81*a*.

Figure 24:
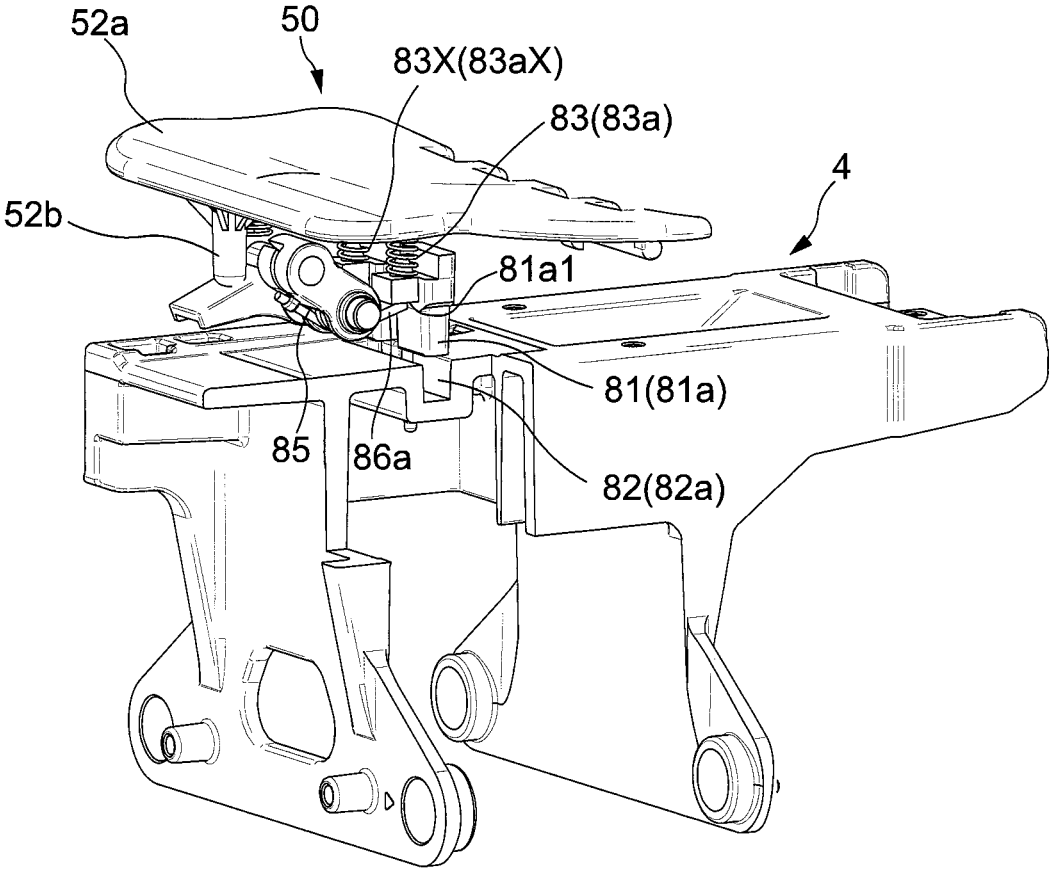
FIG. 24 is an operation explanatory diagram of the front-rear stopper mechanism.
Figure 25:
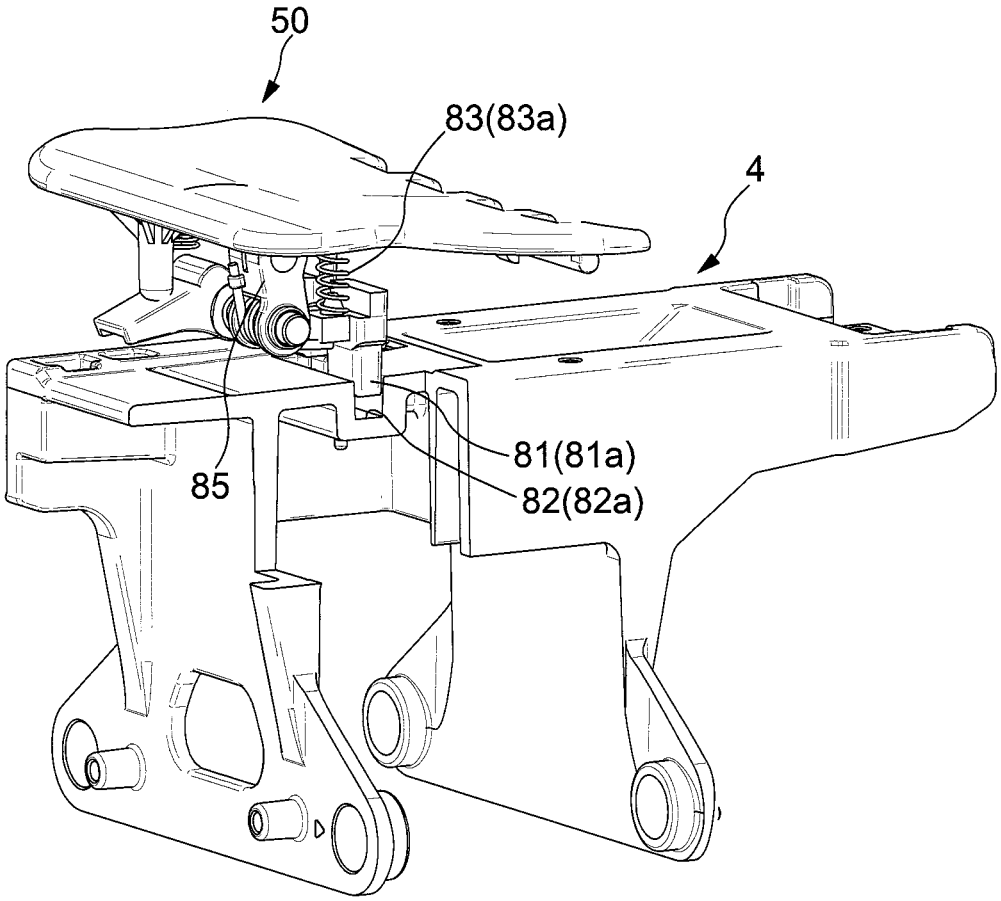
FIG. 25 is an operation explanatory diagram of the front-rear stopper mechanism.

When the operation lever 152*a* illustrated in FIG. 15 is in an unlocked position, the wire tube 87 illustrated in FIG. 17 rotates the stopper operation arm 85 to compress the coil spring 83*a* while the engagement pin 81*a* is lifted upwards at a tip end 86*a* of the torsion coil spring 86, as illustrated in FIG. 24. When the operation lever 152*a* is operated to a locked position, the tip end 86*a* of the torsion coil spring 86 rotates, as illustrated in FIG. 25, together with the stopper operation arm 85 by the repulsive force of the coil spring 83*a*, the engagement pin 81*a* is pressed downward, and when the engagement pin 81*a* engages with the groove 82*a* of the left-right swing part 4, the locked state in the front-rear direction is realized.

It is noted that, in the chair according to the embodiment, a control mechanism 8X configured to automatically suppress a movement of the seat 5 in the front-rear direction at a predetermined position when the seated person leaves the seat, is provided along with the half-piece of the front-rear lock unit 8 of the front-rear stopper mechanism 8M.

First, to detect seating of the seated person, a configuration is such that a weight-receiving part 50 (see FIG. 15), the height position of which changes due to a person sitting on a seat surface, is provided substantially at a center position of the seat 5, the change of the height position is mechanically transmitted to the control mechanism 8X illustrated in FIGS. 16 and 18 configured to control an operation of the front-rear swing part 3 being the movable part, and the control mechanism 8X changes the operation of the front-rear swing part 3, that is, the front-rear operation of the seat 5, between allowed and suppressed states.

Figure 21C:
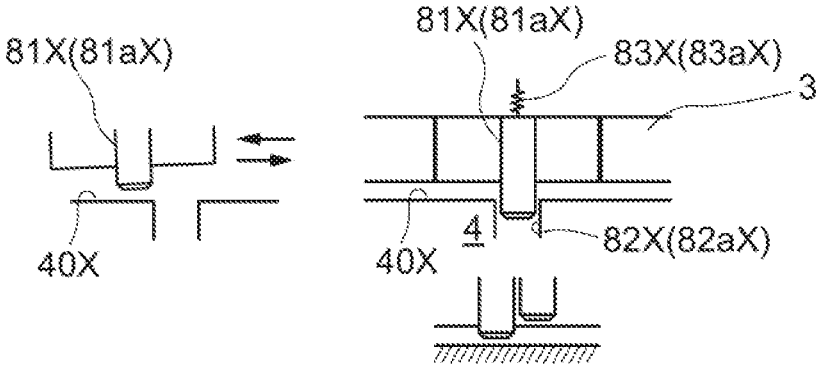

The operation changer 8X changes the allowed/suppressed states of the operation of the front-rear swing part 3 when an engagement state of an engaging part 81X illustrated in FIG. 21C and provided in the front-rear swing part 3 being a movable part and an engaged part 82X provided in the left-right swing part 4 being a support part configured to support the front-rear swing part 3 changes due to the load applied by seated person, and returns, by the elastic member 83X, the state of the front-rear swing part 3 from an operation state where the operation of the front-rear swing part 3 is allowed to the original state where the operation of the front-rear swing part 3 is suppressed, when the load applied by seated person is removed.

The chair is configured such that the engaged part 82X is a recess 82*a*X, and when the load applied by seated person is received in the state where the engaging part 81X is fitted into the recess 82*a*X, the fitted state is released, so that the engaging part 81X and the engaged part 82X are disengaged due to the load applied by seated person, and when the load applied by seated person is removed, the engaging part 81X and the engaged part 82X engage with each other by the elastic force to bring the front-rear swing part 3 into an operation-suppression state.

The control mechanism 8X includes an engagement pin 81*a*X being the engaging part 81X; and a groove-shaped recess 82*a*X being an engaged part 82X provided on a sliding surface 40X relatively operating at a position facing the engaging pin 81X. The engagement pin 81*a*X is configured to be elastically biased toward the sliding surface 40X, and to fit in the groove-shaped recess 82*a*X at a predetermined position. Then, when the seat 5 detects received of the load applied by seated person in a central part, the control mechanism 8X illustrated in FIGS. 16 and 17 separates the engagement pin 81*a*X from the groove-shaped recess 82*a*X. A coil spring 83*a*X being an elastic member 83X functions to bias the engagement pin 81*a*X in a direction where the engagement pin 81*a*X protrudes toward the sliding surface 40X. The control mechanism 8X includes a conversion mechanism 84X configured to convert an operation of the weight-receiving part 50 due to a person sitting on the seat, into an operation in a direction where the engagement pin 81*a*X is separated from the sliding surface 40X, and the conversion mechanism 84X, the engagement pin 81*a*X, and the coil spring 83*a*X are integrally incorporated into an other-half part of the casing 80 illustrated in FIG. 16, to form with unitized.

Figure 37:
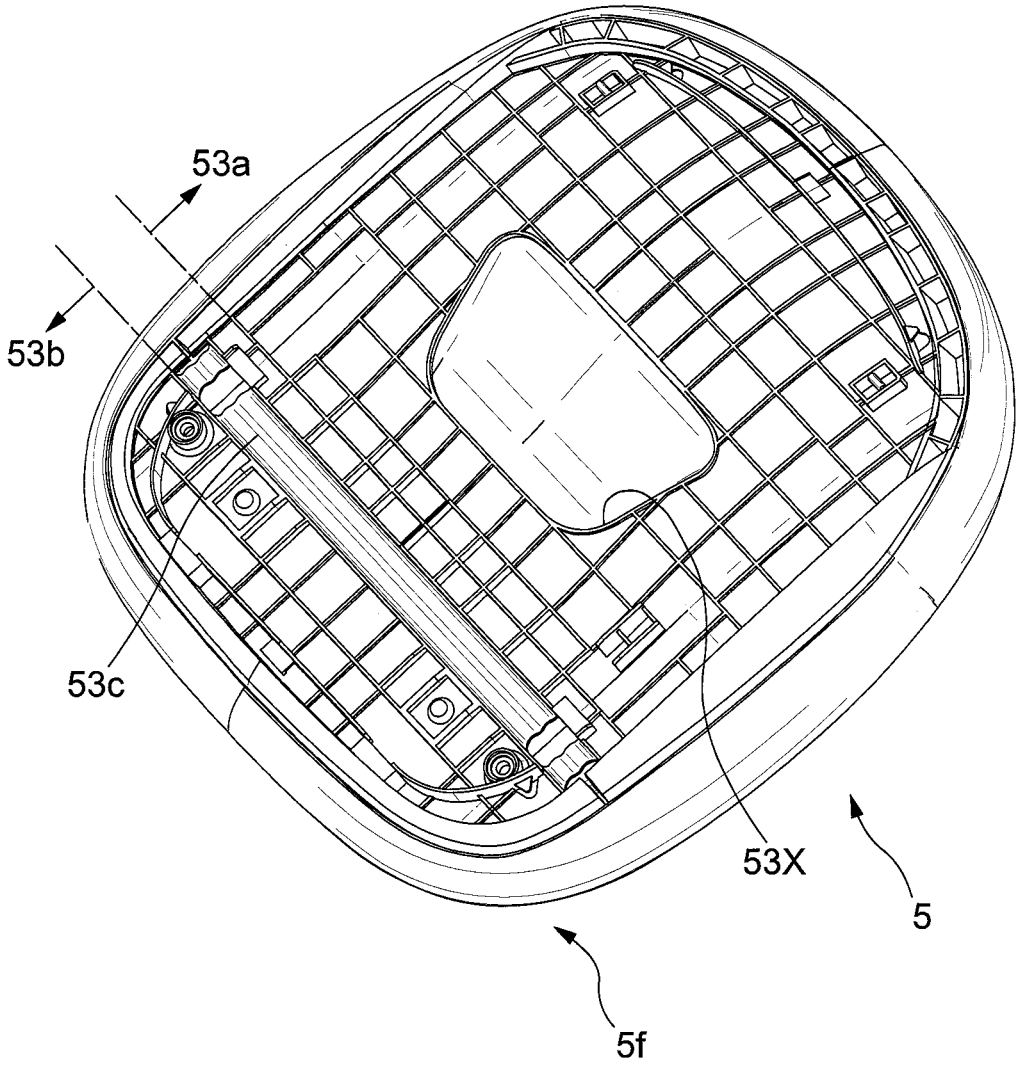
FIG. 37 is a perspective view illustrating a lower surface of the seat.

The engagement pin 81*a*X is disposed to be 1 liftable and lowerable along front, rear, right, and left guides 80*g*2 of the casing 80, in a parallel relationship with the engagement pin 81 in the flat casing 80 configuring the front-rear stopper mechanism 8M. Similarly in parts to the conversion mechanism 84, the conversion mechanism 84X includes the coil spring 83*a*X provided elastically in a compressed state between an upper end of the engagement pin 81*a*X and the cover 80*a* closing the upper opening of the casing 80, a safety operation arm 85X rotatably supported by the horizontal shaft 80*c* disposed between side walls 80*b*, 80*b* of the casing 80 at a position adjacent to the engagement pin 81*a*X, and a torsion coil spring 86X rotatably attached together with the safety operation arm 85X. On the other hand, the weight-receiving part 50 is, as illustrated in FIG. 15, a pressure-receiving plate 52*a* rotatably fitted and attached to the seat outer shell 51 included in the seat 5, and a convex part 52*b* provided below the pressure-receiving plate 52*a* is disposed at a position displaced from the center of rotation of the safety operation arm 85X, where the convex part 52*b* can press a pressed part 85*xt* illustrated in FIG. 16. A tip end 86*a*X of the torsion coil spring 86X is at all times smoothly slidably engaged with a downward-facing surface of the engagement pin 81*a*X. The pressure-receiving plate 52*a* is biased in a direction away from the safety operation arm 85X by a coil spring 52*c* being an elastic body illustrated in FIG. 26. As illustrated in FIG. 37, a hole part 53*x* configured to avoid interference with the pressure-receiving plate 52*a* is provided at a corresponding position of a seat inner shell 53.

Figure 26A:
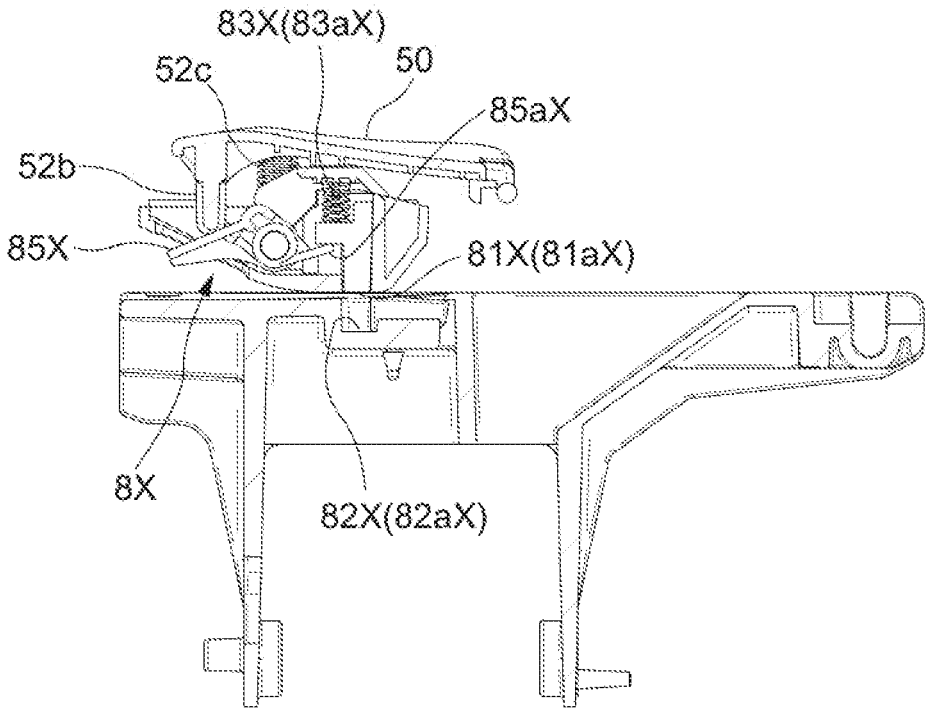
FIGS. 26A to 26B are operation explanatory diagrams of a control mechanism operating in accordance with a seating state.
Figure 26B:
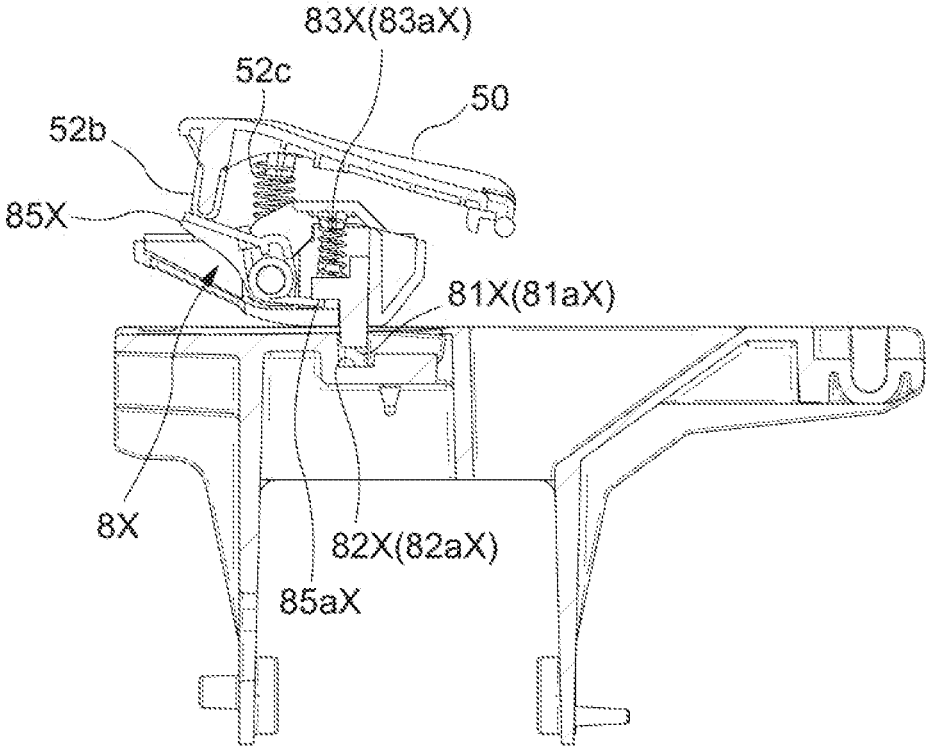

As illustrated in FIG. 26B, when the weight-receiving, part 50 does not sense the weight of the seated person, the engagement pin 81X is pressed downward by the coil spring 83*a*X while a tip end 85*a*X of a torsion coil spring 86X rotates together with the safety operation arm 85X, and when the engagement pin 81X engages with a groove 82*a*X of the front-rear swing part 3, the locked state in the front-rear direction is realized. As illustrated in FIG. 26A [ROM when the weight-receiving part 50 detects the weight of the seated person, when the engagement pin 81X is pulled upward at the tip end 86*a*X of the torsion coil spring 86X while compressing the coil spring 83*a*X, the engagement pin 81X is disengaged from the groove-shaped recess 82*a*X and the locked state in the front-rear direction is released.

That is, when a user is seated, the control mechanism 8X is unlocked, and afterwards, whether or not the seated person locks a movement in the front-rear direction depends on the state of a front-rear fixing stopper mechanism 8M, via the operation of the operating member 152, and when the seated person leaves the seat, the state is maintained unless the front-rear fixing stopper mechanism 8M is unlocked, and if the front-rear fixing stopper mechanism 8M is unlocked, the control mechanism 8X actuates to lock the front-rear operation of the seat 5.

In particular, in this chair, the seat 5 tilts at least back and forth, and when the seated person starts standing up, the seat 5 moves while tilting forward together with the front-rear swing part 3, as illustrated in FIG. 13. When the seated person leaves the seat in this state and the load applied by seated person is removed, the engagement pin 81*a*X being the engaging part 81X illustrated in FIG. 21C settles on the sliding surface 40X in the front of the recess 82*a*X being the engaged part 82X. Afterwards, the seat 5 starts moving while tilting rearward in accordance with a relationship of the center-of-gravity position between the back and the seat, due to the presence of the back 6. During this movement, it is expected that the engagement pin 81*a* being the engaging part 81X engages with the recess 82*a*X being the engaged part 82X. As illustrated in FIG. 7, in the recess 82*a*X, grooves are provided in a linked manner in an orthogonal direction, and a buffer material 82*z* such as rubber is embedded. The buffer material 82*z* is for avoiding collision of the engagement pin 81*a*X with the wall of the recess 82*a*X and a shock or an abnormal noise caused, and after colliding with the buffer material 82*z*. The engagement pin 81*a*X collides with the buffer material 82*z* and fits into the recess 82*a*X.

It is noted that, when a person sits on the seat, the engagement pin 81*a*X and the recess 82*a*X are disengaged, however, the engagement pin 81*a*X and the recess 82*a*X engage with a certain degree of resistance, and thus, the locked state is not released immediately after the person sits on the seat, but is released when the resistance decreases due to a small movement of the seat 5.

That is, the control mechanism 8X switches the locked state of the seat 5 between when the seated person leaves the seat and when sitting on the seat, and thus, may be called a "seat-leaving and seat-sitting automatic stopper mechanism".

Next, the guide hole 34 illustrated in FIG. 3 will be described. Even if the rail plate 31 being a plate member PM is thickened or a separate member is attached to the rail plate 31 to provide the guide hole 34 for securing a pressure-receiving area, this may only lead to an increase in the number of parts and the cost and does not necessarily lead to improvement of strength and durability.

Figure 27:
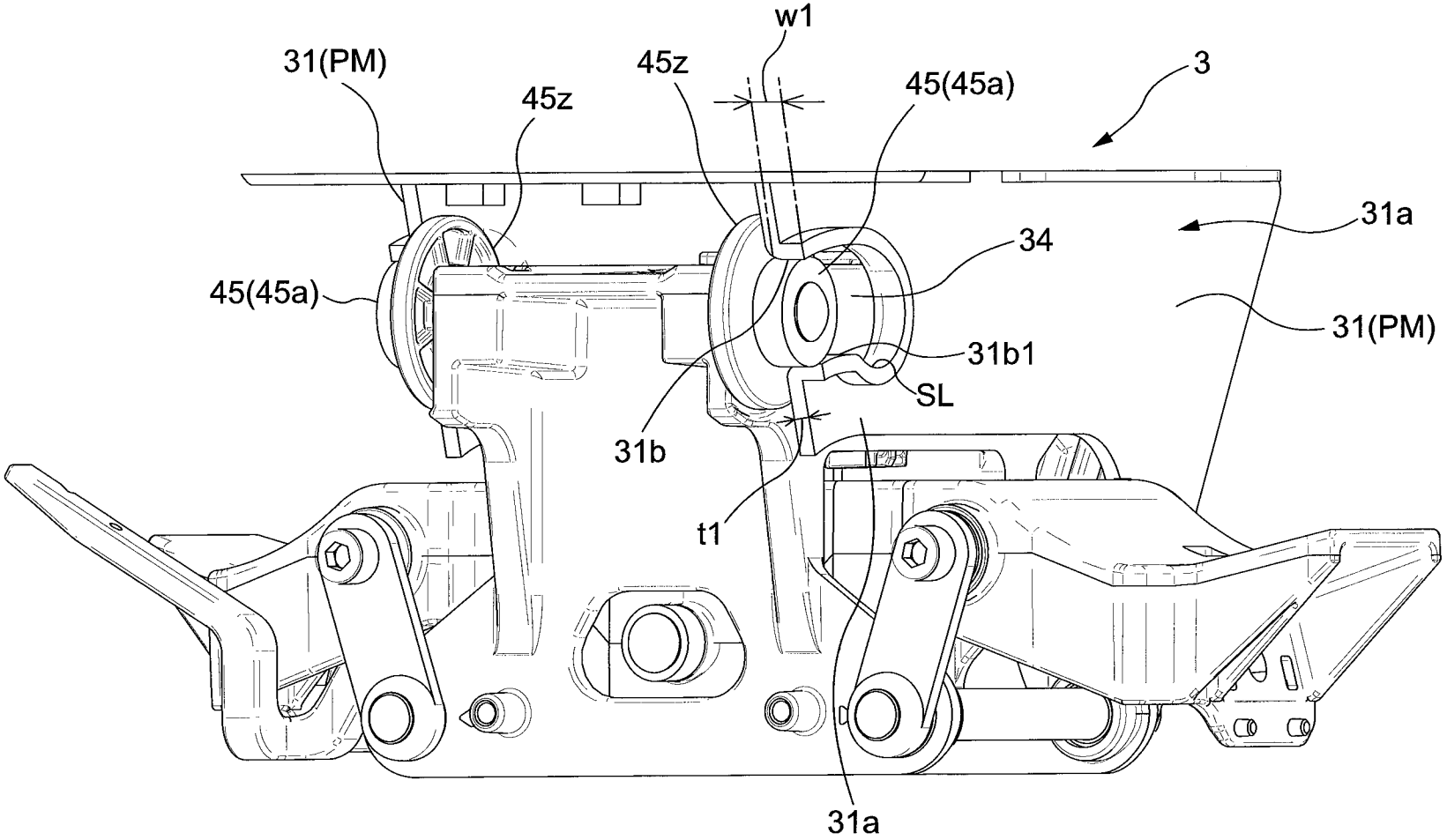
FIG. 27 is a partially broken perspective view illustrating an engaging portion of a bearing and a guide hole in the embodiment.

Therefore, in the present embodiment, as illustrated in FIG. 27, a flange part 31*b* is provided on the plate member PM of the front-rear swing part 3 being the movable portion in which the guide hole 34 is provided, that is, on a vertical surface 31*a* of the rail plate 31, and a guide surface 31*b*1 for moving the bearing 45*a* being the rolling body 45 in the longitudinal direction is provided at a position extending in the lateral direction of the flange part 31*b*, that is, in the horizontal direction in the attached state.

A lateral dimension wl of the guide surface 31*b*1 is greater than a thickness t1 of the rail plate 31 being the plate member PM. The guide surface 31*b*1 is integrally formed of metal together with the rail plate 31. As illustrated in FIG. 3 and the like, the flange part 31*b* has a shape—that goes around the circumference of the guide hole 34 opened in the vertical surface.

The flange part 31*b* according to this embodiment is configured by plastic deformation processing of the plate member PM around the guide hole 34, and specifically, by adopting burring processing. In general, in the burring processing, a pilot hole is opened in a plate member, the periphery of the pilot hole is fixed with a jig and in this state, the edge of the pilot hole is raised, by pressing with a tool larger than the pilot hole, to form a flange part, and thus, a cylindrical flange is generally formed. So far, burring processing has only been utilized for forming tapped holes and the like and has not been considered for producing a structure for guiding a rolling body.

Figure 28A:
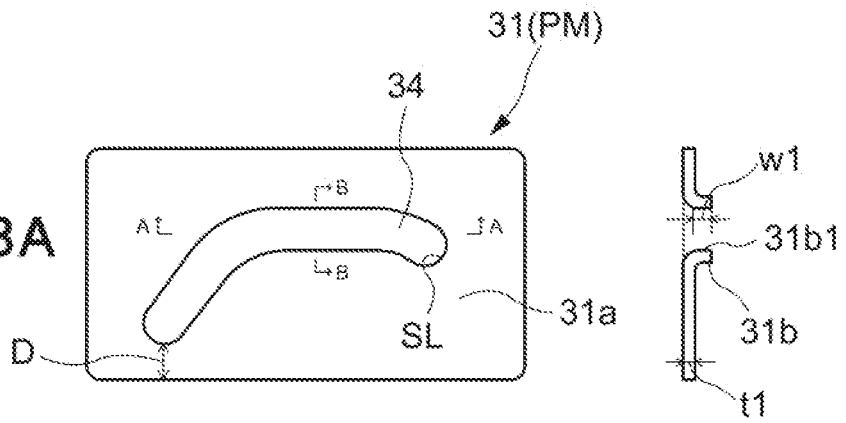
FIGS. 28A to 28C are diagrams for explaining a processing procedure of the guide hole.
Figure 28B:
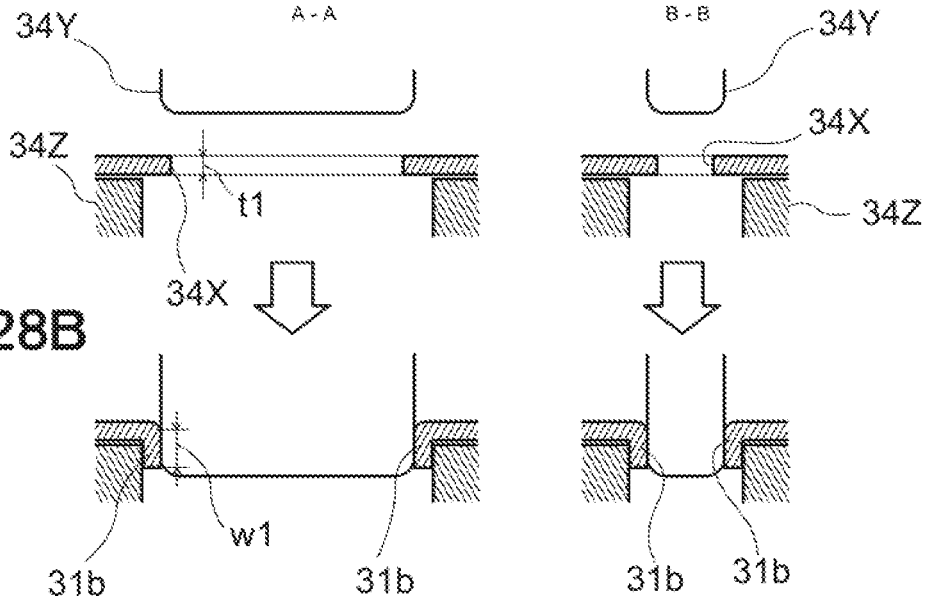

Therefore, in the present embodiment, based on this new perspective, as illustrated in FIG. 28A, to form an asymmetrical hole, or more specifically, the guide hole 34 extending with a substantially constant width, a pilot hole 34*x* corresponding to the shape, of the guide hole 34 is opened with a slightly smaller size than the guide hole 34, as illustrated in FIG. 28B. Then, the periphery of the pilot hole 34*x* is fixed with a jig 34Z along the shape of the guide hole 34, and in this state, pressing is performed with a tool 34Y that is larger than the pilot hole 34*x* and corresponds to the inner circumferential shape of the guide hole 34. Thus, as illustrated in FIG. 27, the flange part 31*b* extending in the lateral direction via a portion R from the vertical surface 31*a* is formed over the entire circumference of the guide hole 34, and the flange part 31*b* directed in this lateral direction is substantially the pressure-receiving area. The lateral dimension of the guide surface 31*b*1 is substantially uniform over the entire circumference.

The manufacturing means for the guide hole 34 is selected based on the conditions that the guide surface 31*b*1 is smooth, the guide surface 31*b*1 has strength, and the manufacturing cost is low. Fine blanking processing and other processing were also tried, however, it turned out that, even though the fine blanking processing relatively likely to be selected was excellent in forming a smooth guide surface, the plate member needed to have a considerable thickness to obtain strength. Thus, the fine blanking processing could not be adopted due to its inappropriate cost and other processing also did not satisfy the conditions above. Overall, it turned out that burring processing met these conditions very suitably.

However, when a shortest distance D from the guide hole 34 to the nearest edge of the plate member PM is narrow in the burring processing, the plate member PM is deformed during the processing or due to the load applied during the processing. As a result of attempting various tests in this embodiment, it was found that it was necessary and sufficient, as a condition for obtaining a stable shape, to set the shortest distance D (see FIG. 28) from the guide hole 34 to the edge of the plate member PM at an appropriate position to at least 15 mm or more for 2 to 6 mm of a thin plate.

As illustrated in FIG. 27, when viewing the entire chair, the flange part 31*b* formed in this way extends outward from the pair of rail plates 31, 31, rather than inward in the left-right direction, and the guide surface 31*b*1 being a rolling surface is formed outside the rail plates 31. Further, to mitigate a shock caused from a collision with the bearing 45*a* being the rolling body 45, one end (the front end or the rear end) of the guide hole 34 is formed with a so-called shockless part in which the radius of curvature is changed, so that as the bearing 45*a* approaches the end due to an operation of the seat 5, the operation speed of the seat 5 is reduced by performing control so that the center of gravity of the seat 5 is lifted. The flange part 31*b*1 made by burring is designed to withstand the shock caused during this time.

Further, when a left-right support state of the front-rear swing part 3 for the left-right swing part 4 becomes unbalanced, a lower region of the guide hole 34 causes the bearing 45*a* being the rolling body 45 to abut against the lower region of the guide hole 34 to support the bearing 45*a* and the flange part 31*b* contributes to supporting the load during this time.

Figure 28C:
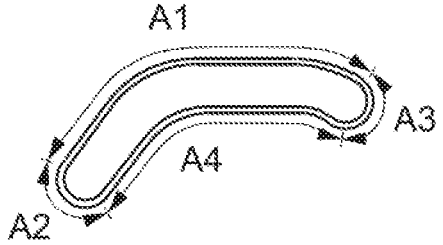

Generally speaking, as illustrated in FIG. 28C, the flange part 31*b* includes an upper-side first flange area. A1 supporting the hack and forth movement of the bearing 45*a* being the rolling body 45 when the seat 5 operates back and forth, a front-side second flange area A2 supporting a portion where the bearing 45*a* being the rolling body 45 reaches the front end of the guide hole 34 when the seated person leans against the back 6, and a rear-side third flange area A3 supporting a portion where the bearing 45*a* being the rolling body 45 reaches the rear end of the guide hole 34 when the seated person leans forward. Further, the flange part 31*b* includes a lower-side fourth flange area A4 supporting the hearing 45*a* being the rolling body 45 when the left-right support state is unbalanced. This structure remains similar, even if the guide hole 34 is formed at the side of the support portion and the bearing 45*a* being the rolling body 45 is disposed at the side of the movable portion.

As described above, the guide hole 34 is formed in the vertical surface of the movable portion or the support portion of the chair and moves while receiving the load applied by seated person. The movable portion is supported at two locations on the front and rear side by the support portion including a guide structure configured by the rolling body 45 and the guide hole 34. In the present embodiment, the other movable portion of the chair is supported by the link arm LA, any one of the front and rear support structures is configured by the above-described rolling body 45 and the guide surface 31*b*1, and the other is configured by a different support structure, that is, in this embodiment, of the link structure.

Next, the support mechanism of the back 6 will be described. As illustrated in FIGS. 2, 14, 30, and 29, in this chair, the back 6 is arranged behind the seat 5 and the backrest 62 is configured to be supported by the back frame 61 via the operating mechanism 6M. A back inner cover 63 is attached to the back frame 61, an opening 63*a* is provided in the back inner cover 63, and the backrest 62 is operatively supported by the back frame 61 via the opening 63*a*.

The backrest 62 includes a cushion arranged on the front surface of a back plate 62*a* and the backrest 62 is entirely covered by an upholstery fabric. A lower end of the backrest 62 is disposed at a predetermined distance above the seat surface and the backrest 62 is supported on a back surface side by a back support part 61*a* at an upper end of the back frame 61 via the operating mechanism 6M.

Figure 29:
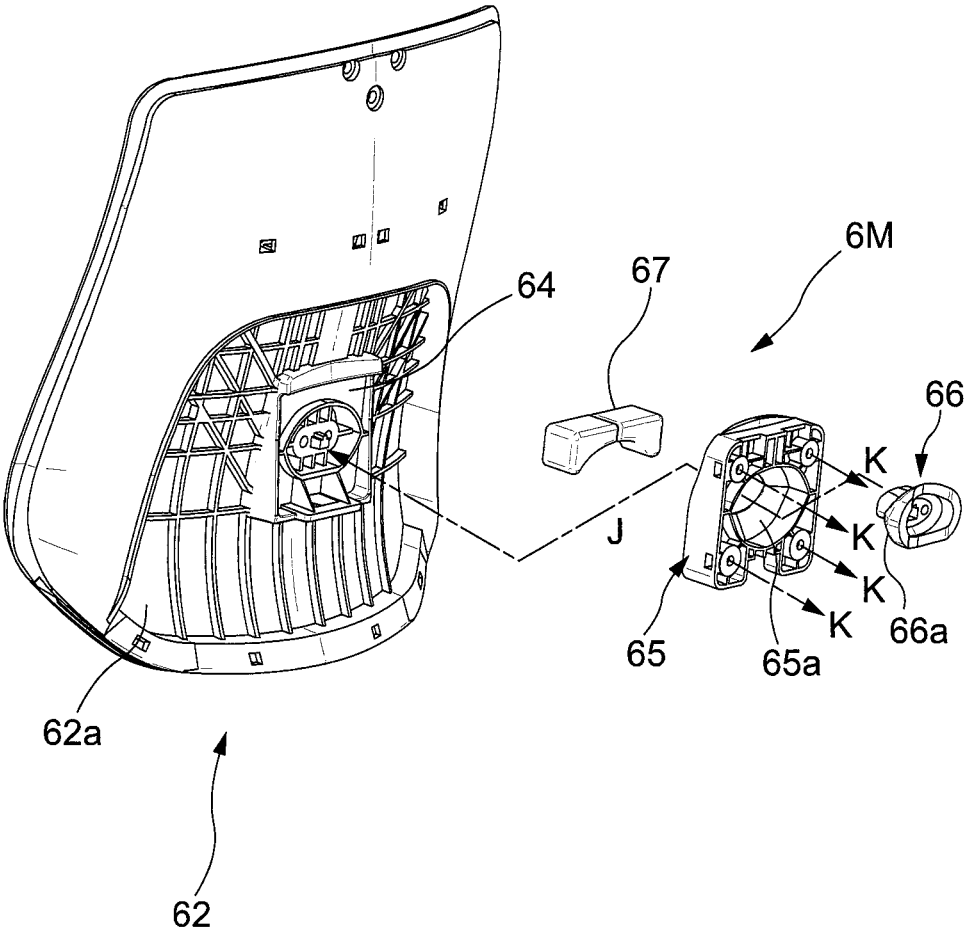
FIG. 29 is an exploded perspective view illustrating an operating mechanism of the back.
Figure 30:
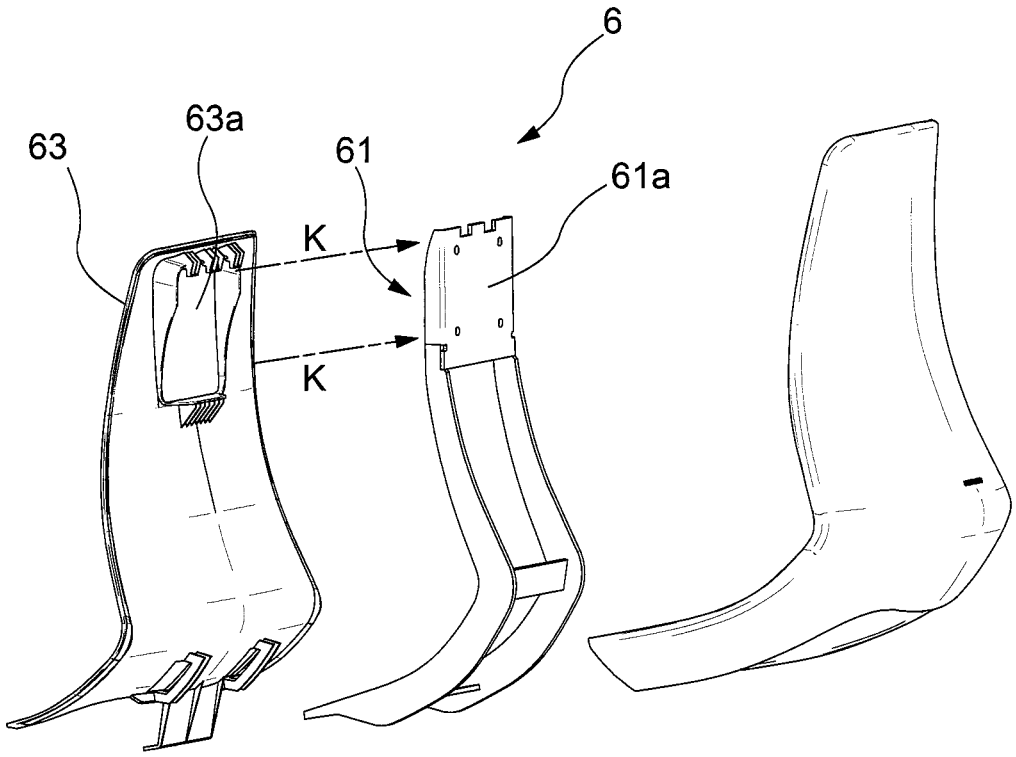
FIG. 30 is an exploded perspective view illustrating a configuration of the back.
Figure 31:
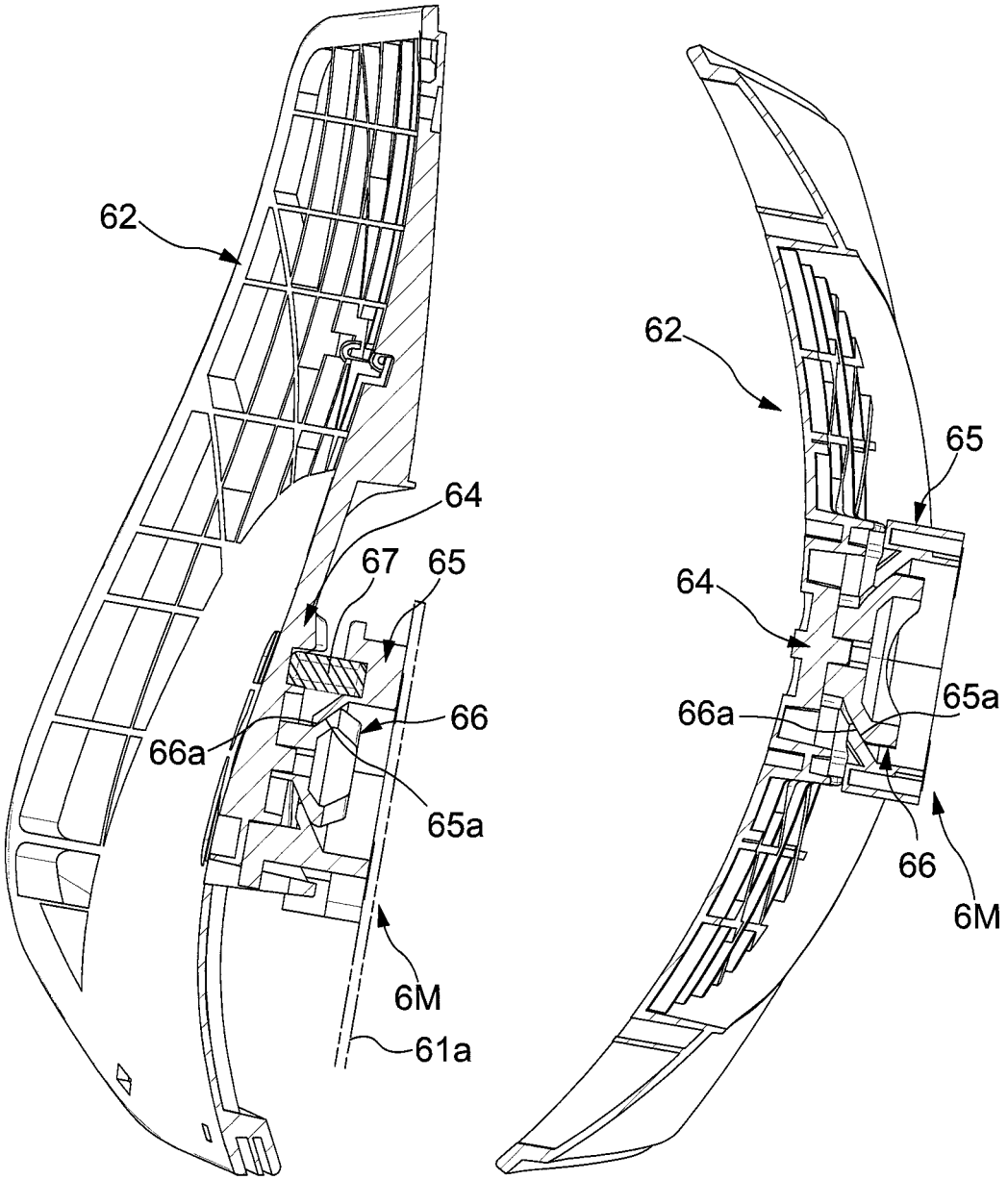
FIG. 31 is a cross-sectional view of the back including the operating mechanism.

The operating mechanism 6M includes: a base part 64 fixed to or formed integrally with the back plate 62*a* included in the backrest 62 and including an elastic body 67 arranged on a back surface side of the base part 64; a tilting part 65 disposed at a position adjacent to the base part 64 and including a guide part 65*a* recessed in a tapered shape at the back surface side, the center of the guide part 65*a* being open in the front-rear direction; and a pressing tool 66 including a guide part 66*a* having a convex shape corresponding to the guide part 65*a* of the tilting part on the front surface side of the pressing tool, the pressing tool 66 being fixed to the base part 64 via the opening of the tilting part 65 in a state where the guide part 66*a* of the pressing tool is fitted into the guide part 65*a*, as illustrated by an arrow J in FIG. 29. As illustrated by arrows K in FIGS. 29 and 30, a configuration of the operating mechanism 6M is such that the tilting part 65 is pulled and passed through the opening of the back inner cover 63 to be fixed by a screw to the back support part 61*a* at the upper end side of the back frame 61. That is, as illustrated in FIG. 31, the pressing tool 66 is fixed to the base part with the tilting part 65 interposed therebetween, and thus, the pressing tool 66 is integrally formed with the base part 64 to form a part of the base part 64. The tilting part 65 can move freely in the gap between the base part 64 and the pressing tool 66, however, a configuration is such to allow for free movement of the tilting part 65, it is necessary to compress an elastic body 67 interposed between the tilting part 65 and the base part 64 against the elastic force. The elastic body 67 exerts a force on the guide part 65*a* of the tilting part 65 in a direction where the guide part 65*a* is constantly fitted in the guide part 66*a* of the pressing tool 66.

Figure 32:
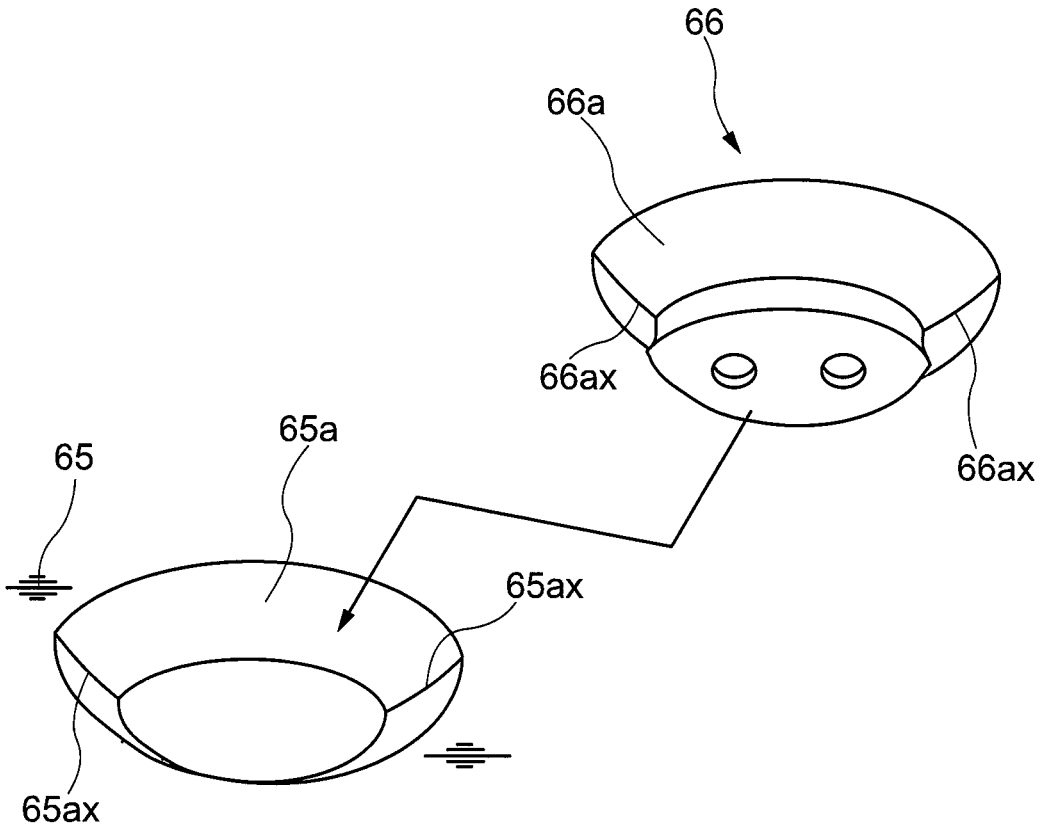
FIG. 32 is an explanatory diagram of a guide part included in the operating mechanism.

More specifically, as illustrated in FIG. 32, the recess guide part 65*a* of the tilting part 65 has a substantially partially elliptical mortar-like shape including at least one valley line 65*ax* (two in this embodiment), the convex guide part 66*a* of the pressing tool 66 has a curved shape having at least one ridge line 66*ax* (two in this embodiment) fitted smoothly into the valley line 65*ax*, and the valley line 65*ax* and the ridge line 66*ax* can be fitted into each other. The convex guide part 66*a* is similar to a shape obtained by eliminating a part of an elliptical sphere, and the ridge line 66*ax* is formed along a line by a guide surface 66*a* intersected on the long axis side of the elliptical sphere. In a corresponding position of the matching recess guide part 65*a*, the valley line 65*ax* is also formed at the position where the guide surfaces 65*a* are intersected. The reason therefore is that a spherical body and a spherical surface-receiving seat do not have directionality and cannot perform a positioning function. In that sense, the convex guide part 66*a* and the recess guide part 65*a* are not limited to the mortar-like shape and the shape of the elliptical sphere, as long as they have different shapes that uniquely determine the directionality during fitting. However, in view of the smoothness of the guides, the guide elements 66*a*, 65*a* need to be configured of a smooth continuous surface. The ridge line 66*ax* and the valley line 65*ax* are provided to enhance the positioning function during fitting.

In this embodiment, urethane is used for the elastic body 67, and as illustrated in FIG. 29, the elastic body 67 is arranged from the left and right corner parts to the upper edge portion of the upper half of the rectangular plate-shaped base part 64. As illustrated in FIG. 31, the thickness dimension of the elastic body 67 is set to achieve an appropriately compressed state in a state where the pressing tool 66 is attached to the base part 64, the tilting part 65 is attached to the back support part 61*a* of the back frame 61, and the guide part 66*a* of the pressing tool 66 and the guide part 65*a* of the tilting element 65 are fitted into each other. In view of the fact that the load is applied to a part above the center of the operating mechanism 6M when the seated person leans against the backrest 62, the elastic body 67 is not provided in the lower half of the base part 64 where there is little occasion to perform a function substantially, however, provision of the elastic body 67 in this position shall not be precluded.

Figure 33:
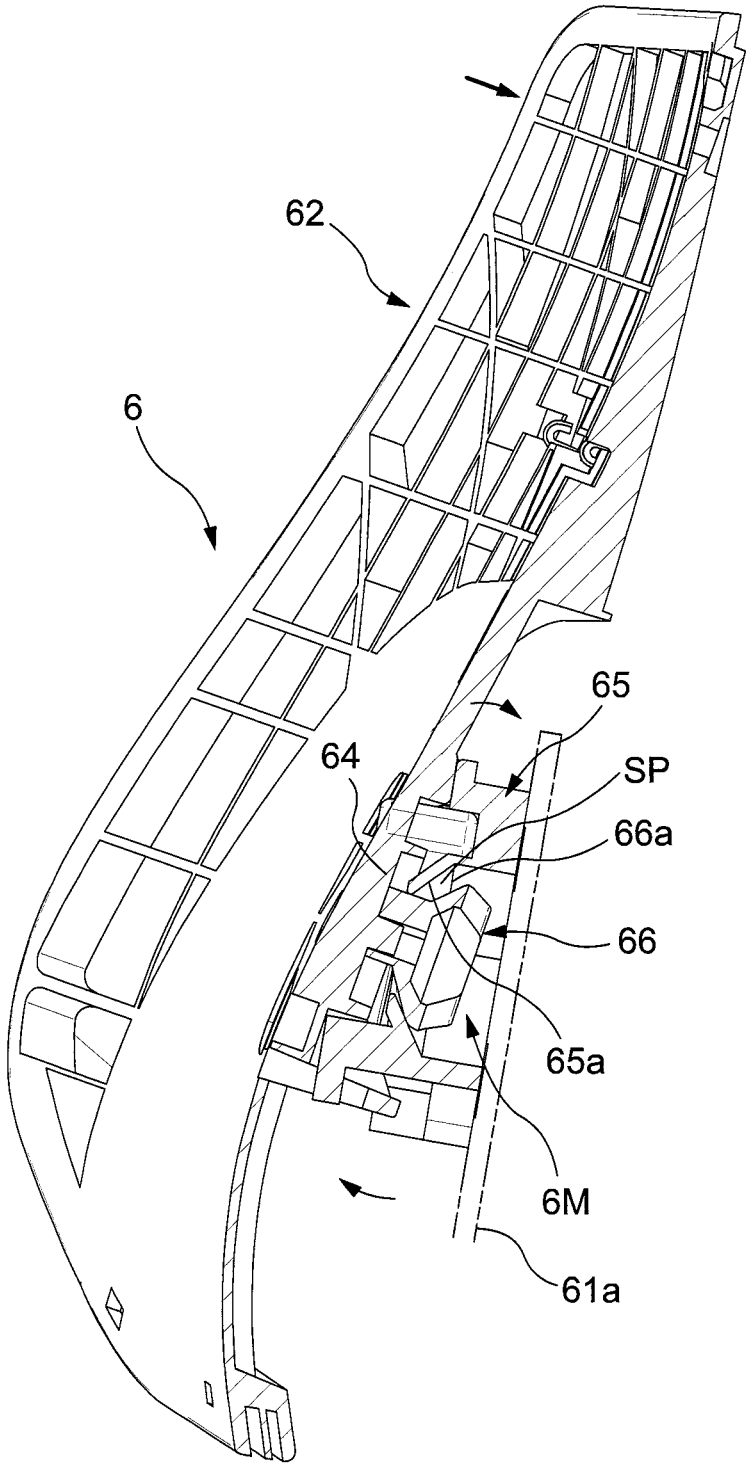
FIG. 33 is an operation explanatory diagram corresponding to FIG. 31.
Figure 34:
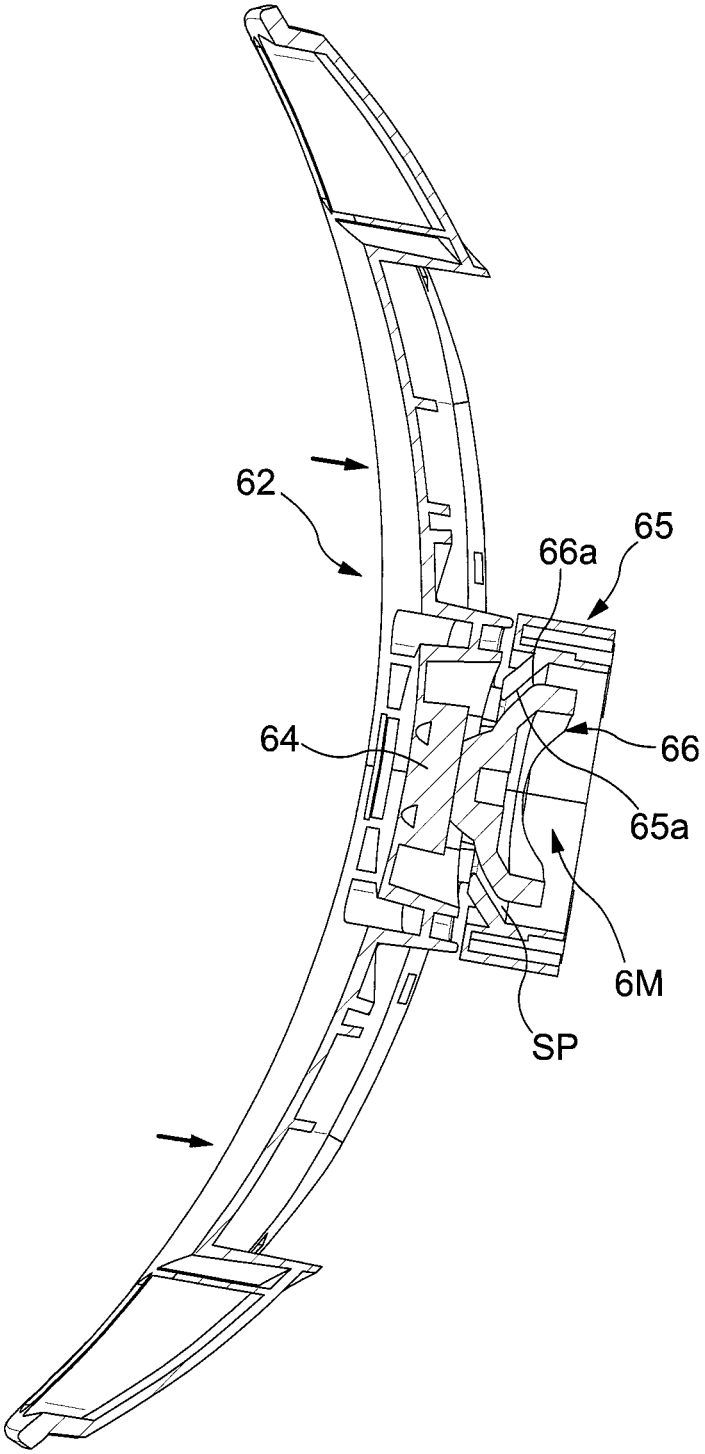
FIG. 34 is an operation explanatory diagram corresponding to FIG. 31.
Figure 35:
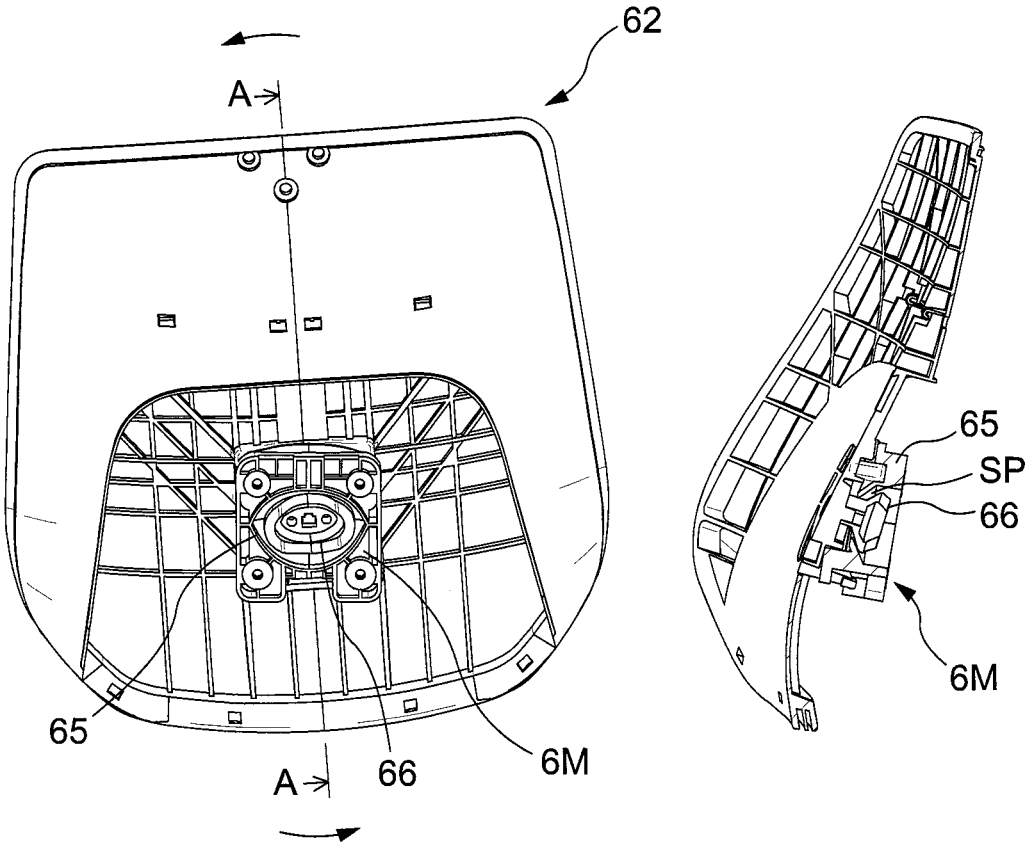
FIG. 35 is an operation explanatory diagram according to a turning operation of a backrest.

FIG. 33 illustrates a rearward tilted state when a load is applied to the upper part of the back 6, and FIG. 34 is a plane cross section thereof. Further, FIG. 35 illustrates a turning operation of the back 6 in a case where the seated person twists its body and the like.

That is, the backrest 62 is disposed in a positional relationship where the backrest 62 moves against the elastic reaction force in the rearward direction and the turning direction while being supported by the elastic body 67, and a configuration is such that, when the elastic body 67 is deformed to the front, rear, right, or left in accordance with the amount of turning movement in the front, rear, right, or left directions, the reaction force returning the backrest 62 to a neutral position increases. The turning direction includes a turning movement in the left-right direction in front view, as illustrated in FIG. 35, and further, in a clockwise or counterclockwise direction in front view.

The guide part 65*a* of the tilting part 65 and the guide part 66*a* of the pressing tool 66 included in the base part 64 are guided to, and a shape of the guide parts 66*a*, 65*a* are in pressure contact with each other to be guided by the elastic body 67 and stands still to the reference position illustrated in FIG. 31. Subsequently, when the pressure contact is loosened due to an elastic body 67 being compressed by a load being applied due to receiving pressure from the seated person, the guide part 65*a* of the tilting part 65 and the guide part 66*a* of the pressing tool 66 included in the base part 64 are at least partly separated, as illustrated in FIGS. 33, 34, and 35, so that the backrest 62 moves freely. The base part 64 and the tilting part 65 relatively move relative to the reference position in accordance with an amount of the received pressure and when the load is removed, the operating position is automatically returned, along the guide parts 66*a*, 65*a*, to the neutral position of FIG. 31 where the ridge line 66*ax* and the valley line 65*ax* coincide with each other. At this time, the backrest 62 is configured so that a gap SP between the guide parts 66*a*, 65*a* widens in accordance with a movement in the rear direction with respect to the back frame 61, and as a result, a turning range in the left-right direction expands and a return reaction force generated when the load is removed increases in accordance with the amount of turning movement in both the left and right directions.

Figure 36:
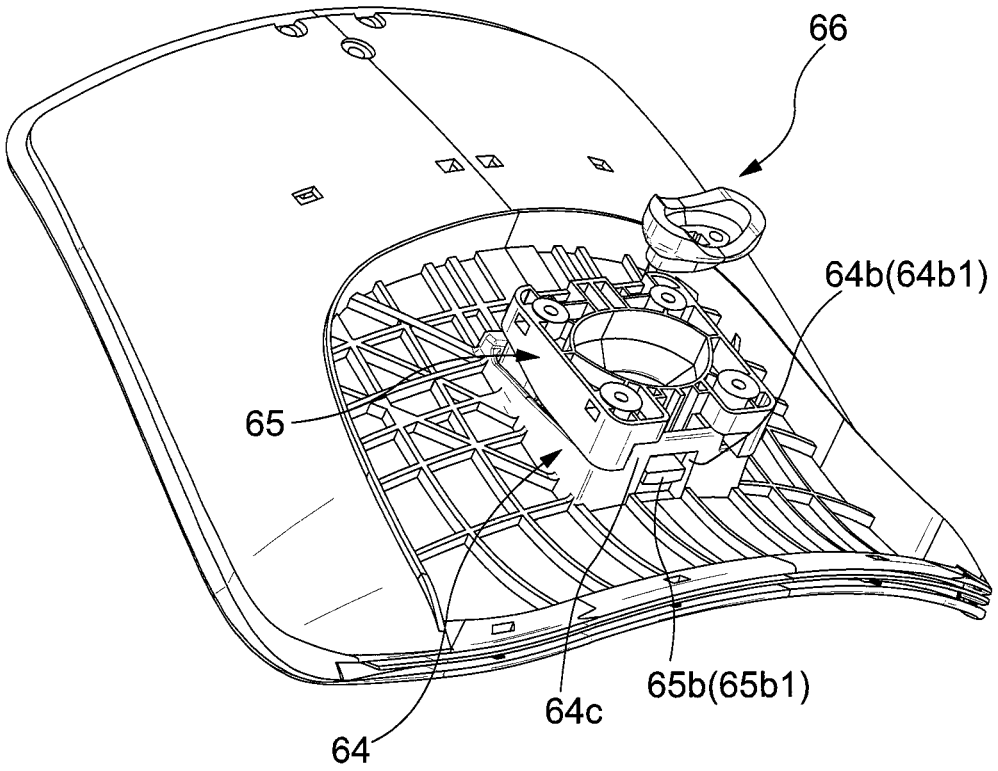
FIG. 36 is an exploded perspective view illustrating a restricting portion configured to restrict the operation of the back.

It is noted that, as illustrated in FIG. 36, the base part 64 and the tilting part 65 are provided with engaging elements 64*b*, 65*b* configured to restrict a relative movement of the base part 64 and the tilting part 65 in collaboration with the guide parts 65*a*, 66*a*. The base part 64 includes an upright wall 64*c* at a peripheral edge, and a window 64*b*1 to be the engaging part 64*b* opens in a rectangular shape in the upright wall 64*c*. On the other hand, in the tilting part 65, an L-shaped claw 65*b*1 to be the engaging part 65*b* is formed at a position displaced downward on the front side. Then, the base part 64 and the tilting part 65 are assembled with the claw 65*b*1 loosely fitted in the window 64*b*1, and a movable range of the tilting part 65 with respect to the base element 64 is restricted to a range where the claw 65*b*1 can move in the window 64*b*1. When the movable range is restricted, a part of the backrest load is also supported in this restriction portion.

As described above, the left-right turning operation of the back 6 occurs with respect to the back frame 61 and the seat 5 is attached to the front-rear swing part 3 to which the back frame 61 is attached, and thus, the back frame 61 and the seat 5 integrally swing in the left-right direction in front view, however, the backrest 62 further performs a different movement separately from the left-right turning operation of the seat 5 and the back frame 61.

It is noted that, in this embodiment, the base part 64 is attached to the backrest 62 and the tilting part 65 is attached to the side of the back frame 61, however, a configuration may be so that the base part 64 is attached to the side of the back frame 61 and the tilting part 65 is attached to the side of the backrest 62.

Next, a front support mechanism of the seat will be described.

As described above, in this chair, the seat 5 is configured to be supported to be swingable to the front, rear, right, or left with respect to the support base part 2, however, a feeling of pressure on a femoral region of the left and right legs of the seated person sitting on the chair configured to swing to front, rear, right, or left, may change to be unbalanced depending on the posture of the seated person. Further, in this chair, the back 6 is provided to tilt rearward behind the seat 5 and when the back 6 tilts rearward, the seat 5 moves together with the back 6 and performs an operation in which the front part of the seat 5 rises relative to the back part of the seat 5 which descends, and as a result, the seated person may experience a feeling of pressure on the femoral region of the legs when leaning rearward and anxiety or instability due to the legs of the seated person being lifted in the air.

Figure 38:
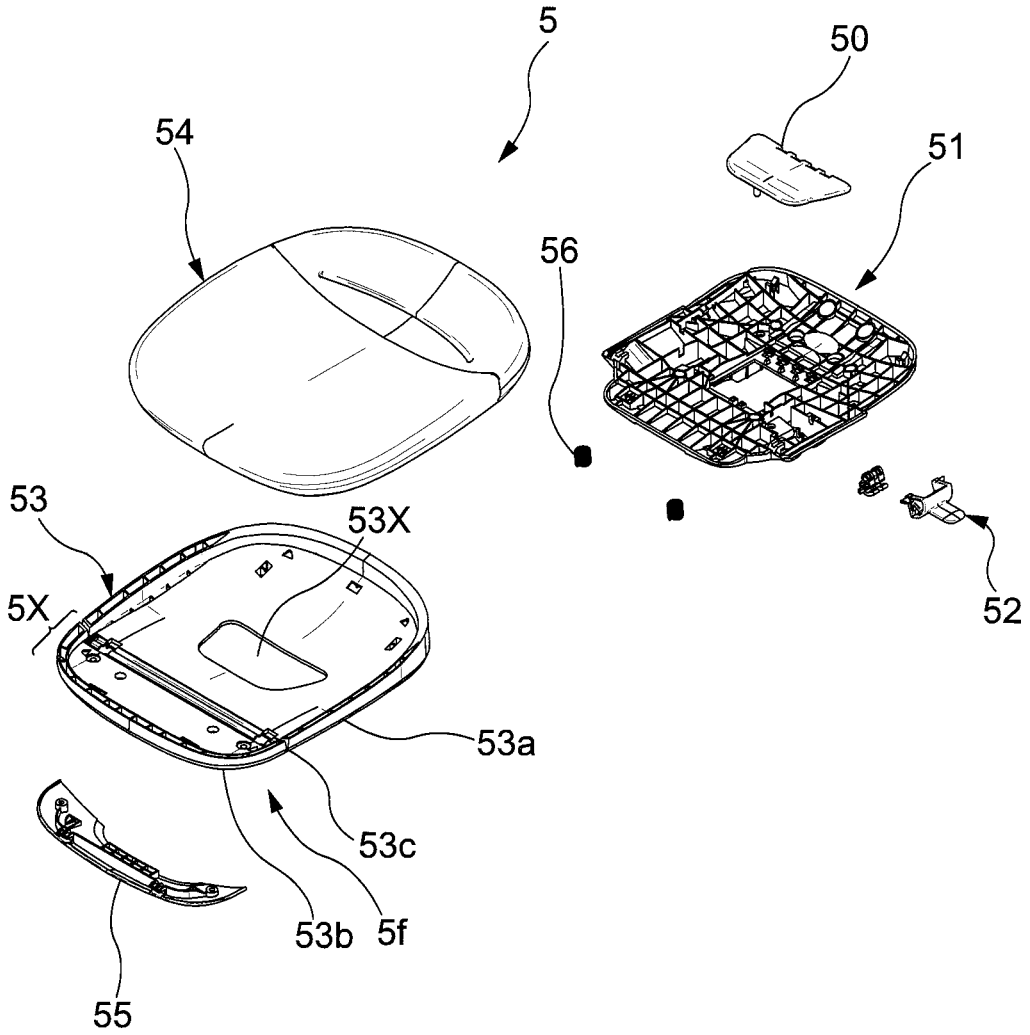
FIG. 38 is an exploded perspective view of the seat.
Figure 39:
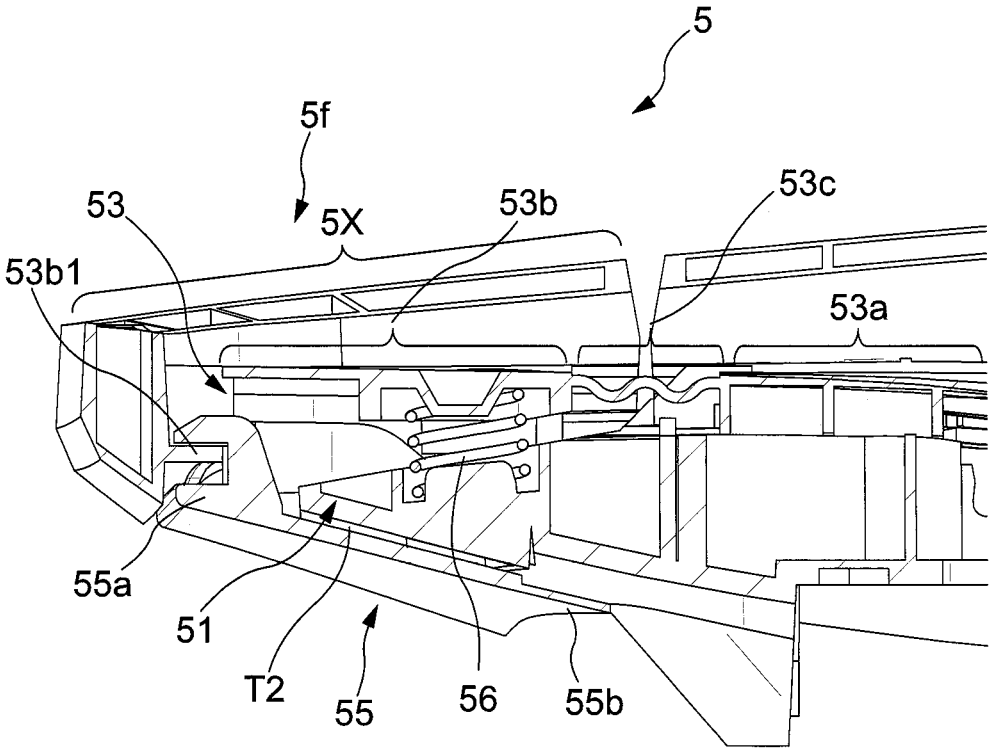
FIG. 39 is an enlarged cross-sectional view of a front part of the seat.

Thus, as illustrated in FIGS. 38, 37, and 39, this chair is provided with a deformation part 5X configured to change its shape in the up-down direction when receiving the load applied by seated person on a front part 5*f* of the seat 5.

The deformation part 5X is provided at a position receiving the weight of the legs of the seated person, and is configured to deform downward when receiving the weight of the legs and to return upward when the weight of the legs is removed.

Specifically, as illustrated in FIG. 38, in the seat 5, a cushion material 54 covered by a non-illustrated upholstery fabric is arranged on the seat inner shell 53, and the seat outer shell 51 is attached below the seat inner shell 53. The seat inner shell 53 is configured by connecting a rear part 53*a* and a front part 53*b* with a resin hinge part 53*c*, and the front part 53*b* is elastically deformed with respect to the rear part 53*a* with the resin hinge part 53*c* as a boundary. Together with this deformation, the cushion material 54 is also deformed, and thus, these portions configure the deformation part 5*x*.

Then, the seat outer shell 51 is fixed to the front-rear swing part 3, and the rear part 53*a* of the seat inner shell 53 is attached above the seat outer shell 51. Thus, the deformation part 5*x* including the front part 53*b* of the seat inner shell 53 is deformed toward the seat outer shell 51.

Figure 40:
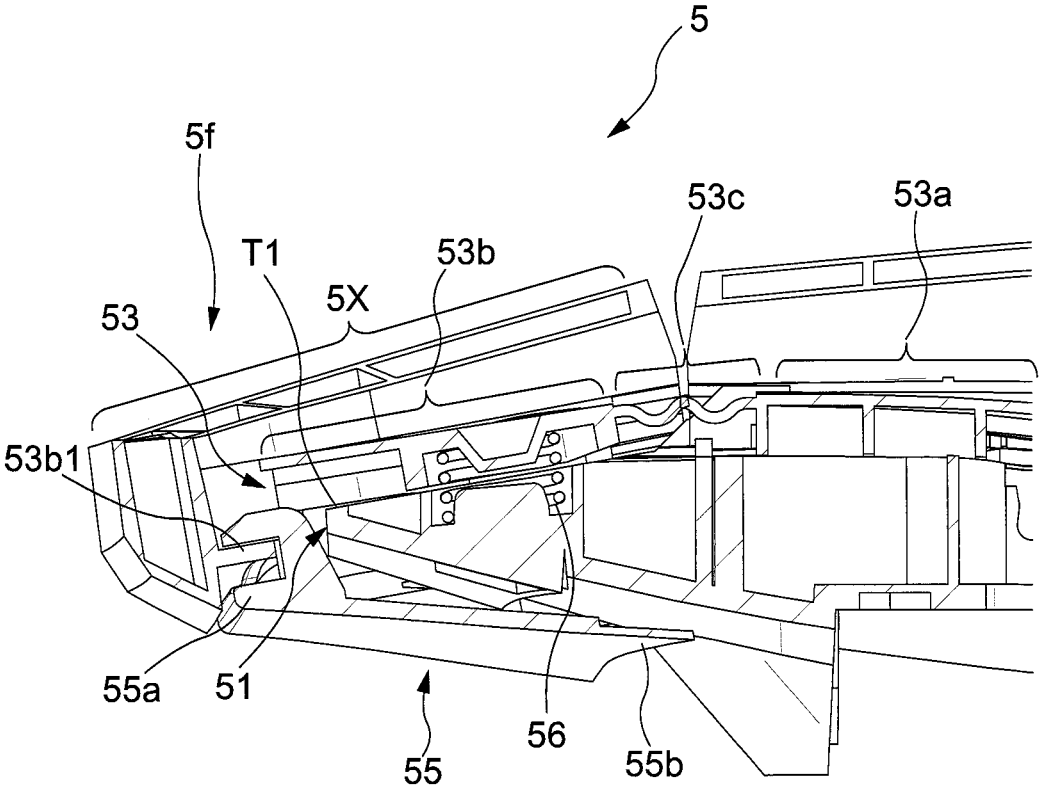
FIG. 40 is a diagram illustrating an operation of a deformation part.

In this embodiment, a front seat lower cover 55 is attached to the front part 53*b* forming the deformation part 5X of the seat inner shell 53, with the seat outer shell 51 interposed therebetween. Although FIG. 15 gives the impression that the front seat lower cover 55 is attached to the front part of the seat outer shell 51, the front seat lower cover 55 is actually arranged below the front part of the seat outer shell 51 in a non-connected state and is coupled to the deformation part 5X of the seat inner shell 53 above, as illustrated in FIGS. 39 and 40. As illustrated in FIG. 15, the left-right dimensions of the front seat lower cover 55 correspond substantially to the left-right dimensions of the front part 53*b* of the seat inner shell 53, and thus, a base end 55*a* of the front seat lower cover 55 is attached to an engaged part 53*b* 1 (refer to FIGS. 39 and 40) set in the front part 53*b* of the seat inner shell 53, with the seat outer shell 51 interposed therebetween and a rear end 55*b* of the front seat lower cover 55 is shaped to extend rearward and downward along the seat outer shell 51.

At two locations on the left and right of the front part of the seat outer shell 51, compression springs 56 being elastic bodies are arranged at positions compressed between the front part 53*b* of the seat inner shell 53 and the front part of the seat outer shell 51.

When the deformation part 5X at the side of the seat inner shell 53 approaches the seat outer shell 51, as illustrated in FIGS. 39 and 40, that is, when the deformation part 5*x* of the seat inner shell 53 is deformed downward while compressing the compression spring 56, an appropriate portion of the front part 53*b* of the seat inner shell 53 abuts against an upper front surface of the seat outer shell 51 (abutment point T1). Conversely, when the front part 53*b* of the seat inner shell 53 moves upward in a direction where the deformation of the deformation part 5*x* is eliminated by the compression springs 56, as illustrated in FIGS. 40 and 39, the front seat lower cover 55 abuts against a lower front surface of the seat outer shell 51 (abutment point T2). That is, a deformable range of the deformation part 5*x* of a seat inner shell 53*b* is restricted both downward and upward.

Here, as illustrated in FIGS. 37 and 39, a resin hinge part 53*c* is shaped as a corrugated plate having a series of uneven portions, and the deformation part 5X has a structure that easily causes, in accordance with an unbalanced load received in a left-side region and a right-side region of the seat 5, regardless of the up-down direction, torsional deformation so that one side of the seat 5 in the left-right direction is lifted higher than the other side.

Figure 2:
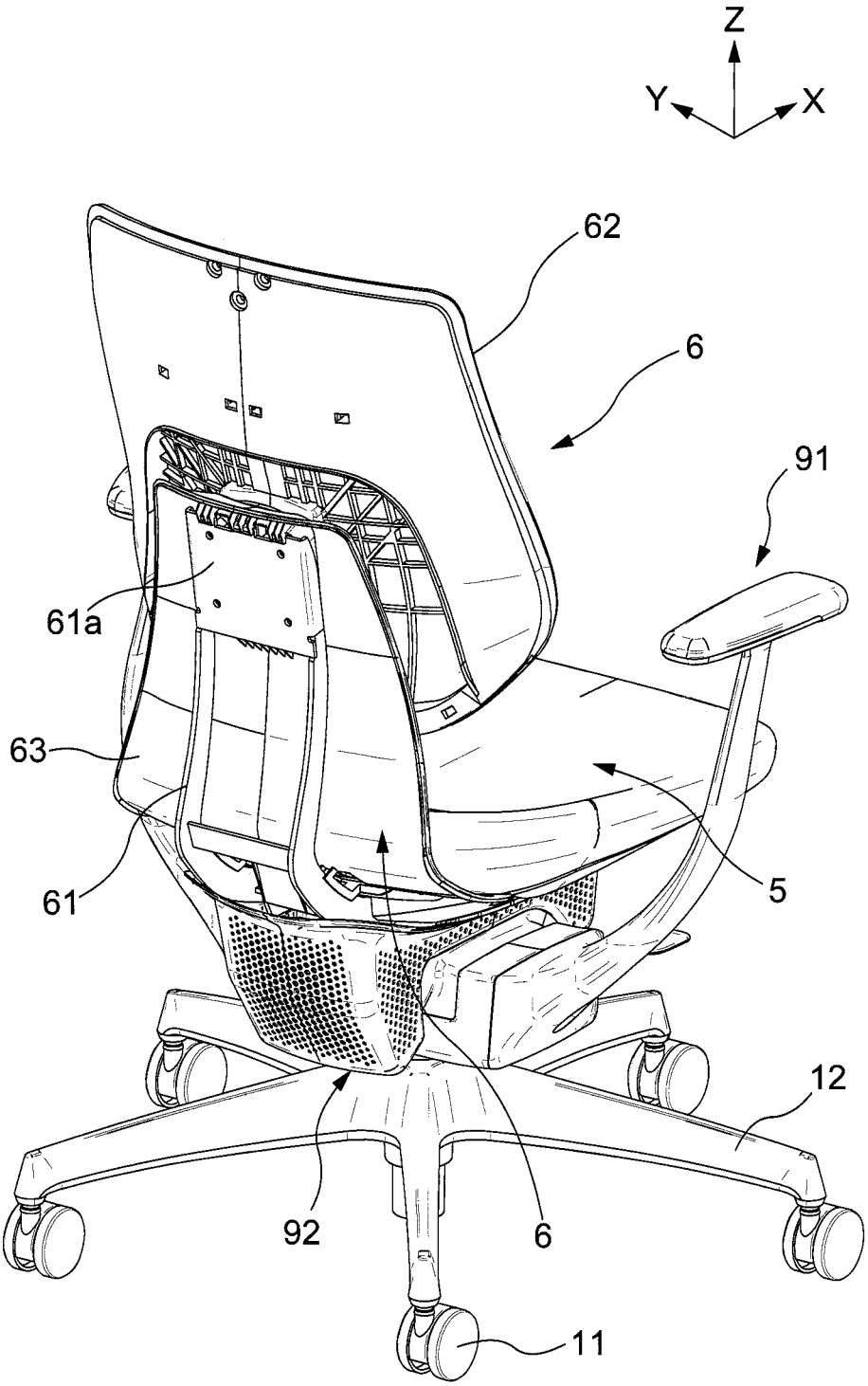
FIG. 2 is a perspective view thereof, as viewed obliquely from behind, in which a part of the chair is removed.

It is noted that, in the chair according to the present embodiment, as illustrated in FIGS. 1 and 2, a fixed attachment part 91 extending upward is attached to an arm attachment part 23 of the support base part 2 to bypass the seat 5 and even if the seat 5 swings to the front, rear, right, or left, the fixed attachment part 91 remains in a fixed position that does not interfere with the seat 5. Further, a movable cover mechanism 92 in which a plurality of covers are combined, is disposed below the seat 5 to not interfere with the relative operation of the front-rear swing part 3 and the left-right swing part 4 and to hide the front-rear swing part 3 and the left-right swing part 4.

As described above, the chair according to the present embodiment is configured such that the back 6 is arranged behind the seat 5, and the back 6 has an operation mechanism 6M turning-movable supporting the load received from a seated person in left-right direction in a front view, and when the load is applied, at least a part of guide parts 65*a*, 66*a* of the operation mechanism 6M is separated, and the back 6 moves freely, and when the applied load is removed, the back 6 automatically returns to the neutral position along the guide parts 65*a*, 66*a*.

Therefore, the back 6 is turning-movable in a front view in a left-right direction, and when the load is applied, at least a part of guide parts 65*a*, 66*a* of the operation mechanism 6M is separated, and the back 6 moves freely. Therefore, it can be easily adapted to various movement of the seated person. Further, when the seated person leaves a seat, the back 6 reliably returns to the neutral position along guide parts 65*a*, 66*a*. Therefore, even if the degree of freedom of back 6 movement is increased, a plurality of chairs is easily uniform in appearance when the seated person leaves a seat. Further, it is possible to avoid the situation in that the initial condition of the chair differs every time the seated person sits on the seat.

Further, the chair is configured such that a reaction force with which the back 6 returns to the neutral position becomes larger in accordance with an amount of turning movement to both of the left and right directions. Therefore, the load in turning direction is easily balanced and an appropriate reaction force in accordance with the seated person's posture is easily obtained.

Further, the back 6 is configured such that a backrest 62 is supported by a back frame 61 via the operation mechanism 6M, the back frame 61 is erected at the rear of the seat 5, and the backrest 62 is turning movably attached to the back frame 61 substantially clockwise or counterclockwise direction in a front view via the operation mechanism 6M. Therefore, the operation mechanism 6M is configured only by introducing a simple turning mechanism or loose convex-concave structure in a part of the backrest 62.

Further, the back 6 is configured such that the backrest 62 is supported by the back frame 61 via the operation mechanism 6M, and the backrest 62 moves via the operation mechanism 6M having an elastic body 67 toward the rear direction and the turning direction against an elastic reaction force. Therefore, supporting force and returning force in accordance with size of displacement can be provided by moving the backrest 62 against the elastic reaction force of the elastic body 67.

Further, the backrest 62 is configured such that a turning range to left-right direction becomes larger in accordance with the movement in the rear direction with respect to the back frame 61, and the turning operation of the seated person to left-right direction becomes larger as the seated person deeply leans against the backrest 62. Therefore, it is possible to realize the support that matches body movement of the seated person.

Further, the seat 5 is swingable in the left-right direction in a front view, and the back 6 performs a left-right turning operation separated from the seat 5. Therefore, left-right swinging of the seat 5 and left-right turning operation of the backrest 62 work together through the seated person's posture. In consequence, it is possible to realize an appropriate support state in accordance with the seated person's posture.

Further, the operation mechanism 6M is provided with a base part 64 and a tilting part 65, and includes a reference position, a guide part 66*a* set at the side of the base part 64 and a guide part 65*a* set at the side of the tilting part 65 are in pressure contact with each other to be guided by the shapes of the guide parts 66*a*, 65*a* and stopped at the reference position, and when the pressure contact is loosened by the received pressure from the seated person, the base part 64 and the tilting part 65 can be relatively changed from the reference position in accordance with the degree of the received pressure. Therefore, while the operation mechanism 6M has a simple structure, the operation mechanism 6M has a function to return to the reference position when the applied load is removed, and can be incorporated as an operation unit for various intended use including the present embodiment.

Further, the chair is configured such that the pressure contact of the both guide parts 66*a*, 65*a* is formed by the elastic body 67 and the elastic body 67 is pressed by the received pressure, whereby the guide part 65*a* of the tilting part 65 and the guide part 66*a* of the base part 64 are separated. Therefore, the elastic body 67 can serve as a role to flexibly receive the load of the backrest and as a role to return the guide parts, 66*a*, 65*a* to the reference position.

Further, the operation mechanism 6M includes: the base part 64 fixed to the backrest 62 and provided with the elastic body 67 on the back surface side of the base part 64; the tilting part 65*a* disposed at a position adjacent to the base part 64 and including a guide part 65*a* recessed in a tapered shape at the back surface side of the tilting part, the bottom part of the guide part 65*a* having an opening; and a pressing tool 66 including a guide part 66*a* having a convex shape corresponding to the guide part 65*a* of the tilting part on the front surface side of the pressing tool, the pressing tool 66 being fixed to the base part 64 via the opening of the tilting part 65 in a state where the guide part 66*a* of the pressing tool is fitted into the guide part 65*a* of the tilting part, and the tilting part 65 is fixed to the back support part 61*a* provided at the upper end part of the back frame 61. Accordingly, a structure that allows an easy assembly can be realized.

Further, one guide part 65*a* has a substantially partially elliptical mortar-like shape including at least one valley line 65*ax* and the other guide part 66*a* has a curved shape having at least one ridge line 66*ax* fitted smoothly into the valley line 65*ax*, and the valley line 65*ax* and the ridge line 66*ax* can be fitted into each other. With the structure, the positioning function at the reference position can be enhanced.

Further, the base part 64 and the tilting part 65 are provided with engaging parts 64*b*,65*b* configured to regulate a relative movement of the base part 64 and the tilting part 65 in collaboration with the guide parts 66*a*,65*a*, and a part of the load of the backrest is supported by these engaging parts, 64*b*, 65*b*. Therefore, it is possible to prevent the local load from concentrating on the guide parts. 66*a*, 65*a*.

Although an embodiment of the present invention was explained above, the specific configuration of each part is not limited to those in the embodiment described above.

Figure 41:
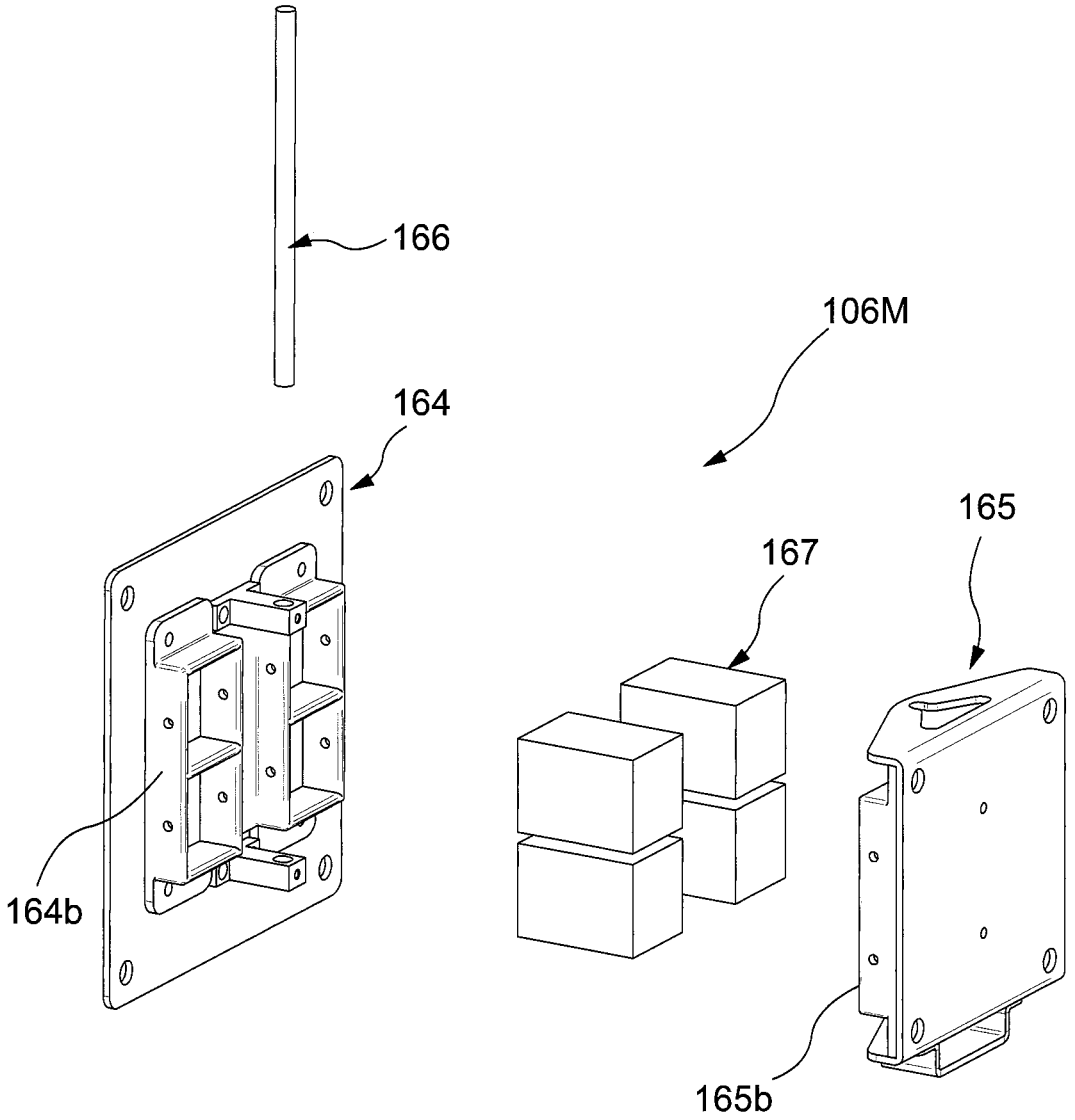
FIG. 41 is an exploded perspective view of operation mechanism according to modification of the present invention.
Figure 42:
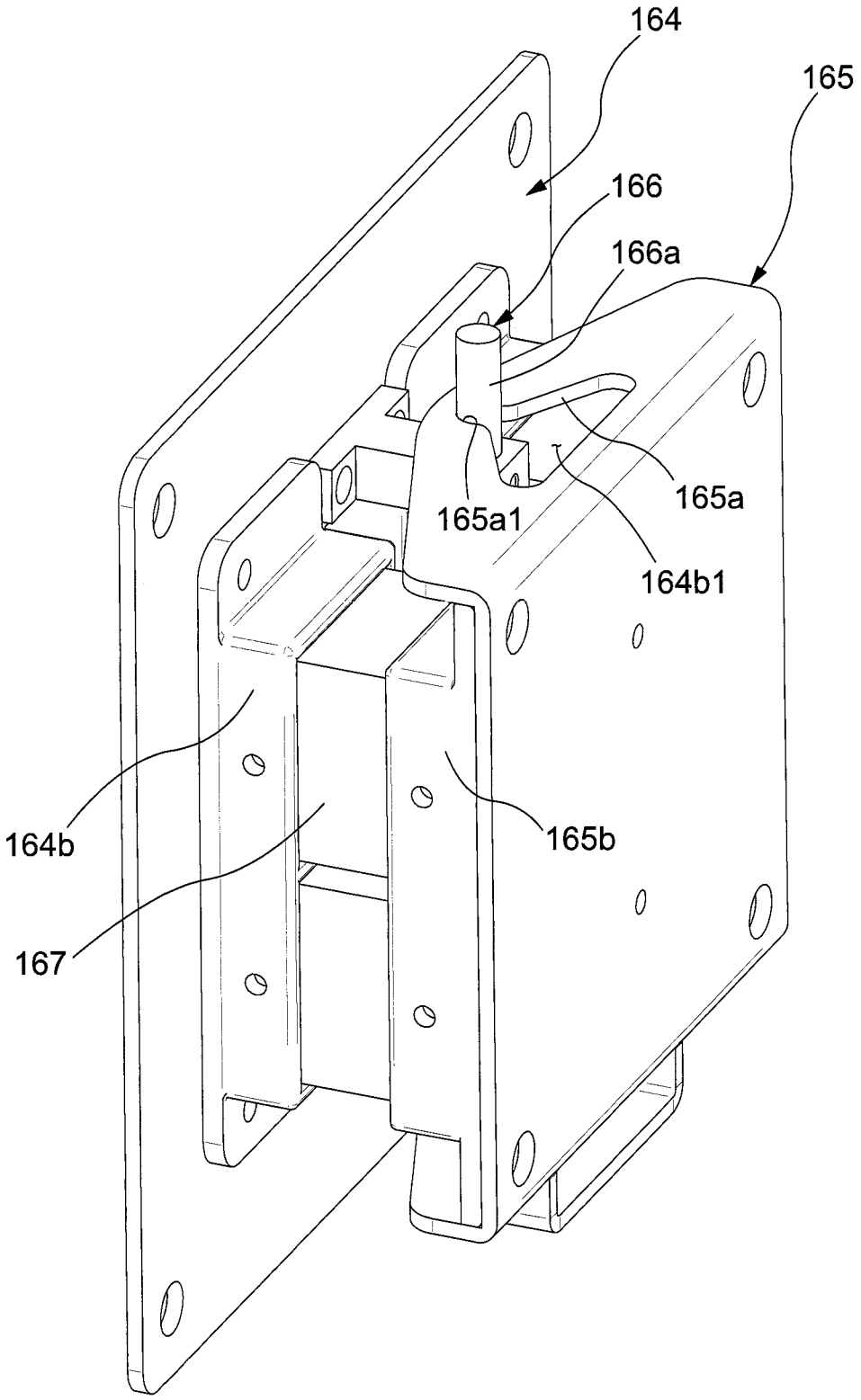
FIG. 42 is a perspective view of an assembled operation mechanism according to modification of the present invention.
Figure 43:
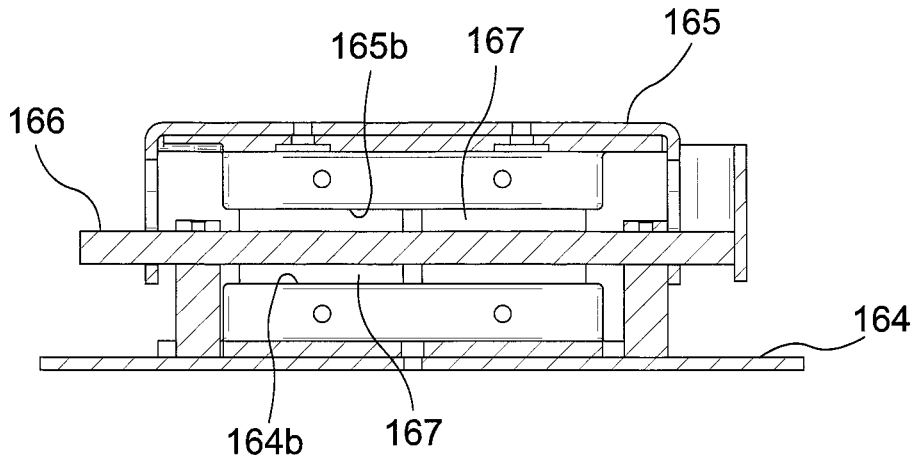
FIG. 43 is a cross-sectional view of the operation mechanism according to modification of the present invention.
Figure 43:
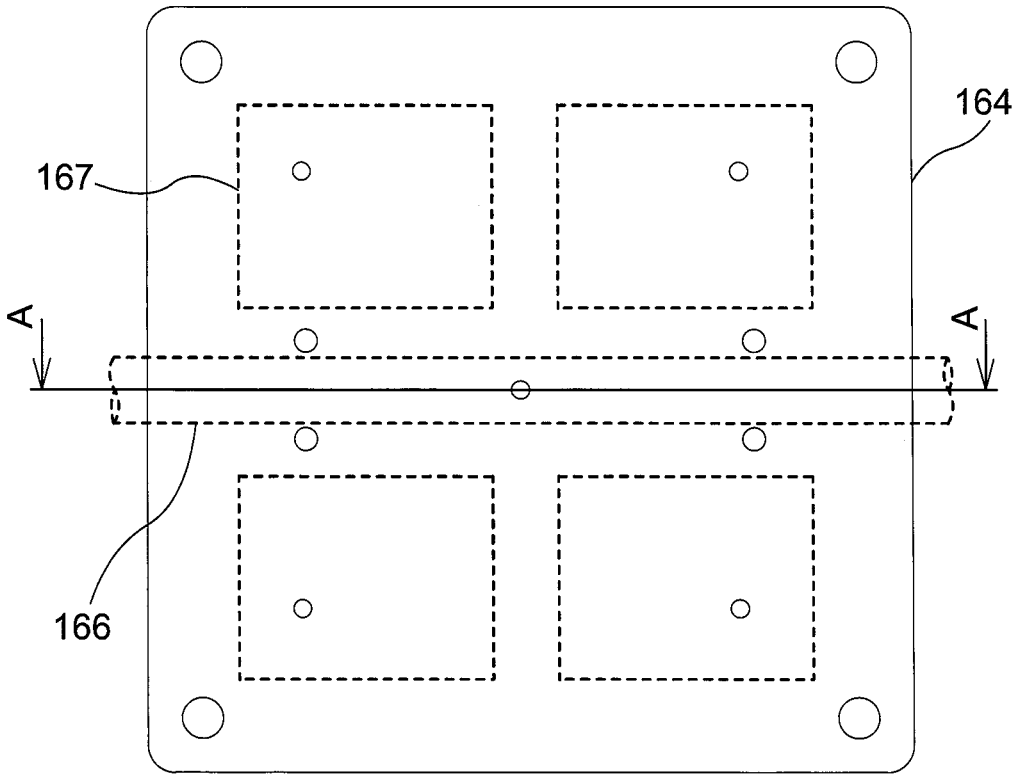

For example, the chair illustrated in FIGS. 41, 42 and 43 includes an operation mechanism 106M different from one of the above-described embodiments at the back to support turning-movably the load received from seated person in left-right direction in front view. The operation mechanism 106M is also configured such that when the load is applied, at least a part of guide parts, 165*a*, 166*a* of the operation mechanism is separated and the back moves freely, and when the applied load is removed, the operating position of the operation mechanism 160M automatically returns to the neutral position along the guide parts, 165*a*, 166*a* of the operation mechanism 106M.

Specifically, the operation mechanism 106M is provided with a base part 164 and a tilting part 165, and includes a reference position, a guide part 166*a* set at the side of the base part 164 and a guide part 165*a* set at the side of the tilting part 165 are in pressure contact with each other to be guided by the shapes of the guide parts 166*a*, 165*a*, and stopped at the reference position, and when the pressure contact is loosened by the received pressure from the seated person, the base part 164 and tilting part 165 can be relatively changed from the reference position in accordance with the degree of the received pressure. This function is also the same as one of the above-described embodiment.

However, the shapes of the guide parts, 166*a*, 165*a* are different from those of the above-described embodiment. One guide part 166*a* is a shaft-shaped part 166 extended upward and downward, or leftward and rightward and the other guide part 165*a* is a V-groove leading the upper-lower or left-right shaft-shaped part 166 to the center position, A semicircle groove bottom 165*a*1 that defines the reference position at the center of the groove is formed. The tilting part 165 is freely movable in a gap between the base part 164 and the shaft-shaped part 166. For the free movement, it is configured so as to be required to press an elastic body 167 interposed between the tilting part 165 and the base part 164 against the elastic force. In this case, the shaft-shaped part 166 is dividedly placed at the position avoiding the elastic body 167, and kept in the position by supporting members, 164*b*, 165*b*. With the configuration, the operation mechanism is simply realized.

Further, the V-groove is formed in a part of a window 164*b*1 being an engaging part and a part of the shaft-shaped part 166 being an engaging part is relatively-movable in the range controlled by the window 164*b*1. Therefore, it can be said that the base part 164 and the tilting part 165 are provided with the engaging parts configured to regulate the relative movement of the base part 164 and the tilting part 165 in collaboration with the guide parts, 165*a*, 166*a*. As a part of the load of the backrest is supported by the engaging part, it is possible to prevent the local load from concentrating on the guide part.

Then, even when this operation mechanism 106M is applied instead of the operation mechanism 6M described in the above-described embodiment, a configuration is realized that the back 6 is swingable in the left-right direction in a front view, and the back 6 performs a left-right turning operation separated from the seat 5.

Figure 44:
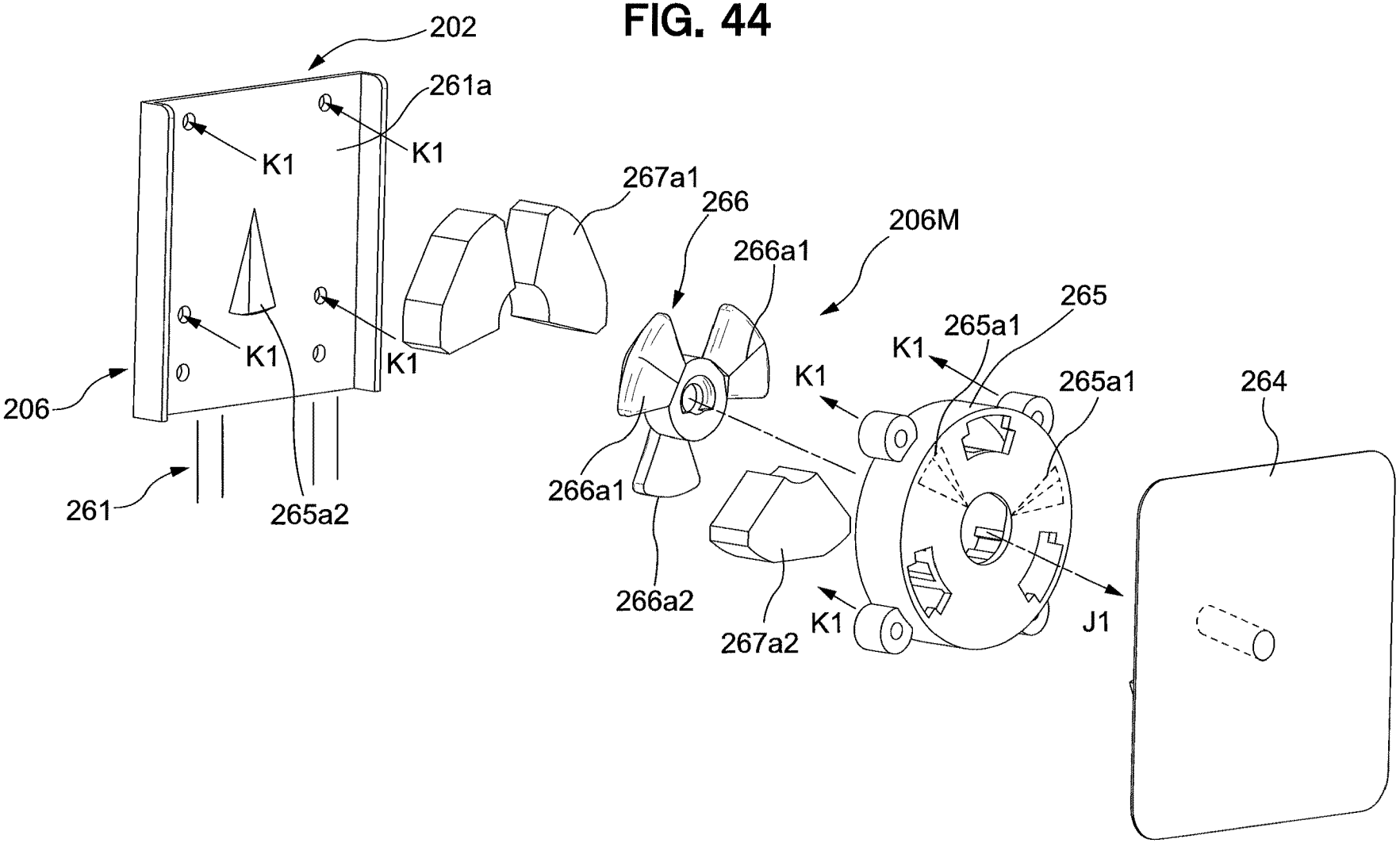
FIG. 44 is an exploded perspective view of the operation mechanism according to another modification of the present invention.
Figure 45:
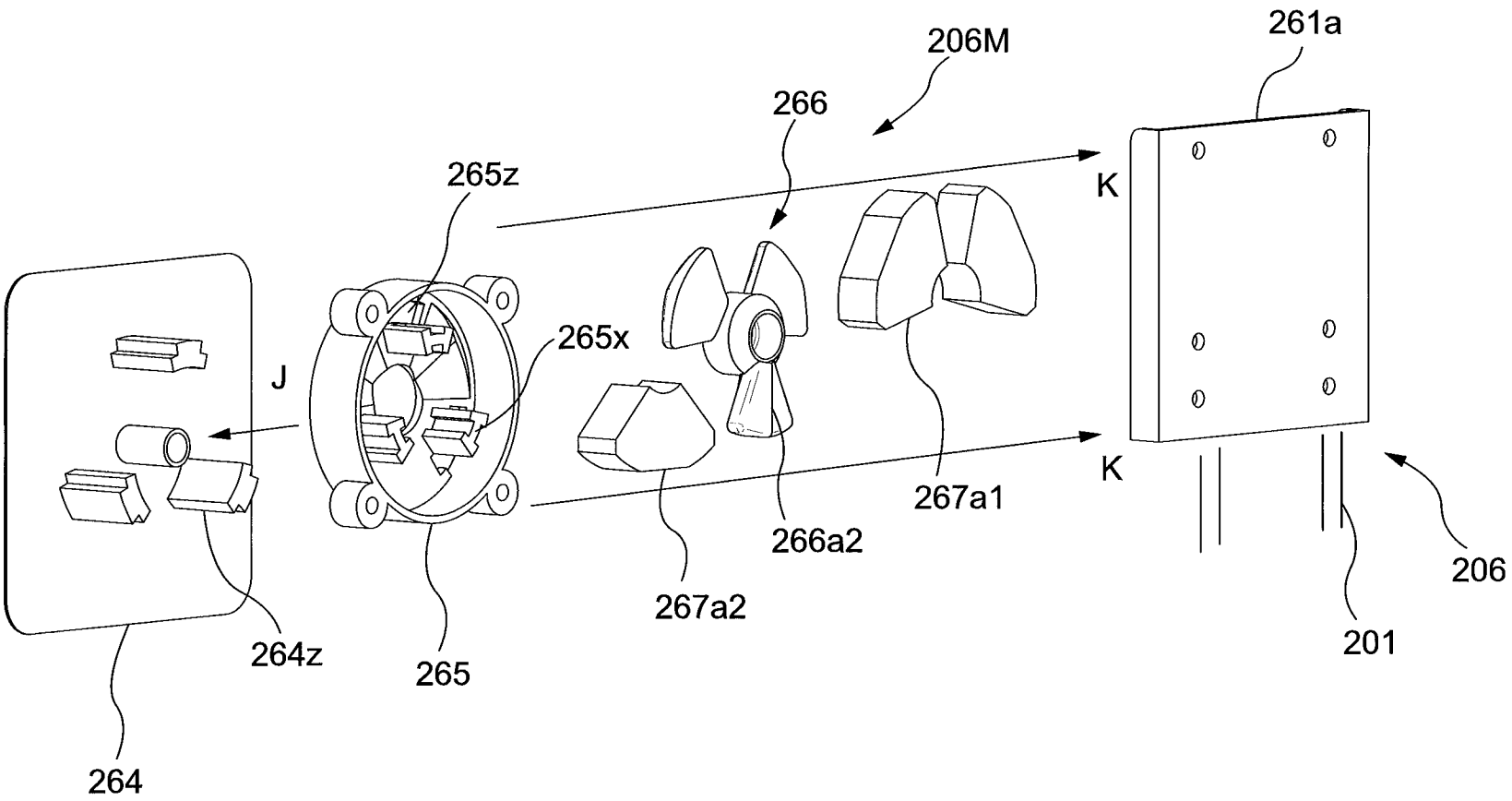
FIG. 45 is an exploded perspective view of the operation mechanism according to another modification of the present invention.
Figure 46A:
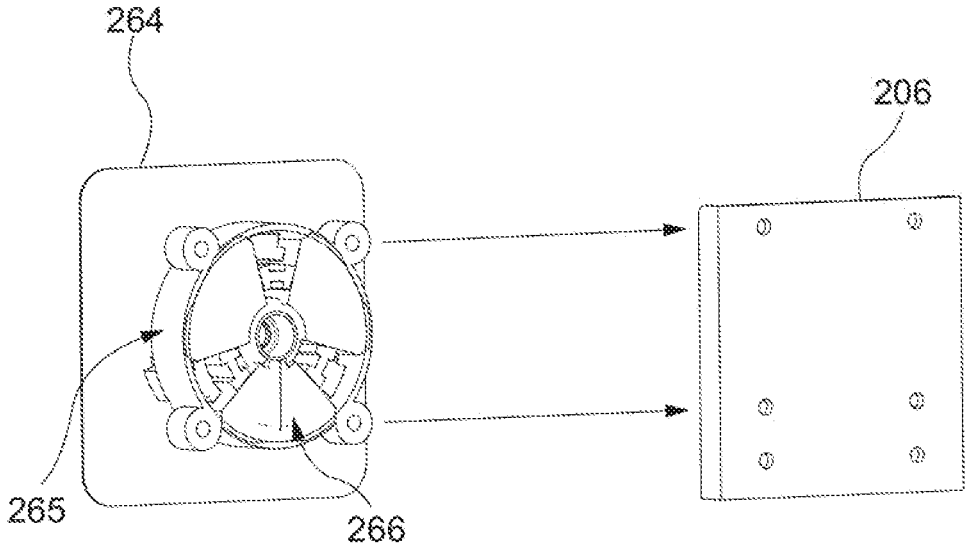
FIGS. 46A and B are perspective views of an assembled operation mechanism according to another modification of the present invention.
Figure 46B:
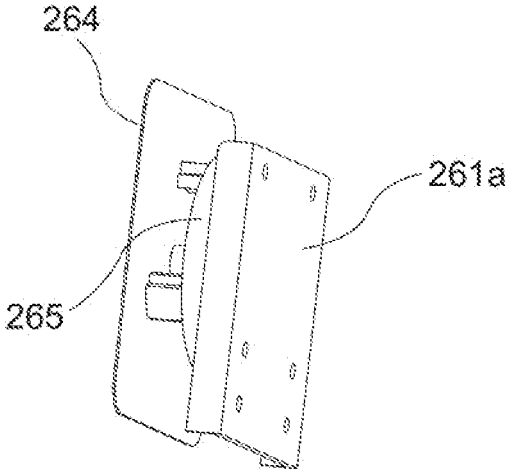

The chair illustrated in FIGS. 44, 45 and 46, is also configured such that the back 6 is arranged behind the seat, and the back has an operation mechanism 206M turning-movably supporting the load received from a seated person in a left-right direction in a front view, and when the load is applied, at least a part of guide parts 265*a*1, 266*a*1 (265*a*2, 266*a*2) of the operation mechanism is separated and the back moves freely, and when the applied load is removed, the operating position of the operation mechanism 206M automatically returns to the neutral position along the guide parts 265*a*1, 266*a*1 (265*a*2, 266*a*2) of the operation mechanism 206M.

Then, the seat is swingable in the left-right direction in a front view, and the back 6 performs a left-right turning operation separated from the seat.

Specifically, the operation mechanism 206M is provided with a base part 264, a tilting part 265, and a back frame received pressure part 261*a* at the upper end side of a back frame 261, and. includes a reference position, a first guide part 266*a*1 set at the side of the base part 264 and a first guide part 265*a*1 set at the side of the tilting part 265 are in pressure contact with each other, and pressure contact of a second guide part 266*a*2 set at the side of the base part 264 and a second guide part 265*a*2 set at the side of the back frame received pressure part 261*a* are in pressure contact with each other to be guided by the shapes of the guide parts 266*a*1, 265*a*1(266*a*1, 265*a*1) and stopped at the reference position, when the pressure contact is loosened by the received pressure from the seated person, the base part 264 is integrated with the pressing tool 266 in accordance with the degree of the received pressure and can be relatively changed from the reference position with respect to the tilting part 265 and the back frame received pressure part 261*a*.

The operation mechanism 206M includes: the base part 264 fixed to or formed integrally with the back plate included in the backrest, and provided with the pressing tool 266 at the side of the back surface in an a protruding condition; the tilting part 265 disposed at a position adjacent to the base part 264, including the first guide part 265*a*1 recessed in a tapered shape at the back surface side of the tilting part, the center of the tilting part 265 having an opening in front-rear direction; and the back frame received pressure part 261*a* placed at the position facing the tilting part 265 interposing the pressing tool 266 and having the second guide part 265*a*2 that is recessed in a tapered shape on the front surface side. The pressing tool 266 is provided with the first convex guide part 266*a*1 and the second convex guide part 266*a*2 corresponding to the first guide part 265*a*1 and the second guide part 265*a*2 on the front surface side or the back surface side. As shown by arrow J1 in the FIG. 44, 45, the pressing tool 266 is fixed to the base part 264 through the opening of the tilting part 265, and the tilting part 265 is drawn and fixed by a screw to the back support part 261*a* at the upper end side of the back frame 261 configuring the back 206 as shown by arrow K1. At this time, the first elastic body 267*a*1 is interposed between the pressing tool 266 and the back frame received pressure part 261*a*, and the second elastic body 267*a*2 is interposed between the pressing tool 266 and the tilting part 265.

That is, the pressing tool 266 is fixed to the base part 264 in a state where the tilting part 265 is interposed between the pressing tool 266 and the base part 264, whereby, the pressing tool 266 is integrated with the base part 264 and configures a part of the base part 264. The pressing tool 266 is freely movable in a gap between the base part 264 and the back frame received part 261*a*. To freely move, the pressing tool 266 is configured such that it is required to compress the elastic body 267 interposed among the tilting part 265, the back frame received pressure part 261*a* and the pressing tool 266 against the elastic force. The force in the direction where the guide part 266*a*1 of the pressing tool 266 is constantly fitted into by the elastic body 267*a*1, is applied to the guide part 265*a*1 of the tilting part 265, and the force in the direction where the guide part 266*a*2 of the pressing tool 266 is constantly fitted into by the elastic body 267*a*2, is applied to the guide part 265*a*2 of the back frame received pressure part 261*a*.

Therefore, the first guide part 266*a*1 and the second guide part 266*a*2 of the pressing tool 266 are provided with three protruding parts resembling propeller blade, and the first guide part 265*a*1 at the side of the tilting part 265 and the second guide part 265*a*2 at the side of the back frame received pressure part 261*a* that receive the protruding parts have a notch groove shape that receives a part of the three protruding parts. Specifically, the guide parts 266*a*1, 266*a*2 have a polygonal line part being a convex and the guide parts 265*a*1, 265*a*2 are in a notch shape having a valley line part.

When the seated person leans against a back 202, the first guide part 266*a*1 at the side of the base part 264 is separated from the first guide part 265*a*1 at the tilting side and the second guide part 266*a*2 at the side of the base part 264 is separated from the second guide part 265*a*2 at the side of the back frame received pressure part 261*a* while the pressing tool 266 at the side of the base part 264 presses the first, second elastic members 267*a*1, 267*a*2. Therefore, The base part 264 as well as the pressing tool 266 can freely move, when the applied load is removed, the first elastic member 267*a*1, the second elastic member 267*a*2 press the pressing tool 266 to the tilting part 265 and the back frame received pressure part 261*a*, and the first guide part 266*a*1 engages with the first guide part 265*a*1 and second guide part 266*a*2 engages with the second guide part 265*a*2. Therefore, the back returns to the reference position.

That is, when the load of the backrest is applied to an upper half from the center of the operation mechanism 206M, the behavior arises that the upper edge of the backrest moves the rearward and the lower edge of the backrest moves the forward around the center of the operation mechanism 206M, and the applied load of the backrest is removed, a reverse operation is performed. Thus, it is an effective support structure for the behavior of the back 6 that the upper edge of the backrest moves rearward or forward and the lower edge of the backrest moves forward or rearward.

It is noted that an object illustrated as the reference sign 265*x* in the drawing is a protrusion for dividing and storing the elastic part 267. The protrusion 264*z* and the opening 265*z* illustrated in the drawings make up an engaging part that regulates the range of free movement of the base part 264.

With the above-described configuration, functions and effects according to the above-described embodiment can be obtained.

Various other changes may be applied to other configurations without departing from the spirit of the present invention.

INDUSTRIAL APPLICABILITY

Since the chair according to the present invention is configured as described above, the chair can be utilized especially suitably in an office and the like.

DESCRIPTION OF REFERENCE NUMERALS

5 . . . Seat
6 . . . Back
6M . . . Operation mechanism
61 . . . Back frame
61*a* . . . Received pressure part
62 . . . Backrest
67 . . . Elastic body
64 . . . Base part
64*b* . . . Engaging part
65 . . . Tilting part
65*a* . . . Guide part
65*b* . . . Engaging part
65*ax* . . . Valley line
66 . . . Pressing tool
66*a* . . . Guide part
66*ax* . . . Ridge line
106M . . . Operation mechanism
165*a* . . . Guide part (V-groove)
166*a* . . . Guide part
164 . . . Base part
165 . . . Tilting part
166 . . . Shaft-shaped part
167 . . . Elastic body
164*b*1 . . . Engaging part (window)
206M . . . Operation mechanism
264 . . . Base part
265 . . . Tilting part
265*a*1 . . . First guide part
265*a*2 . . . Second guide part
266*a*1 . . . First guide part
266*a*2 . . . Second guide part
267*a*1 . . . First elastic member
267*a*2 . . . Second elastic member

The invention claimed is:

1. A chair, wherein the chair is configured such that a back is arranged behind a seat, and the back has an operation mechanism turning-movably supporting the load received from a seated person in a left-right direction in a front view, and when the load is applied, at least a part of guide part of the operation mechanism is separated and the back moves freely, and when the applied load is removed, the back automatically returns to the neutral position along the guide part, wherein the operation mechanism is provided with a base part and a tilting part, and includes a reference position, a guide part set at the side of the base part and a guide part set at the side of the tilting part are in pressure contact with each other to be guided by the shapes of the guide parts and stopped at the reference position, and when the pressure contact is loosened by the received pressure from the seated person, the base part and the tilting part can be relatively changed from the reference position in accordance with the degree of the received pressure, wherein the chair is configured such that the pressure contact of the both guide parts is formed by the elastic body and the elastic body is pressed by the received pressure, whereby the guide part of the tilting part and the guide part of the base part are separated, wherein the operation mechanism includes: the base part fixed to the backrest and provided with the elastic body on the back surface side of the base part; the tilting part disposed at a position adjacent to the base part and including a guide part recessed in a tapered shape at the back surface side of the tilting part, the bottom part of the guide part having an opening; and a pressing tool including a guide part having a convex shape corresponding to the guide part of the tilting part on the front surface side of the pressing tool, the pressing tool being fixed to the base part via the opening of the tilting part in a state where the guide part of the pressing tool is fitted into the guide part of the tilting part, and the tilting part is fixed to the received pressure part provided at the upper end part of the back frame.

2. The chair according to claim 1, wherein the chair is configured such that a reaction force with which the back returns to the neutral position becomes larger in accordance with an amount of turning movement to both of the left and right directions.

3. The chair according to claim 1, wherein the back is configured such that a backrest is supported by a back frame via the operation mechanism, the back frame is erected at the rear of the seat, and the backrest is turning-movably attached to the back frame substantially clockwise or counterclockwise direction in a front view via the operation mechanism.

4. The chair according to claim 3, wherein the backrest is configured such that a turning range to the left-right direction becomes larger in accordance with the movement in the rear direction with respect to the back frame.

5. The chair according to claim 1, wherein the back is configured such that the backrest is supported by the back frame via the operation mechanism, and the backrest moves via the operation mechanism having an elastic body toward the rear direction and the turning direction against an elastic reaction force.

6. The chair according to claim 1, wherein the chair is configured such that the seat is swingable in the left-right direction in a front view, and the back performs a left-right turning operation separated from the seat.

7. The chair according to claim 1, wherein one guide part of both the guides is a shaft-shaped part extended upward and downward, or leftward and rightward and the other guide part is a V-groove leading the upper-lower or left-right shaft-shaped part to the center position.

8. The chair according to claim 1, wherein the base part and the tilting part are provided with engaging part configured to regulate a relative movement of the base part and the tilting part in collaboration with the guide parts.

9. The chair according to claim 1, wherein the operation mechanism is provided with the base part, the tilting part, and the back frame received pressure part, and includes a reference position, a first guide part set at the side of the base part and a first guide part set at the side of the tilting part are in pressure contact with each other, and a second guide part set at the side of the base part and a second guide part set at the side of the back frame received pressure part are in pressure contact with each other, whereby these first guide parts and second guide parts are guided by the shapes of the first guide parts and the second guide parts, and stopped at the reference position, when the pressure contact is loosened by the received pressure from the seated person, the tilting part can be relatively changed from the reference position with respect to the base part and the back frame received pressure part in accordance with the degree of the received pressure.

10. The chair according to claim 9, wherein the chair is configured such that pressure contact of the first guide parts is formed by a first elastic body and pressure contact of the second guide parts is formed by a second elastic body, and the first and the second elastic bodies are pressed by the received pressure, respectively, whereby the first guide parts are separated from each other and the second guide parts are separated from each other.

11. The chair according to claim 9, wherein the base part is provided with three protrusion parts, and some of the three protrusion parts are provided with the first guide part and the other of the three protrusion parts are provided with the second guide part, and the tilting part side is in a shape which receives a first protrusion part of the base part provided with the first guide part and the back frame received pressure part side is in a shape which receives a second protrusion part of the base part provided with the second guide part, and the first elastic body is placed between the first protrusion part and the back frame received pressure part and the second elastic body is placed between the second protrusion part and the tilting part.

12. A chair, wherein the chair is configured such that a back is arranged behind a seat, and the back has an operation mechanism turning-movably supporting the load received from a seated person in a left-right direction in a front view, and when the load is applied, at least a part of guide part of the operation mechanism is separated and the back moves freely, and when the applied load is removed, the back automatically returns to the neutral position along the guide part, wherein the operation mechanism is provided with a base part and a tilting part, and includes a reference position, a guide part set at the side of the base part and a guide part set at the side of the tilting part are in pressure contact with each other to be guided by the shapes of the guide parts and stopped at the reference position, and when the pressure contact is loosened by the received pressure from the seated person, the base part and the tilting part can be relatively changed from the reference position in accordance with the degree of the received pressure, wherein the chair is configured such that the pressure contact of the both guide parts is formed by the elastic body and the elastic body is pressed by the received pressure, whereby the guide part of the tilting part and the guide part of the base part are separated, wherein one guide part has a substantially partially elliptical mortar-like shape including at least one valley line and the other guide part has a curved shape having at least one ridge line fitted smoothly into the valley line, and the valley line and the ridge line can be fitted into each other.

13. The chair according to claim 12, wherein the chair is configured such that a reaction force with which the back returns to the neutral position becomes larger in accordance with an amount of turning movement to both of the left and right directions.

14. The chair according to claim 12, wherein the back is configured such that a backrest is supported by a back frame via the operation mechanism, the back frame is erected at the rear of the seat, and the backrest is turning-movably attached to the back frame substantially clockwise or counterclockwise direction in a front view via the operation mechanism.

15. The chair according to claim 12, wherein the backrest is configured such that a turning range to the left-right direction becomes larger in accordance with the movement in the rear direction with respect to the back frame.

16. The chair according to claim 12, wherein the back is configured such that the backrest is supported by the back frame via the operation mechanism, and the backrest moves via the operation mechanism having an elastic body toward the rear direction and the turning direction against an elastic reaction force.

17. The chair according to claim 12, wherein the chair is configured such that the seat is swingable in the left-right direction in a front view, and the back performs a left-right turning operation separated from the seat.

18. The chair according to claim 12, wherein one guide part of both the guides is a shaft-shaped part extended upward and downward, or leftward and rightward and the other guide part is a V-groove leading the upper-lower or left-right shaft-shaped part to the center position.

* * * * *